US006077636A

United States Patent [19]

Moriki et al.

[11] Patent Number: 6,077,636

[45] **Date of Patent: *Jun. 20, 2000**

[54] TONER, TWO-COMPONENT DEVELOPER, IMAGE FORMING METHOD AND APPARATUS UNIT

[75] Inventors: Yuji Moriki, Susono; Kenji Okado; Hiroaki Kawakami, both of Yokohama; Shinya Yachi, Numazu; Michihisa Magome, Shizuoka-ken, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/235,397

[22] Filed: Jan. 22, 1999

[30] Foreign Application Priority Data

Jan. 28, 1998 [JP] Japan ..... 10-015452
Jun. 18, 1998 [JP] Japan ..... 10-171578

[51] Int. Cl.[7] ..... G03G 13/01; G03G 9/097; G03G 15/22

[52] U.S. Cl. ..... 430/45; 430/110; 430/111; 430/126; 399/252

[58] Field of Search ..... 430/45, 110, 111, 430/126; 399/252

[56] References Cited

U.S. PATENT DOCUMENTS

| | | | |
|---|---|---|---|
| 4,950,575 | 8/1990 | Shiozaki et al. | 430/110 |
| 5,240,803 | 8/1993 | Ota | 430/110 |
| 5,272,040 | 12/1993 | Nakasawa et al. | 430/111 |
| 5,712,072 | 1/1998 | Inaba et al. | 430/111 |
| 5,771,426 | 6/1998 | Oka et al. | 399/119 |
| 5,809,378 | 9/1998 | Kukimoto et al. | 430/111 |
| 5,827,632 | 10/1998 | Inaba et al. | 430/110 |

*Primary Examiner*—Roland Martin
*Attorney, Agent, or Firm*—Fitzpatrick, Cella, Harper & Scinto

[57] ABSTRACT

A toner is comprised of toner particles containing at least a binder resin and a colorant, and an external additive fine powder. The toner particles have a specific circularity distribution and a specific particle size distribution. The external additive fine powder has an inorganic fine powder having as primary particles a specific number-average particle length, and a non-spherical inorganic fine powder formed by coalescence of particles and having a specific shape factor and a specific number-average particle length.

95 Claims, 10 Drawing Sheets

TONER, TWO-COMPONENT DEVELOPER, IMAGE FORMING METHOD AND APPARATUS UNIT

BACKGROUND OF THE INVENTION

1. Field of the Invention

This invention relates to a toner used in recording processes utilizing electrophotography, electrostatic recording, magnetic recording or toner-jet recording. More particularly, this invention relates to a toner used in copying machines, printers and facsimile machines in which a toner image is formed previously on an electrostatic latent image bearing member and thereafter the toner image is transferred to a transfer medium to form an image, and also relates to a two-component developer, an image forming method and an apparatus unit which make use of the toner.

2. Related Background Art

Image forming apparatus are well known conventionally in which an electrostatic latent image is formed on a photosensitive member (drum) by means of an exposure optical system, the electrostatic latent image formed is developed by a developing apparatus to form a toner image and the toner image formed is transferred to recording paper and then fixed thereto.

Developers used in such a developing apparatus include a one-component developer and a two-component developer. In the one-component developer, toner particles are charged electrostatically by friction between toner particles one another or friction with a suitable charging member, and the toner particles thus charged are carried by a developing sleeve of the developing apparatus and then come to adhere to latent image areas on the surface of the photosensitive member to form a toner image.

Now, in the formation of such a toner image, especially in the case of the one-component developer, a lowering of fluidity of the developer because of, e.g., leaving a developing assembly to stand for a long period of time may result in a strong adhesion between toner particles to make it impossible to effect satisfactory charging of the toner particles, so that what is called "uneven images" or "dimmed images" occurs, which is a phenomenon such that visible images are formed non-uniformly even though latent images are uniform. As a method for preventing it, conventionally put into wide use is a method of agitating the developer previously in the developing apparatus to impart fluidity thereto.

However, any excessive agitation of the developer may accelerate toner deterioration, which has been a cause of short service life of developers.

The two-component developer is constituted of magnetic carrier particles and non-magnetic toner particles made of a synthetic resin, blended in an appropriate blend ratio. The toner particles are charged electrostatically upon mixing with the carrier particles, and the toner particles thus charged are carried by a developing sleeve of the developing apparatus and then come to adhere to latent image areas on the surface of the photosensitive member to form a toner image. As a developing method making use of such a two-component developer, what is called magnetic-brush development is disclosed in, e.g., Japanese Patent Applications Laid-Open No. 55-32060 and No. 59-165082, in which a magnetic brush is formed on the surface of a developing sleeve provided internally with a magnet, by the use of a two-component developer comprised of carrier particles and toner particles, the magnetic brush thus formed is rubbed against, or brought close to, a photosensitive drum opposed to the developing sleeve while keeping a minute development gap between them, and an alternating electric field is applied continuously across the developing sleeve and the photosensitive drum (between S-D) to cause the toner particles repeatedly to transit from the developing sleeve side to the photosensitive drum side and vice versa, to carry out development.

In such magnetic brush development making use of a two-component developer, the toner particles are charged triboelectrically by mixing them with carrier particles. Since the carrier particles have a higher specific gravity than the toner particles, the toner particles undergo a high mechanical strain because of their friction with the carrier particles when mixed, so that the deterioration of toner tends to accelerate with the progress of development operated repeatedly.

Once such deterioration of toner has occurred, it may cause concretely such phenomena that the density of fixed images changes as a result of long-term service, that the toner particles adhere partly to non-image areas to cause what is called "fog" and that minute-image reproducibility becomes poor.

As a result of extensive studies, the present inventors have elucidated that the above toner deterioration has relation to the following three phenomena.

The first phenomenon is break of toner particles into fine particles.

When toners whose particles have a rugged shape and are individually different in shape, as typified by pulverization toners commonly used, are agitated in the developing apparatus over a long period of time, it has been revealed that the toner particles break especially at their convexes to become fine particles as a result of collision of the toner particles against a developer carrying member or against toner particles one another.

The second phenomenon is that particles of an external additive become buried in toner particle surfaces ("surfaces" used in this context are herein meant to be outermost layer portions).

When the toners whose particles have a rugged shape and are individually different in shape as in pulverization toners are used, fine particles used as external additive particles stand buried in the surfaces of toner particles at their convexes, whereas the external additive particles have been found not to be buried at their concaves. Meanwhile, when toner particles having spherical particle shapes as typified by polymerization toners are used, it has been revealed that the toner particles neither break nor become fine particles but fine particles added as an external additive stand buried uniformly in the surfaces of toner particles.

The third phenomenon is that toner particles become non-uniform in charging performance.

In use of conventionally known commonly available toner particles, measurement of their charge distribution has revealed that the charge distribution becomes broad when toner particles are agitated in the developing apparatus over a long period of time, compared with that before agitation.

SUMMARY OF THE INVENTION

An object of the present invention is to solve the above problems.

Another object of the present invention is to provide a toner that can form fog-free images, having superior image-density stability and minute-image reproducibility without causing deterioration of toner even in its long-term service;

and a two-component developer, an image forming method and an apparatus unit which make use of such a toner.

To achieve the above objects, the present invention provides a toner comprising toner particles containing at least a binder resin and a colorant, and an external additive fine powder, wherein;

in circularity distribution of particles and in particle size distribution on the basis of circle-corresponding diameter, measured with a flow type particle image analyzer, the toner has an average circularity of from 0.950 to 0.995, and contains particles with circle-corresponding diameters of from 0.60 μm to less than 2.00 μm, having a maximum value X in the region of circle-corresponding diameters of from 3.0 μm to 9.0 μm and having a maximum value Y in the region of circle-corresponding diameters of from 0.60 μm to 2.00 μm, in an amount of from 8.0% by number to 30.0% by number; and the external additive fine powder has, on the toner particles, at least an inorganic fine powder (A) having as primary particles a number-average particle length of from 1 mμm to 30 mμm and a non-spherical inorganic fine powder (B) formed by coalescence of a plurality of particles and having a shape factor SF-1 greater than 150 and a number-average particle length of from 30 mμm to 600 mμm.

The present invention also provides a two-component developer comprising (I) a toner having at least toner particles containing at least a binder resin and a colorant, and an external additive fine powder, and (II) a carrier, wherein;

in circularity distribution of particles and in particle size distribution on the basis of circle-corresponding diameter, measured with a flow type particle image analyzer, the toner has an average circularity of from 0.950 to 0.995, and contains particles with circle-corresponding diameters of from 0.60 μm to less than 2.00 μm, having a maximum value X in the region of circle-corresponding diameters of from 3.0 μm to 9.0 μm and having a maximum value Y in the region of circle-corresponding diameters of from 0.60 μm to 2.00 μm, in an amount of from 8.0% by number to 30.0% by number; and the external additive fine powder has, on the toner particles, at least an inorganic fine powder (A) having as primary particles a number-average particle length of from 1 mμm to 30 mμm and a non-spherical inorganic fine powder (B) formed by coalescence of a plurality of particles and having a shape factor SF-1 greater than 150 and a number-average particle length of from 30 mμm to 600 mμm.

The present invention still also provides an image forming method comprising the steps of;

(I) charging electrostatically a latent image bearing member on which an electrostatic latent image is to be held;

(II) forming the electrostatic latent image on the latent image bearing member thus charged;

(III) developing the electrostatic latent image on the latent image bearing member by the use of a toner to form a toner image; and (IV) transferring to a transfer medium the toner image formed on the latent image bearing member;

wherein;

the toner has at least toner particles containing at least a binder resin and a colorant, and an external additive fine powder;

in circularity distribution of particles and in particle size distribution on the basis of circle-corresponding diameter, measured with a flow type particle image analyzer, the toner has an average circularity of from 0.950 to 0.995, and contains particles with circle-corresponding diameters of from 0.60 μm to less than 2.00 μm, having a maximum value X in the region of circle-corresponding diameters of from 3.0 μm to 9.0 μm and having a maximum value Y in the region of circle-corresponding diameters of from 0.60 μm to 2.00 μm, in an amount of from 8.0% by number to 30.0% by number; and the external additive fine powder has, on the toner particles, at least an inorganic fine powder (A) having as primary particles a number-average particle length of from 1 mμm to 30 mμm and a non-spherical inorganic fine powder (B) formed by coalescence of a plurality of particles and having a shape factor SF-1 greater than 150 and a number-average particle length of from 30 mμm to 600 mμm.

The present invention further provides an apparatus unit detachably mountable on a main assembly of an image forming apparatus, comprising;

a toner as a one-component developer, having at least toner particles containing at least a binder resin and a colorant, and an external additive fine powder;

a developing container for holding the one-component developer therein; and a developer carrying member for carrying the one-component developer held in the developing container and transporting the developer to the developing zone;

wherein;

in circularity distribution of particles and in particle size distribution on the basis of circle-corresponding diameter, measured with a flow type particle image analyzer, the toner has an average circularity of from 0.950 to 0.995, and contains particles with circle-corresponding diameters of from 0.60 μm to less than 2.00 μm, having a maximum value X in the region of circle-corresponding diameters of from 3.0 μm to 9.0 μm and having a maximum value Y in the region of circle-corresponding diameters of from 0.60 μm to 2.00 μm, in an amount of from 8.0% by number to 30.0% by number; and the external additive fine powder has, on the toner particles, at least an inorganic fine powder (A) having as primary particles a number-average particle length of from 1 mμm to 30 mμm and a non-spherical inorganic fine powder (B) formed by coalescence of a plurality of particles and having a shape factor SF-1 greater than 150 and a number-average particle length of from 30 mμm to 600 mμm.

DESCRIPTION OF THE PREFERRED EMBODIMENTS

Figure 1:
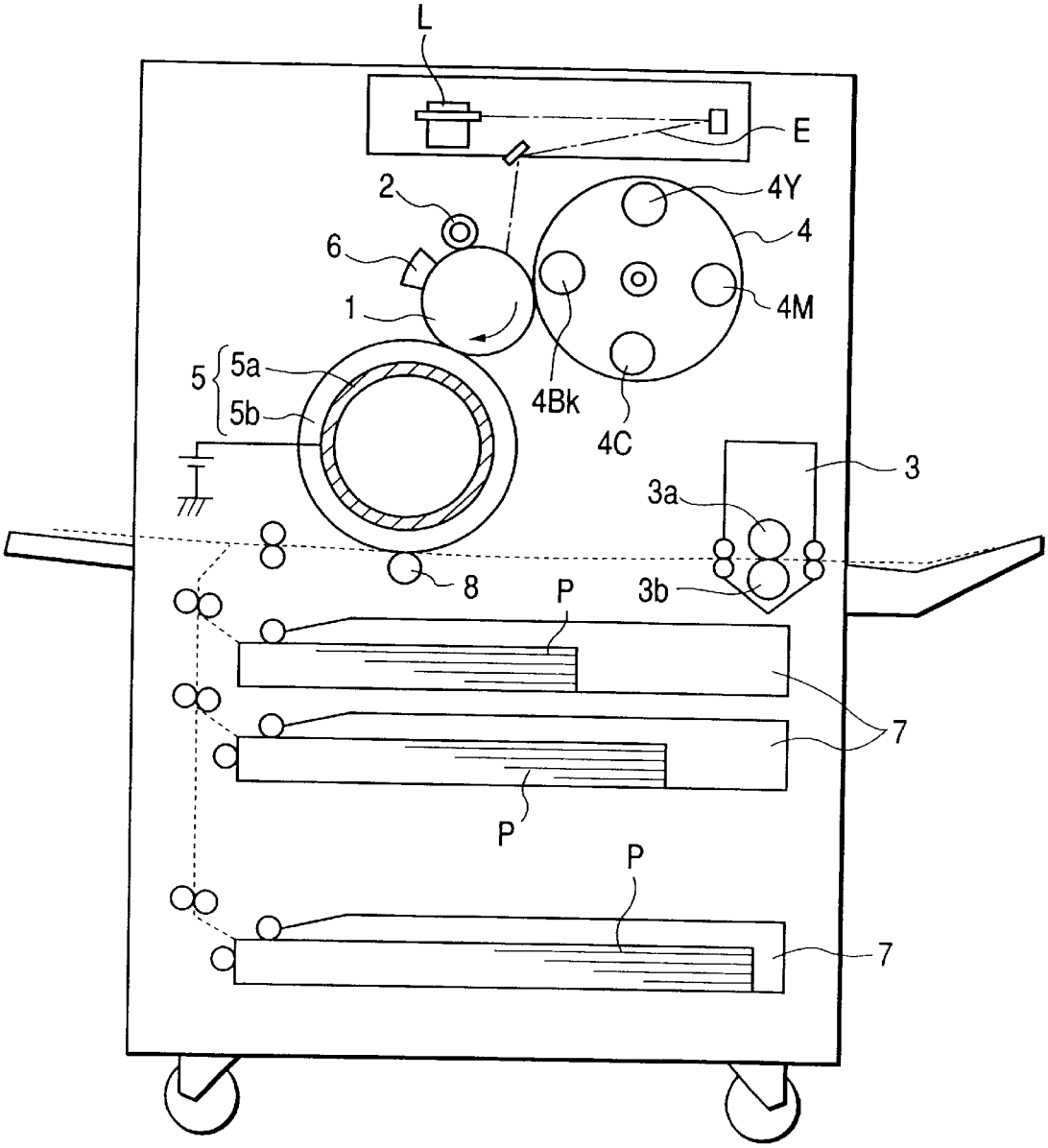
FIG. 1 illustrates an image forming apparatus that can carry out an image forming method making use of the toner of the present invention.

As a result of extensive studies made by the present inventors, it has been discovered that fog-free images with superior image-density stability and minute-image reproduction can be formed without causing deterioration of toner even in its long-term service, when at least two types of fine powders having specific shape and specific number-average particle length are used as external additive fine powders used in a toner having a specific circularity distribution and having a specific particle size distribution on the basis of circle-corresponding diameter.

The reason why the above effect can be obtained is unclear in detail, and is presumed as follows:

As a result of extensive studies, the present inventors have elucidated that the deterioration of developers has relation to the following three phenomena.

The first phenomenon is that toner particles are broken into finer particles, the second phenomenon is that particles of an external additive become buried in toner particle surfaces, and the third phenomenon is that toner particles become non-uniform in charging performance.

The present invention has been accomplished standing on the above phenomena.

The embodiments of the present invention will be described below in detail.

The toner of the present invention has an average circularity of from 0.950 to 0.995, and preferably from 0.960 to 0.995, in circularity distribution of particles as measured with a flow type particle image analyzer. Herein, the flow type particle image analyzer refers to an apparatus that analyzes images of photographed particles statistically. The average circularity is calculated by an arithmetic mean of circularity determined according to the following expression, using the above apparatus.

$$\text{Circularity} = \frac{\text{Circumferential length of corresponding circle}}{\text{Circumferential length of particle projected image}}$$

In the above expression, the circumferential length of particle projected image means the length of a contour line formed by connecting edge points of a binary-coded particle image. The circumferential length of corresponding circle means the length of circumference of a circle having the same area as the binary-coded particle image.

If the toner has an average circularity of less than 0.950, the friction between toner particles one another or between toner particles and a member for imparting electric charges to toner, such as a toner carrying member, may be so great that the toner particles may break to become fine particles, bringing about images not so free from fog and inferior in high minuteness. If the toner has an average circularity of more than 0.995, the toner may be charged by friction with difficulty, bringing about images having a poor uniformity.

In particle size distribution on the basis of circle-corresponding diameter as measured with the flow type particle image analyzer, the toner of the present invention contains particles with circle-corresponding diameters of from 0.60 $\mu$m to less than 2.00 $\mu$m, having a maximum value X in the region of circle-corresponding diameters of from 3.0 $\mu$m to 9.0 $\mu$m and having a maximum value Y in the region of circle-corresponding diameters of from 0.60 $\mu$m to less than 2.00 $\mu$m, in an amount of from 8.0% by number to 30.0% by number. Here, the particles constituting the maximum value Y has the function to lower the fluidity to a proper value.

In the particle size distribution on the basis of circle-corresponding diameter as measured with the flow type particle image analyzer, a spherical toner having only a single peak is a toner having too good fluidity, and hence such a toner can not be well charged triboeletrically at the initial stage to cause uneven images in the initial-stage images. The toner also has too good fluidity if it contains the particles with circle-corresponding diameters of from 0.60 $\mu$m to less than 2.00 $\mu$m in an amount less than 8.0% by number, to cause uneven images in the initial-stage images. If the toner contains the particles with circle-corresponding diameters of from 0.60 $\mu$m to less than 2.00 $\mu$m in an amount more than 30.0% by number, the effect of lowering fluidity may be too great, and the toner has a poor fluidity to cause coarse images in the initial-stage images after its long-term leaving.

The effect of lowering fluidity can be more remarkable in an image forming method employing an intermediate transfer member, thus the present invention is preferable in such an image forming method. Its mechanism is unclear in detail. It is presumed that, when, e.g., full-color images are formed on a intermediate transfer member by the use of color toners, the toner whose fluidity has been controlled to a proper value may hardly be affected by fine vibrations occurring from a drive system and can prevent the toner image on the intermediate transfer member from becoming coarse.

In the present invention, there are no particular limitations on methods for attaining the maximum values X and Y in the particle size distribution on the basis of circle-corresponding diameter and on methods for controlling the content of the particles with circle-corresponding diameters of from 0.60 $\mu$m to less than 2.00 $\mu$m. For example, usable methods are a method in which particles not having ill influence in relation to toner deterioration is added appropriately, a method in which emulsified particles formed as a by-product when toner particles are produced by polymerization are used totally, a method in which a part of the emulsified particles formed as a by-product is removed by classification such as wet classification or air classification to make use of such a part of emulsified particles.

In the present invention, the toner having the above specific average circularity can be produced by, e.g., a method in which, when toner particles produced by pulverization are treated to make spherical, conditions for such treatment are controlled to produce the toner, and a method in which, when toner particles are produced by polymerization, conditions for the polymerization are controlled to produce the toner.

As a method for making spherical the toner particles produced by pulverization, they may be done in the following way: Toner constituent materials such as a binder resin and a colorant and also optionally a release agent and a charge control agent are dispersed uniformly by means of a dry mixing machine such as a Henschel mixer or a media dispersion machine to prepare a uniformly dispersed mixture, the mixture obtained is melt-kneaded by means of a kneading machine such as a pressure kneader or an extruder to obtain a kneaded product, the kneaded product obtained is cooled and thereafter crushed by means of a crusher such as a hammer mill, the crushed product obtained is finely pulverized using a fine grinding machine which causes the crushed product to collide against a target under jet streams, and further the pulverized product obtained is classified using a classifier to remove coarse powder and fine powder to control its particle size distribution. Particles whose particle size distribution has been controlled may be made spherical by a hot-water method in which toner particles are dispersed in water and heated, a heating method in which toner particles are passed through hot-air streams, or a mechanical impact method in which an impact by mechanical energy is imparted to toner particles. Treatment conditions such as treatment temperature, treatment time and treatment energy used when the toner particles are made spherical may be controlled appropriately, whereby the circularity of the toner can be controlled.

As a method for producing the toner particles by polymerization, they may be produced in the following way: A monomer composition is prepared by adding constituent materials such as a colorant and optionally a release agent and a charge control agent in polymerizable monomers together with a polymerization initiator and dissolving or dispersing them uniformly by means of a mixing machine such as a homogenizer or an ultrasonic dispersion machine. This monomer composition is dispersed in an aqueous phase containing a dispersion stabilizer by means of a homomixer. Granulation is stopped at the stage where droplets of the monomer composition has come to have the desired toner particle size. After the granulation, agitation may be carried out to such an extent that the state of particles is maintained and the particles can be prevented from settling by the acton of the dispersion stabilizer. The polymerization may be carried out at a polymerization temperature set at 40° C. or above, usually from 50 to 90° C. At the latter half of the polymerization, the temperature may be raised for the purpose of controlling the molecular weight distribution of the binder resin for the toner. Also the aqueous medium may be evaporated off in part at the latter half of the reaction or after the reaction has been completed, in order to remove unreacted polymerizable monomers and by-products. After the reaction has been completed, the toner particles formed are collected by washing and filtration, followed by drying. In such suspension polymerization, water may usually be used as the dispersion medium preferably in an amount of from 300 to 3,000 parts by weight based on 100 parts by weight of the monomer composition.

The circularity of the toner can be adjusted by controlling the type and amount of the dispersion stabilizer, and polymerization conditions such as agitation conditions, pH of the aqueous phase and polymerization temperature when the toner particles are produced by the above polymerization process.

In the present invention, the circularity distribution and the particle size distribution on the basis of circle-corresponding diameter of the toner are measured in the following way, using a flow type particle image analyzer FPIA-1000, manufactured by Toa Iyou Denshi K.K.

To make measurement, 0.1 to 0.5% by weight of a surface-active agent (preferably CONTAMINON, trade name; available from Wako Pure Chemical Industries, Ltd.) is added to ion-exchanged water from which fine dust has been removed through a filter and which consequently contains 20 or less particles within the measurement range (e.g., with circle-corresponding diameters of from 0.60 $\mu$m to less than 159.21 $\mu$m) in $10^{-3}$ $cm^3$ of water to prepare about 10 ml of a solution (20° C.). To this solution, about 0.02 g of a measuring sample is added and dispersed uniformly to prepare a sample dispersion. It is dispersed by means of an ultrasonic dispersion machine UH-50, manufactured by K.K. SMT, (vibrator: a titanium alloy chip of 5 mm diameter) for a dispersion time of at least 5 minutes while appropriately cooling the dispersion medium so that its temperature does not become higher than 40° C. Using the above flow type particle image analyzer, the particle size distribution and circularity distribution of particles having circle-corresponding diameters of from 0.60 $\mu$m to less than 159.21 $\mu$m are measured.

The summary of measurement is described in a catalog of FPIA-1000 (an issue of June, 1995), published by Toa Iyou Denshi K.K., and in an operation manual of the measuring apparatus and Japanese Patent Application Laid-Open No. 8-136439, and is as follows:

The sample dispersion is passed through channels (extending along the flow direction) of a flat transparent flow cell (thickness: about 200 $\mu$m). A strobe and a CCD (charge-coupled device) camera are fitted at positions opposite to each other with respect to the flow cell so as to form a light path that passes crosswise with respect to the thickness of the flow cell. During the flowing of the sample dispersion, the dispersion is irradiated with strobe light at intervals of 1/30 seconds to obtain an image of the particles flowing through the cell, so that a photograph of each particle is taken as a two-dimensional image having a certain range parallel to the flow cell. From the area of the two-dimensional image of each particle, the diameter of a circle having the same area is calculated as the circle-corresponding diameter. The circumferential length of the circle (corresponding circle) having the same area as the two-dimensional image of each particle is divided by the circumferential length of the two-dimensional image of each particle to calculate the circularity of each particle.

Results (relative frequency % and cumulative frequency %) can be obtained by dividing the range of from 0.06 $\mu$m to 400 $\mu$m into 226 channels (divided into 30 channels for one octave) as shown in Table 1 below. In actual measurement, particles are measured within the range of circle-corresponding diameters of from 0.60 $\mu$m to less than 159.21 $\mu$m.

In the following Table 1, the upper-limit numeral in each particle diameter range does not include that numeral itself to mean that it is indicated as "less than".

TABLE 1

| Particle diameter ranges | | | |
|---|---|---|---|
| (μm) | (μm) | (μm) | (μm) |
| 0.60–0.61 | 1.12–1.16 | 2.12–2.18 | 4.00–4.12 |
| 0.61–0.63 | 1.16–1.19 | 2.18–2.25 | 4.12–4.24 |
| 0.63–0.65 | 1.19–1.23 | 2.25–2.31 | 4.24–4.36 |
| 0.65–0.67 | 1.23–1.26 | 2.31–2.38 | 4.36–4.49 |
| 0.67–0.69 | 1.26–1.30 | 2.38–2.45 | 4.49–4.62 |
| 0.69–0.71 | 1.30–1.34 | 2.45–2.52 | 4.62–4.76 |
| 0.71–0.73 | 1.34–1.38 | 2.52–2.60 | 4.76–4.90 |
| 0.73–0.75 | 1.38–1.42 | 2.60–2.67 | 4.90–5.04 |
| 0.75–0.77 | 1.42–1.46 | 2.67–2.75 | 5.04–5.19 |
| 0.77–0.80 | 1.46–1.50 | 2.75–2.83 | 5.19–5.34 |
| 0.80–0.82 | 1.50–1.55 | 2.83–2.91 | 5.34–5.49 |
| 0.82–0.84 | 1.55–1.59 | 2.91–3.00 | 5.49–5.65 |
| 0.84–0.87 | 1.59–1.64 | 3.00–3.09 | 5.65–5.82 |
| 0.87–0.89 | 1.64–1.69 | 3.09–3.18 | 5.82–5.99 |
| 0.89–0.92 | 1.69–1.73 | 3.18–3.27 | 5.99–6.16 |
| 0.92–0.95 | 1.73–1.79 | 3.27–3.37 | 6.16–6.34 |
| 0.96–0.97 | 1.79–1.84 | 3.37–3.46 | 6.34–6.53 |
| 0.97–1.00 | 1.84–1.89 | 3.46–3.57 | 6.53–6.72 |
| 1.00–1.03 | 1.89–1.95 | 3.57–3.67 | 6.72–6.92 |
| 1.03–1.06 | 1.95–2.00 | 3.67–3.78 | 6.92–7.12 |
| 1.06–1.09 | 2.00–2.06 | 3.78–3.89 | 7.12–7.33 |
| 1.09–1.12 | 2.06–2.12 | 3.89–4.00 | 7.33–7.54 |
| 7.54–7.76 | 14.20–14.62 | 26.75–27.53 | 50.37–51.84 |
| 7.76–7.99 | 14.62–15.04 | 27.53–28.33 | 51.84–53.36 |
| 7.99–8.22 | 15.04–15.48 | 28.33–29.16 | 53.36–54.91 |
| 8.22–8.46 | 15.48–15.93 | 29.16–30.01 | 54.91–56.52 |
| 8.46–8.71 | 15.93–16.40 | 30.01–30.89 | 56.52–58.17 |
| 8.71–8.96 | 16.40–16.88 | 30.89–31.79 | 58.17–59.86 |
| 8.96–9.22 | 16.88–17.37 | 31.79–32.72 | 59.86–61.61 |
| 9.22–9.49 | 17.37–17.88 | 32.72–33.67 | 61.61–63.41 |
| 9.49–9.77 | 17.88–18.40 | 33.67–34.65 | 63.41–65.26 |
| 9.77–10.05 | 18.40–18.94 | 34.65–35.67 | 65.26–67.16 |
| 10.05–10.35 | 18.94–19.49 | 35.67–36.71 | 67.16–69.12 |
| 10.35–10.65 | 19.49–20.06 | 36.71–37.78 | 69.12–71.14 |
| 10.65–10.96 | 20.06–20.65 | 37.78–38.88 | 71.14–73.22 |
| 10.96–11.28 | 20.65–21.25 | 38.88–40.02 | 73.22–75.36 |
| 11.28–11.61 | 21.25–21.87 | 40.02–41.18 | 75.36–77.56 |
| 11.61–11.95 | 21.87–22.51 | 41.18–42.39 | 77.56–79.82 |
| 11.95–12.30 | 22.51–23.16 | 42.39–43.62 | 79.82–82.15 |
| 12.30–12.66 | 23.16–23.84 | 43.62–44.90 | 82.15–84.55 |
| 12.66–13.03 | 23.84–24.54 | 44.90–46.21 | 84.55–87.01 |
| 13.03–13.41 | 24.51–25.25 | 46.21–47.56 | 87.01–89.55 |
| 13.41–13.80 | 25.25–25.99 | 47.56–48.94 | 89.55–92.17 |
| 13.80–14.20 | 25.99–26.75 | 48.94–50.37 | 92.17–94.86 |
| (μm) | (μm) | (μm) | |
| 94.86–97.63 | 178.63–183.84 | 336.37–346.19 | |
| 97.63–100.48 | 183.84–189.21 | 346.19–356.29 | |
| 100.48–103.41 | 189.21–194.73 | 356.29–366.69 | |
| 103.41–106.43 | 194.73–200.41 | 366.69–377.40 | |
| 106.43–109.53 | 200.41–206.26 | 377.40–388.41 | |
| 109.53–112.73 | 206.26–212.28 | 388.41–400.00 | |
| 112.73–116.02 | 212.28–218.48 | | |
| 116.02–119.41 | 218.48–224.86 | | |
| 119.41–122.89 | 224.86–231.42 | | |
| 122.89–126.48 | 231.42–238.17 | | |
| 126.48–130.17 | 238.17–245.12 | | |
| 130.17–133.97 | 245.12–252.28 | | |
| 133.97–137.88 | 252.28–259.64 | | |
| 137.88–141.90 | 259.64–267.22 | | |
| 141.90–146.05 | 267.22–275.02 | | |
| 146.05–150.31 | 275.02–283.05 | | |
| 150.31–154.70 | 283.05–291.31 | | |
| 154.70–159.21 | 291.31–299.81 | | |
| 159.21–163.86 | 299.81–308.56 | | |
| 163.86–168.64 | 308.56–317.56 | | |
| 168.64–173.56 | 317.56–326.83 | | |
| 173.56–178.63 | 326.83–336.37 | | |

The toner of the present invention has the toner particles described above and an external additive fine powder. The external additive fine powder has, on the toner particles, at least an inorganic fine powder (A) whose particles are present individually or in an aggregated state and a non-spherical inorganic fine powder (B) formed by coalescence of a plurality of particles. This makes the toner have an improved fluidity and restrains the toner from its deterioration due to running.

More specifically, the external additive fine powder (A) moves appropriately around the surfaces of the toner particles and therefore acts as to make electric charges on the toner particle surfaces uniform, to make the toner have a sharp charge quantity distribution and also make the toner have an improved fluidity. The non-spherical inorganic fine powder (B) functions as a spacer of the toner particles and thereby acts as to restrain the toner particles from being buried in the inorganic fine powder (A).

In general, toner particles having less unevenness on their surfaces and approximate to spheres have less escapes through which the external additive fine powder added externally to the toner particle surfaces can slip away when the toner particles come into contact with a member for imparting triboelectric charges to the toner, e.g., a developing sleeve, so that the external additive tends to be buried in the toner particle surfaces to tend to cause the deterioration of toner.

The toner of the present invention is an almost spherical toner having an average circularity of from 0.950 to 0.995 as described above. However, since it has the inorganic fine powder (A) and non-spherical inorganic fine powder (B) as an external additive fine powder on the toner particle surfaces, the inorganic fine powder (A) can be prevented effectively from being buried in the toner particle surfaces on account of the non-spherical inorganic fine powder (B).

The inorganic fine powder (A) has as primary particles a number-average particle length on toner particles, of from 1 mμm to less than 30 mμm, and preferably from 1 mμm to 25 mμm. This is good because the toner can be improved well in its charge quantity distribution and fluidity.

If the inorganic fine powder (A) has a primary particle number-average particle length smaller than 1 mμm, the inorganic fine powder (A) tends to be buried in the toner particle surfaces to cause the deterioration of toner with long-term service.

If the inorganic fine powder (A) has a primary particle number-average particle length greater than 30 mμm, it may have a poor ability to make electric charge on the toner particle surfaces uniform, resulting in a broad charge quantity distribution of the toner, and hence problems such as toner scatter and fog tend to occur.

The inorganic fine powder (A) may preferably have, as primary particles on the toner particle surfaces, a length/breadth ratio (ratio of particle length to particle breadth) of from 1.0 to 1.5, and more preferably from 1.0 to 1.3, in order for the inorganic fine powder (A) to be able to be dispersed uniformly on the toner particle surfaces in a preferable form when dispersed thereon.

If the inorganic fine powder (A) has a primary particle length/breadth ratio more than 1.5, the inorganic fine powder (A) may have an excessive cohesive force to make it difficult for the inorganic fine powder (A) to be dispersed uniformly on the toner particle surfaces in a preferable form by means of an agitation mixer put into wide use.

The inorganic fine powder (A) may preferably have, as primary particles on the toner particle surfaces, a shape factor SF-1 of from 100 to 130, and preferably from 100 to 125, in order for the powder to be able to move appropriately around the toner particles to impart a good fluidity to the toner.

If the inorganic fine powder (A) have a primary particle shape factor SF-1 more than 130, the inorganic fine powder (A) may have a low ability to move appropriately around the toner particles, resulting in images having poor density uniformity and minute image reproduction.

In the present invention, the SF-1 indicating the shape factor is a value obtained by sampling at random 100 particles of particle images by the use of FE-SEM (S-4700), a field-emission scanning electron microscope manufactured by Hitachi Ltd.), introducing their image information in an image analyzer (LUZEX-III; manufactured by Nikore Co.) through an interface to make analysis, and calculating the data according to the following expression.

Shape factor SF-1=$(MXLNG)_2/AREA\times\pi/4\times100$ wherein MXLNG represents an absolute maximum length of a particle, and AREA represents a projected area of a particle.

The primary particle shape factor SF-1 of the inorganic fine powder (A) is measured at magnification of 100,000 times on the FE-SEM.

The inorganic fine powder (A) may preferably have a specific surface area as measured by nitrogen adsorption according to the BET method (BET specific surface area), of from 50 to 150 $m^2/g$, and more preferably from 60 to 140 $m^2/g$, in order for the charging performance of toner particles to be kept stable with ease.

If the inorganic fine powder (A) has a BET specific surface area smaller than 50 $m^2/g$, the inorganic fine powder (A) may come apart from the toner particle surfaces easily, tending to cause problems such as toner scatter and fog. Also, image density may become inferior in uniformity.

If the inorganic fine powder (A) has a BET specific surface area larger than 150 $m^2/g$, the toner may have an unstable charging performance to cause the problems such as toner scatter and fog, especially when left in an environment of high humidity over a long period of time.

In the present invention, the BET specific surface areas of powders are measured in the following way, using Autosorb I, a specific surface area meter manufactured by Quantach Rome Co.

About 0.1 g of a measuring sample is weight out in a cell, and is deaerated at a temperature of 40° C., under a degree of vacuum of $1.0\times10^3$ mmHg for at least 12 hours. Thereafter, nitrogen gas is adsorbed in the state where the sample is cooled with liquid nitrogen, and then the value is determined by the multiple point method.

The non-spherical inorganic fine powder (B) used in the present invention may have a shape factor SF-1 on toner particles, of 150 or greater, preferably 190 or greater, and more preferably 200 or greater, in order for the non-spherical inorganic fine powder (B) to move hardly around the toner particle surfaces and for the inorganic fine powder (A) to be restrained well from being buried in the toner particle surfaces.

If the non-spherical inorganic fine powder (B) has a shape factor SF-1 of 150 or less, the non-spherical inorganic fine powder (B) itself tends to be buried in the toner particle surfaces, so that the inorganic fine powder (A) may be less effectively restrained from being buried in the toner particle surfaces.

The shape factor SF-1 of the non-spherical inorganic fine powder (B) on toner particles is measured on a magnified photograph taken by the FE-SEM at 50,000 magnifications.

Figure 10:
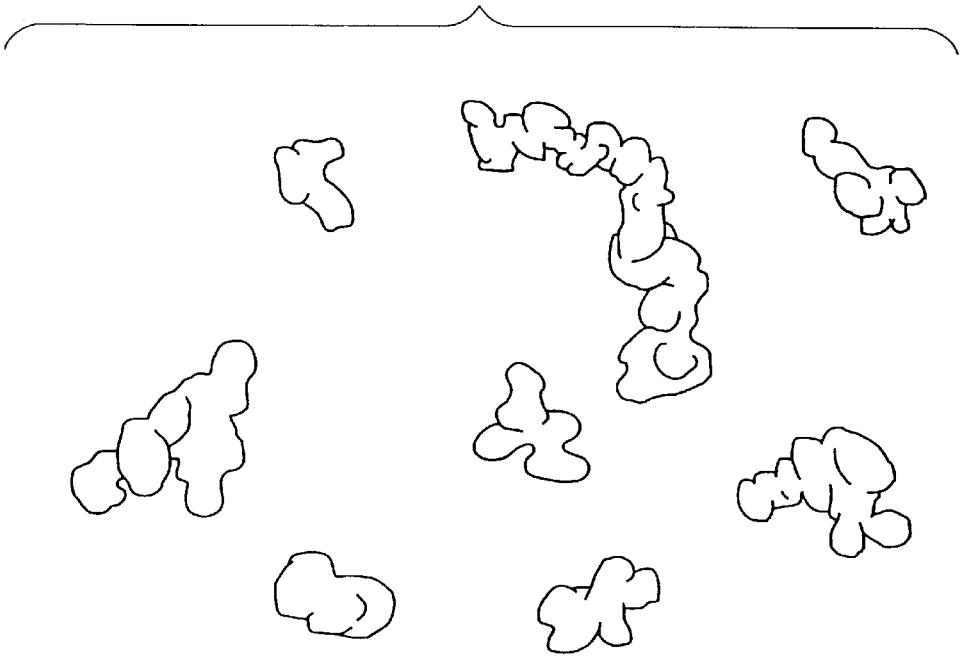
FIG. 10 illustrates diagrammatically the particle shape of the non-spherical inorganic fine powder (B).

As the shape of particles of the non-spherical inorganic fine powder (B), the particles may be not non-spherical particles such as merely rod-like particles or core-like particles, but those formed by coalescence of a plurality of particles as shown in FIG. 10. This is effective in order for the inorganic fine powder (A) to be restrained from being buried in the toner particle. The reason therefor is presumed as follows: The particles of the non-spherical inorganic fine powder (B) formed by coalescence of a plurality of particles have shapes with curved portions, and hence the non-spherical inorganic fine powder (B) is prevented from being buried in the toner particles and also the non-spherical inorganic fine powder (B) functions as a spacer on the toner particles to restrain the inorganic fine powder (A) from being buried in the toner particles.

The non-spherical inorganic fine powder (B) also may preferably have a number-average particle length of from 30 to 600 mμm, more preferably from 30 to 300 mμm, and still more preferably from 35 to 300 mμm, in order for the powder (B) to be able to function well as a spacer on the toner particles.

If the non-spherical inorganic fine powder (B) has a number-average particle length smaller than 30 mμm, the effect of its addition may be similar to that obtained when the inorganic fine powder (A) is added alone, making it difficult to restrain the inorganic fine powder (A) from being buried.

If the non-spherical inorganic fine powder (B) has a number-average particle length larger than 600 mμm, the inorganic fine powder (A) may become buried in the toner particle surfaces as a result of friction of the toner particles with the non-spherical inorganic fine powder (B), tending to cause toner deterioration.

The non-spherical inorganic fine powder (B) may preferably have a length/breadth ratio on toner particles, of 1.7 or more, more preferably 2.0 or more, and still more preferably 3.0 or more, in order for the inorganic fine powder (A) to be restrained highly effectively from being buried in the toner particle surfaces.

If the non-spherical inorganic fine powder (B) has a length/breadth ratio of less than 1.7, the non-spherical inorganic fine powder (B) may have less curved structure, and hence the non-spherical inorganic fine powder (B) itself tends to be buried in the toner particle surfaces, so that the inorganic fine powder (A) may be less effectively restrained from being buried in the toner particle surfaces.

The non-spherical inorganic fine powder (B) also may preferably be one formed by coalescence of a plurality of primary particles having an average Feret's diameter minimum width of preferably from 20 mμm to 200 mμm, and more preferably from 30 mμm to 200 mμm, on the toner particles in order for the inorganic fine powder (A) to be restrained highly effectively from being buried in the toner particle surfaces.

If the primary particles constituting the coalescing particles of the non-spherical inorganic fine powder (B) have an average Feret's diameter minimum width smaller than 20 mμm, it may be greatly cohesive to make it difficult for the non-spherical inorganic fine powder (B) to be dispersed uniformly on the toner particle surfaces by means of an agitation mixer put into wide use.

If the primary particles constituting the coalescing particles of the non-spherical inorganic fine powder (B) have an average Feret's diameter minimum width larger than 200 mμm, it may have less curved structure, and besides the inorganic fine powder (A) may undesirably begin to be buried in the toner particle surfaces as a result of friction of the toner particles with the non-spherical inorganic fine powder (B).

The non-spherical inorganic fine powder (B) may preferably have a specific surface area as measured by nitrogen adsorption according to the BET method (BET specific surface area), of from 20 to 90 $m^2/g$, and more preferably from 25 to 70 $m^2/g$, in order not to prevent the inorganic fine powder (A) from being added effectively.

If the non-spherical inorganic fine powder (B) has a BET specific surface area smaller than 20 $m^2/g$, the inorganic fine powder (A) has already been buried in the toner particle surfaces because of such non-spherical inorganic fine powder (B) when agitation is carried out using an agitation mixer put into wide use, to make the addition of the inorganic fine powder (A) less effective.

If the non-spherical inorganic fine powder (B) has a BET specific surface area larger than 90 $m^2/g$, the inorganic fine powder (A) may become incorporated into pores of the non-spherical inorganic fine powder (B) to make the addition of the inorganic fine powder (A) less effective.

In the present invention, the primary particles of the inorganic fine powder (A) present individually or in an aggregated state may preferably be present on the toner particle surfaces in a number of at least 20 particles, and more preferably at least 25 particles, in total on the average per unit area of 0.5 $\mu$m×0.5 $\mu$m, and the non-spherical inorganic fine powder (B) may preferably be present on the toner particle surfaces in a number of from 1 to 20 particles, and more preferably from 2 to 18 particles, on the average per unit area of 1.0 $\mu$m×1.0 $\mu$m, as viewed on an electron microscope magnified photograph of the toner. The total number of primary particles of the inorganic fine powder (A) present on the toner particle surfaces is meant to be the total number of the primary particles present individually and the primary particles constituting the aggregates.

If the primary particles of the inorganic fine powder (A) present on the toner particle surfaces are less than 20 particles on the average, the toner may have an inferior fluidity, resulting in images inferior in uniformity.

The number-average particle length, length/breadth ratio and average Feret's diameter minimum width of the external additive fine powder and the number of particles of the external additive fine powder present on the toner particle surfaces are measured in the following way.

The respective numerical values of the inorganic fine powder (A) are measured using a magnified photograph taken by photographing toner particle surfaces magnified 100,000 times by the use of the scanning electron microscope FE-SEM (S-4700, manufactured by Hitachi Ltd.), which are measured on particles having a particle length of from 1 to 40 m$\mu$m. The particle length and breadth of the primary particles are measured appropriately at a magnification within the range of from 100,000 times to 500,000 times as will be described later.

The average length of primary particles of the inorganic fine powder (A) is determined by measuring the length of each primary particle of the inorganic fine powder (A) over 10 visual fields on the magnified photograph, and regarding its average value as the average length. Similarly, the average value of the breadth of each primary particle of the inorganic fine powder (A) is determined as the average breadth, and ratio of the average length to the average breadth is calculated as the length/breadth ratio of each primary particle of the inorganic fine powder (A). Here, the length of the primary particle corresponds to the distance between parallel lines which is maximum among sets of parallel lines drawn tangentially to the contour of each primary particle of the inorganic fine powder (A), and the breadth thereof corresponds to the distance between parallel lines which is minimum among such sets of parallel lines.

In an instance where the diameter measured is 1 mm or smaller in actual scale in the measurement of the length and breadth of the inorganic fine powder (A), the magnification of the magnified photograph of the toner particle surfaces is increased up to the range of 500,000 magnifications to make measurement.

The number of particles of the inorganic fine powder (A) on the toner particle surfaces is determined by counting in 10 visual fields on the magnified photograph the number of primary particles of the inorganic fine powder (A) per unit area of 0.5 $\mu$m×0.5 $\mu$m (50 mm×50 mm in the 100,000-time magnified photograph) on the toner particle surfaces, and calculating its average value. When the number of particles of the inorganic fine powder (A) is counted, the number of primary particles is counted in respect of the inorganic fine powder (A) present in the area corresponding to 0.5 $\mu$m×0.5 $\mu$m at the center of the magnified photograph, and the number of primary particles constituting the aggregates is counted in respect of the inorganic fine powder (A) standing aggregated.

The respective numerical values of the non-spherical inorganic fine powder (B) are measured using a magnified photograph taken by photographing toner particle surfaces magnified 50,000 times by the use of the scanning electron microscope FE-SEM (S-800, manufactured by Hitachi Ltd.), which are measured on particles having a particle length of 20 m$\mu$m or larger.

The average length of particles of the non-spherical inorganic fine powder (B) is determined by measuring the length of each particle of the non-spherical inorganic fine powder (B) over 10 visual fields on the magnified photograph, and regarding its average value as the average length. Similarly, the average value of the breadth of each particle of the non-spherical inorganic fine powder (B) is further determined as the average breadth, and the ratio of the average length to the average breadth is calculated as the length/breadth ratio of the non-spherical inorganic fine powder (B). Here, the length of particle corresponds to the distance between parallel lines which is maximum among sets of parallel lines drawn tangentially to the contour of each particle of the non-spherical inorganic fine powder (B), and the breadth thereof corresponds to the distance between parallel lines which is minimum among such sets of parallel lines.

The number of particles of the non-spherical inorganic fine powder (B) on the toner particle surfaces is determined by counting in 10 visual fields on the magnified photograph the number of particles of the non-spherical inorganic fine powder (B) per unit area of 1.0 $\mu$m×1.0 $\mu$m (50 mm×50 mm in the 50,000-time magnified photograph) on the toner particle surfaces, and calculating its average value. When the number of particles of the non-spherical inorganic fine powder (B) is counted, it is counted on the non-spherical inorganic fine powder (B) present in the area corresponding to the area of 1.0 $\mu$m×1.0 $\mu$m at the center of the magnified photograph.

The average Feret's diameter minimum width of the primary particles constituting the coalescing particles of the non-spherical inorganic fine powder (B) is determined as follows: sampling 20 or more particles of the non-spherical inorganic fine powder (B) over a plurality of visual fields on the magnified photograph, measuring a Feret's diameter minimum width on all particles sampled on which the Feret's diameter minimum width of the primary particles constituting the coalescing particles of the non-spherical inorganic fine powder (B) can be measured, and regarding its average value as the average Feret's diameter minimum width. Here, the Feret's diameter minimum width corresponds to the distance between parallel lines which is minimum among sets of parallel lines drawn tangentially to the contour of each primary particle constituting the coalescing particles of the non-spherical inorganic fine powder (B).

To distinguish the inorganic fine powder (A) from the non-spherical inorganic fine powder (B) on the scanning electron microscope magnified photograph, when there is a clear difference in particle shape between the inorganic fine powders, a method may be used in which judgement is made in accordance with the difference in particle shape on the scanning electron microscope magnified photograph. Alternatively, when there is a compositional difference between the inorganic fine powders, a method may be used in which the inorganic fine powder (A) and the non-spherical inorganic fine powder (B) are detected separately by detecting only specific designated elements using an X-ray microanalyzer.

In the present invention, the inorganic fine powder (A) and/or the non-spherical inorganic fine powder (B) may preferably contain silicone oil. Treatment of the inorganic fine powder(s) with silicone oil brings about an improvement in hydrophobicity of the inorganic fine powder(s), and also, in non-magnetic one-component developing systems, makes it possible to prevent the charging member from being scratched by the inorganic fine powder(s) and thereby prevent the charging performance of the toner from becoming non-uniform. Here, the silicone oil is presumed to exude from the inorganic fine powder(s) in a very small quantity and play a role as a lubricant.

In the present invention, the inorganic fine powder (A) and/or the non-spherical inorganic fine powder (B) may preferably be an inorganic compound(s). If the inorganic fine powder (A) is an organic compound, its particles may deform with long-term service to have such a shape they stick to the toner particle surfaces. Meanwhile, if the non-spherical inorganic fine powder (B) is an organic compound, its particles may deform or collapse as a result of their friction with the charging member to act poorly as spacer particles.

As the inorganic fine powders (A) and (B) used in the present invention, conventionally known materials may be used. In order to improve charging stability, developing performance, fluidity and storage stability, they may preferably be selected from silica, and alumina, titania or double oxides thereof. In particular, fine silica powder is more preferred because the formation of primary particles or coalesced primary particles can be controlled arbitrarily to a certain extent. For example, the silica includes what is called dry-process silica or fumed silica produced by vapor phase oxidation of silicon halides or alkoxides and what is called wet-process silica produced from alkoxides or water glass, either of which may be used. The dry-process silica is preferred, as having less silanol groups on the surface and inside and leaving no production residues such as $Na_2O$ and $SO_{32-}$.

The non-spherical inorganic fine powder (B) may preferably be produced especially in the following way.

When fine silica powder is given as an example, a silicon halide is subjected to gaseous phase oxidation to form fine silica powder, and the fine silica powder obtained is subjected to hydrophobic treatment to produce non-spherical fine silica powder. Especially in the case of the gaseous phase oxidation, firing may preferably be carried out at a temperature high enough for the primary particles of silica to coalesce.

Such non-spherical inorganic fine powder (B) may particularly preferably be those obtained by classifying coalesced particles comprised of primary particles having mutually coalesced, to collect relatively coarse particles, and adjusting their particle size distribution so as to fulfill the condition of the number-average length in the state they are present on the toner particle surfaces.

In the toner of the present invention, the toner may have the inorganic fine powder (A) in an amount of from 0.1 to 3 parts by weight, and preferably from 0.2 to 2 parts by weight, and the non-spherical inorganic fine powder (B) in an mount of from 0.1 to 3 parts by weight, and preferably from 0.2 to 1.5 parts by weight, all based on 100 parts by weight of the toner.

If the toner has the inorganic fine powder (A) in an amount less than 0.1 part by weight, the toner can not be endowed with a sufficient fluidity to tend to cause images inferior in uniformity.

If the toner has the inorganic fine powder (A) in an amount more than 3 parts by weight, the inorganic fine powder (A) may come apart from the toner particle surfaces to form aggregates of the inorganic fine powder (A) in a large number, to cause fog on paper and images inferior in fine-line reproduction.

If the toner has the non-spherical inorganic fine powder (B) in an amount less than 0.1 part by weight, the addition of the non-spherical inorganic fine powder (B) can not be well effective, causing a lowering of image uniformity with long-term service.

If the toner has the non-spherical inorganic fine powder (B) in an amount more than 3 parts by weight, the non-spherical inorganic fine powder (B) may come apart from the toner particle surfaces to form aggregates of the non-spherical inorganic fine powder (B) in a large number, to cause fog on paper and images inferior in fine-line reproduction.

In the toner of the present invention, in addition to the inorganic fine powder (A) and non-spherical inorganic fine powder (B), different fine particles may further be added as an external additive.

In such fine particles, organic or inorganic fine particles may be used which are commonly known widely as external additives.

The inorganic fine particles may include, e.g., metal oxides such as aluminum oxide, titanium oxide, strontium titanate, cerium oxide, magnesium oxide, chromium oxide, tin oxide and zinc oxide; nitrides such as silicon nitride; carbides such as silicon carbide; metal salts such as calcium sulfate, barium sulfate and calcium sulfate; fatty acid metal salts such as zinc stearate and calcium stearate; carbon black; and silica; any of which may be used. The organic fine particles may include, e.g., homopolymers or copolymers of monomer components used in binder resins for toner, such as styrene, acrylic acid, methyl methacrylate, butyl acrylate and 2-ethylhexyl acrylate, obtained by emulsion polymerization or spray drying.

For the purpose of making hydrophobicity higher to more improve environmental properties and improving the operability in controlling the particle diameter and shape, the fine particles used in the toner of the present invention may be subjected to treatment with a silane coupling agent, or to surface treatment to form alumina coatings on the surfaces of the fine particles.

Stated specifically, the silane coupling agent may include hexamethyldisilazane or compounds represented by the formula (1):

$$R_mSiY_n \quad (1)$$

wherein R is an alkoxyl group or a chlorine atom; m is an integer of 1 to 3; Y is an alkyl group, or a hydrocarbon group containing a vinyl group, a glycidoxyl group or a methacrylic group; and n is an integer of 1 to 3.

The compounds represented by the above formula (1) may include typically, e.g., dimethyldichlorosilane, trimethylchlorosilane, allyldimethylchlorosilane, allylphenyldichlorosilane, benzyldimethylchlorosilane, vinyltriethoxysilane, γ-methacryloxypropyltrimethoxysilane, vinyltriacetoxysilane, divinylchlorosilane and dimethylvinylchlorosilane.

The treatment with the silane coupling agent may be made by a method including dry-process treatment in which a fine powder made cloudy by agitation is reacted with the silane coupling agent, and wet-process treatment in which a fine powder is dispersed in a solvent and the silane coupling agent is added dropwise thereto to carry out the reaction, either of which may be used.

The alumina coatings may be formed by a method in which aluminum chloride, aluminum nitrate or aluminum sulfate is added in an aqueous solution or a solvent to immerse fine particles in it, followed by drying, or a method in which hydrated alumina, hydrated alumina-silica, hydrated alumina-titania, hydrated alumina-titania-silica or hydrated alumina-titania-silica-zinc oxide is added in an aqueous solution or a solvent to immerse fine particles in it, followed by drying.

The toner particles contained in the toner of the present invention contains at least a binder resin and a colorant.

As the binder resin used in the present invention, it may include homopolymers of styrene and derivatives thereof such as polystyrene and polyvinyl toluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; polymethyl methacrylate; polybutyl methacrylate; polyvinyl acetate; polyethylene; polypropylene; polyvinyl butyral; polyacrylic acid resins; rosins; modified rosins; terpene resins; phenol resins; aliphatic or alicyclic hydrocarbon resins; aromatic petroleum resins; paraffin wax; and carnauba wax. Any of these may be used alone or in the form of a mixture.

As colorants used in the present invention, carbon black, magnetic materials, and colorants toned in black by the use of yellow, magenta and cyan colorants shown below are used as black colorants.

As the yellow colorant, compounds typified by condensation azo compounds, isoindolinone compounds, anthraquinone compounds, azo metal complexes, methine compounds and allylamide compounds are used. Stated specifically, C.I. Pigment Yellow 12, 13, 14, 15, 17, 62, 74, 83, 93, 94, 95, 109, 110, 111, 128, 129, 147, 168 and 180 are preferably used.

As the magenta colorant, condensation azo compounds, diketopyropyyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254 are particularly preferable.

As the cyan colorant, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may particularly preferably be used.

Any of these colorants may be used alone, in the form of a mixture, or in the state of a solid solution.

In the case of color toners, the colorants used in the present invention are selected taking account of hue angle, chroma, brightness, weatherability, transparency on OHP films and dispersibility in toner particles. The colorant may be used in an amount of from 1 to 20 parts by weight based on 100 parts by weight of the binder resin.

In the toner of the present invention, a charge control agent may be used optionally.

As charge control agents used in the present invention, known agents may be used. In the case of color toners, it is particularly preferable to use charge control agents that are colorless, make toner charging speed higher and are capable of maintaining a constant charge quantity stably.

As specific compound, the may include, as negative charge control agents, metal compounds of salicylic acid, naphthoic acid, dicarboxylic acid or derivatives of these, polymer type compounds having sulfonic acid or carboxylic acid in the side chain, boron compounds, urea compounds, silicon compounds, and carycsarene. As positive charge control agents, they may include quaternary ammonium salts, polymer type compounds having such a quaternary ammonium salt in the side chain, guanidine compounds, and imidazole compounds.

The charge control agent may preferably be used in an amount of from 0.5 to 10 parts by weight based on 100 parts by weight of the binder resin. In the present invention, however, the addition of the charge control agent is not essential. In the case when two-component development is employed, the triboelectric charging with a carrier may be utilized. Also in the case when non-magnetic one-component blade-coating development is employed, the triboelectric charging with a blade member or a sleeve member. Accordingly, the charge control agent need not necessarily be contained in the toner particles.

In the toner of the present invention, a wax may be used optionally as a low-softening substance.

The low-softening substance used in the toner of the present invention may include polymethylene waxes such as paraffin wax, polyolefin wax, microcrystalline wax and Fischer-Tropsch wax, amide waxes, higher fatty acids, long-chain alcohols, ester waxes and derivatives thereof such as graft compounds and block compounds. These may preferably be those from which low-molecular-weight components have been removed and having a sharp maximum endothermic peak in the DSC endothermic curve.

Waxes preferably usable are straight-chain alkyl alcohols having 15 to 100 carbon atoms, straight-chain fatty acids, straight-chain acid amides, straight-chain esters or montan type derivatives. Any of these waxes from which impurities such as liquid fatty acids have been removed are also preferred.

Waxes more preferably usable may include low-molecular-weight alkylene polymers obtained by radical polymerization of alkylenes under a high pressure or polymerization thereof in the presence of a Ziegler catalyst or any other catalyst under a low pressure; alkylene polymers obtained by thermal decomposition of high-molecular-weight alkylene polymers; those obtained by separation and purification of low-molecular-weight alkylene polymers formed as by-products when alkylenes are polymerized; and polymethylene waxes obtained by extraction fractionation of specific components from distillation residues of hydrocarbon polymers obtained by the Arge process from a synthetic gas comprised of carbon monoxide and hydrogen, or from synthetic hydrocarbons obtained by hydrogenation of distillation residues. Antioxidants may be added to these waxes.

The low-softening substance used in the present invention may preferably have an endothermic main peak in a temperature range of from 40 to 90° C., and more preferably from 45 to 85° C., in the the endothermic curve measured by DSC (differential scanning calorimetry). With regard to the endothermic main peak, preferred is a sharp-melting low-softening substance having a half width within 10° C., and more preferably within 5° C. In particular, an ester wax composed chiefly of an esterified compound of a long-chain alkyl alcohol having 15 to 45 carbon atoms with a long-chain alkyl carboxylic acid having 15 to 45 carbon atoms is preferred in view of a transparency on OHP sheets and low-temperature fixing performance and high-temperature anti-offset properties at the time of fixing.

In the present invention, the measurement by DSC is made using, e.g., DSC-7, manufactured by Perkin Elmer Co. The temperature at the detecting portion of the device is corrected on the basis of melting points of indium and zinc, and the calorie is corrected using indium fusion heat. The sample is put in a pan made of aluminum, and an empty pan is set as a control, to make measurement at a rate of temperature rise of 10° C./min at temperatures of from 20° C. to 200° C.

The low-softening substance may preferably be contained in the toner particles in an amount of 3 to 40 parts by weight, and more preferably from 5 to 35 parts by weight, based on 100 parts by weight of the binder resin.

If the low-softening substance is in a content less than 5 parts by weight, sufficient high-temperature anti-offset properties may be attained with difficulty. Also, when images are fixed on both sides of a recording medium, offset of first-formed (surface) images may occur at the time of fixing of second-formed (back) images.

If the low-softening substance is in a content more than 40 parts by weight, when the toner is produced, toner components tend to melt-adhere to the interior of a toner production apparatus in the case when the toner particles are produced by pulverization, and granulation performance may lower at the time of granulation and also toner particles tend to coalesce one another in the case when the primary particles are produced by polymerization.

In the present invention, when the toner particles are produced by polymerization, the polymerizable monomer used therein may include styrene monomers such as styrene, o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile and acrylic acid amide, any of which may preferably be used. Any of these polymerizable monomers may be used alone, or commonly used in the form of an appropriate mixture of monomers so mixed that the theoretical glass transition temperature (Tg) as described in a publication POLYMER HANDBOOK, 2nd Edition, III pp.139–192 (John Wiley & Sons, Inc.) ranges from 40 to 80° C. If the theoretical glass transition temperature is lower than 40° C., problems may arise in respect of storage stability of toner or running stability of developer. If on the other hand it is higher than 80° C., the fixing point of the toner may become higher. Especially in the case of toners for full-color images, the color mixing performance of the respective color toners at the time of fixing may be insufficient, resulting in a poor color reproducibility, and also the transparency of OHP images may seriously lower. Thus, such temperatures are not preferable from the viewpoint of high image quality.

In the method of obtaining the toner particles by polymerization, from the viewpoint of making the polymerizable monomers undergo polymerization reaction without inhibition, it is especially preferable to add a polar resin simultaneously. As the polar resin used in the present invention, copolymers of styrene with acrylic or methacrylic acid, maleic acid copolymers, polyester resins and epoxy resins may preferably be used. The polar resin may particularly preferably be those not containing in the molecule any unsaturated groups that may react with polymerizable monomers.

As the polymerization initiator used in the present invention, it may include, e.g., azo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide.

The particle size distribution and particle diameter of the toner particles may be controlled by a method in which the type or amount of a slightly water-soluble inorganic salt or a dispersant having the action of protective colloids is changed; or a method in which mechanical device conditions, e.g., agitation conditions such as the peripheral speed of a rotor, pass times and the shape of agitating blades and the shape of a reaction vessel or the concentration of solid matter in the aqueous medium are controlled.

In the present invention, the toner particles may have a core/shell structure wherein shells are formed of a polymer synthesized by polymerization and cores are formed of a low-softening substance. This is preferable because the fixing performance of the toner can be improved without damaging its blocking resistance and also residual monomers can be removed from toner particles with ease.

As a specific method of confirming the core/shell structure of the toner particles, the toner particles are well dispersed in a room temperature curing epoxy resin, followed by curing in an environment of temperature 40° C. for 2 days, and the cured product obtained is dyed with triruthenium tetraoxide optionally in combination with triosmium tetraoxide, thereafter samples are cut out in slices by means of a microtome having a diamond cutter to observe the cross-sectional form of toner particles using a transmission electron microscope (TEM). In the present invention, it is preferable to use the triruthenium tetraoxide dyeing method in order to form a contrast between the materials by utilizing some difference in crystallinity between the low-softening substance constituting the core and the resin constituting the shell.

The toner of the present invention may be used as a one-component developer having the toner, or the toner may be blended with a carrier so as to be used as a two-component developer.

In the case when the toner of the present invention is used as the two-component developer, the carrier may include, e.g., particles of magnetic metals such as surface-oxidized or unoxidized iron, nickel, copper, zinc, cobalt, manganese, chromium and rare earth elements, and alloys or oxides thereof, and ferrite, any of which may be used. There are no particular limitations on methods for its production.

For the purpose of charge control and so forth, it is also preferable to coat the surfaces of the carrier particles with a coat material having a resin. As methods therefor, any conventionally known methods may be used, e.g., a method in which the coat material having a resin is dissolved or suspended in a solvent and then coated to make it adhere to carrier particles, or a method in which it is blended merely in the form of a powder. In order to make coat layers stable, preferred is the method in which the coat material is dissolved in a solvent and then coated.

The coat material to be coated on the carrier particle surfaces may differ depending on the materials for toners. It may include, e.g., but not necessarily limited to, aminoacrylate resins, acrylic resins, copolymers of any of these resins with styrene resins; and silicone resins, polyester resins, fluorine resins, polytetrafluoroethylene, monochlorotrifluoroethylene polymers and polyvinylidene fluoride; any of which may preferably be used. The coating weight of any of these compounds may appropriately be determined so as to satisfy charge-providing performance of the carrier, and may usually be in the range of from 0.1 to 30% by weight, and preferably from 0.3 to 20% by weight, in total, based on the weight of the carrier.

Materials for the carrier used in the present invention may typically include ferrite particles having composition of 98% or more of Cu—Zn—Fe [compositional ratio: (5 to 20):(5 to 20):(30 to 80)], and there are no particular limitations so long as its performance is not damaged. It may also be in the form of, e.g., a resin carrier constituted of a binder resin, a metal oxide and a magnetic metal oxide.

When the carrier is blended with the toner particles, good results can be obtained when they are blended in such a proportion that the toner in the two-component developer is in a concentration of from 2 to 9% by weight, and preferably from 3 to 8% by weight. If the toner concentration is less than 2% by weight, the image density tends to lower and become infeasible for practical use. If it is more than 9% by weight, fog and in-machine scatter may frequently occur to shorten the running lifetime of the developer.

Image forming methods and apparatus units which make use of the toner of the present invention will be described below with reference to the drawings.

Figure 8:
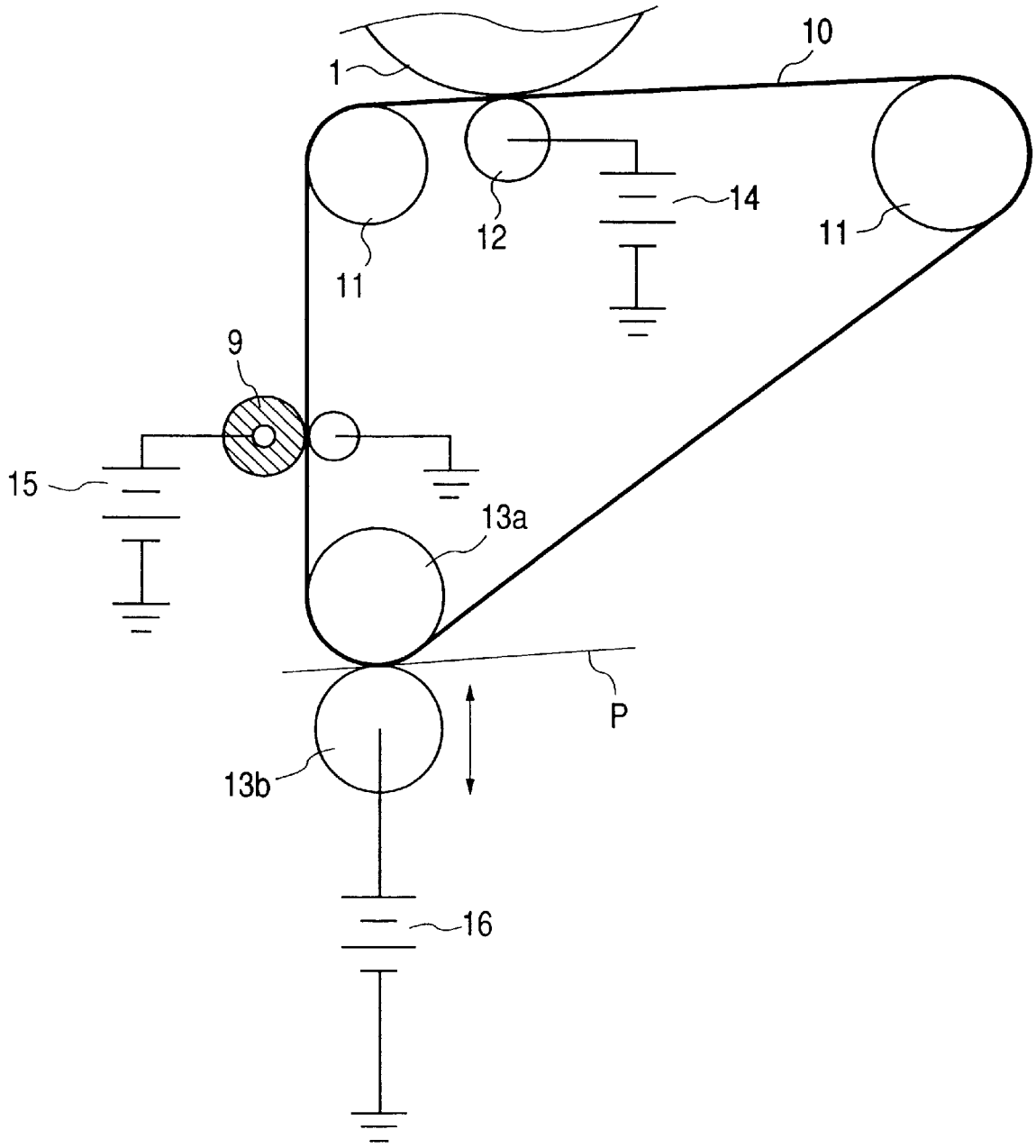
FIG. 8 illustrates a image forming apparatus employing a belt type intermediate transfer member in place of a drum type intermediate transfer member of the image forming apparatus shown in FIG. 1.

FIGS. 1 and 8 illustrate schematically image forming apparatus in which a multiple toner image is one-time transferred to a recording medium by the image forming method of the present invention, using an intermediate transfer member.

FIG. 1 illustrates schematically an image forming apparatus in which a multiple toner image is one-time transferred to a recording medium by the image forming method of the present invention, using an intermediate transfer member.

A rotatable charging roller 2 as a charging member, to which a charging bias voltage has been applied, is brought into contact with the surface of a photosensitive drum 1 as a latent image bearing member while rotating the charging roller 2, to effect uniform primary charging of the photosensitive drum surface. Then, a first electrostatic latent image is formed on the photosensitive drum 1 by its exposure to laser light E emitted from a light-source L as an exposure means. The first electrostatic latent image thus formed is developed by the use of a black toner held in a black developing assembly 4Bk as a first developing assembly, to form a black toner image; the developing assembly being provided in a rotatable rotary unit 4. The black toner image formed on the photosensitive drum 1 is primarily transferred electrostatically onto an intermediate transfer drum 5 by the action of a transfer bias voltage applied to a conductive support of the intermediate transfer member. Next, a second electrostatic latent image is formed on the surface of the photosensitive drum 1 in the same way as the above, and the rotary unit 4 is rotated to develop the second electrostatic latent image by the use of a yellow toner held in a yellow developing assembly 4Y as a second developing assembly, to form a yellow toner image. The yellow toner image is primarily transferred electrostatically onto the intermediate transfer drum 5 on which the black toner image has been transferred primarily. Similarly, third and fourth electrostatic latent images are formed and, rotating the rotary unit 24, they are developed successively by the use of a magenta toner held in a magenta developing assembly 4M as a third developing assembly and a cyan toner held in a cyan developing assembly 4C as a fourth developing assembly, respectively, and the magenta toner image and cyan toner image formed are primarily transferred successively. Thus, the respective color toner images are primarily transferred on the intermediate transfer drum 5. The toner images primarily transferred as a multiple toner image onto the intermediate transfer drum 5 are secondarily one-time transferred electrostatically onto a recording medium P by the action of a transfer bias voltage applied from a second transfer means 8 positioned on the opposite side via the recording medium P. The multiple toner image secondarily transferred onto the recording medium P is heat-fixed to the recording medium P by means of a fixing means 3 having a heat roller 3*a* and a pressure roller 3*b*. Transfer residual toner remaining on the surface of the photosensitive drum after transfer is collected by a cleaner having a cleaning blade coming in contact with the surface of the photosensitive drum 1, thus the photosensitive drum is cleaned.

For the primary transfer from the photosensitive drum 1 to the intermediate transfer drum 5, a transfer electric current is formed by applying a bias from a power source (not shown) to the conductive support of the intermediate transfer drum 5 serving as a first transfer means, thus the toner images can be transferred.

The intermediate transfer drum 5 comprises a conductive support 5*a* which is a rigid body and an elastic layer 5*b* which covers its surface.

The conductive support 5*a* may be formed using a metal such as aluminum, iron, copper or stainless steel, or a conductive resin with carbon or metal particles dispersed therein. As its shape, it may be a cylinder, a cylinder through the center of which a shaft is passed, or a cylinder reinforced on its inside.

The elastic layer 5*b* may preferably be formed using, but not particularly limited to, an elastomer rubber including styrene-butadiene rubber, high styrene rubber, butadiene rubber, isoprene rubber, ethylene-propyelne copolymer, nitrile butadiene rubber (NBR), chloroprene rubber, butyl rubber, silicone rubber, fluororubber, nitrile rubber, urethane rubber, acrylic rubber, epichlorohydrin rubber and norbornane rubber. Resins such as polyolefin resins, silicone resins, fluorine resins, polycarbonate resins, and copolymers or mixtures of any of these may also be used.

On the surface of the elastic layer, a surface layer may further be formed in which a highly lubricating and water-repellent lubricant powder has been dispersed in any desired binder.

There are no particular limitations on the lubricant. Preferably usable are various fluororubbers, fluoroelastomers, carbon fluorides comprising fluorine-bonded graphite, fluorine compounds such as polytetrafluoroethylene (PTFE), polyvinylidene fluoride (PVDF), ethylene-tetrafluoroethylene copolymer (ETFE) and tetrafluoroethylene-perfluoroalkyl vinyl ether copolymers (PFA), silicone compounds such as silicone resin particles, silicone rubbers and silicone elastomers, polyethylene (PE), polypropylene (PP), polystyrene (PS), acrylic resins, polyamide resins, phenol resins, and epoxy resins.

In the binder of the surface layer, a conducting agent may be added appropriately in order to control its resistance. The conducting agent may include various conductive inorganic particles, carbon black, ionic conducting agents, conductive resins and conductive-particle-dispersed resins.

The multiple toner image on the intermediate transfer drum 5 is secondarily one-time transferred onto the recording medium P by means of the second transfer means 8. Usable as the transfer means is a non-contact electrostatic transfer means making use of a corona charging assembly, or a contact electrostatic transfer means making use of a transfer roller or a transfer belt.

As the fixing means 3, in place of the heat roller fixing means having a heat roller 3*a* and a pressure roller 3*b*, a film heat-fixing means may be used which heat-fixes the multiple toner image onto the recording medium P by heating a film coming in contact with the toner images on the recording medium P and thereby heating the toner images on the recording medium P.

In place of the intermediate transfer drum as the intermediate transfer member used in the image forming apparatus shown in FIG. 1, an intermediate transfer belt may be used to one-time transfer the multiple toner image to the recording medium. Such an intermediate transfer belt is constituted as shown in FIG. 8.

In the course the toner images formed and held on the photosensitive drum 1 pass a nip between the photosensitive drum 1 and an intermediate transfer belt 10, they are primarily transferred successively to the periphery of the intermediate transfer belt 10 by the aid of a primary transfer bias applied to the intermediate transfer belt 10 through a primary transfer roller 12.

The primary transfer bias for the successive superimposing transfer of the first- to fourth-color toner images to the intermediate transfer belt 10 has a polarity opposite to that of the toner and is applied from a bias power source 14.

Reference numeral 13*b* denotes a secondary transfer roller, which is supported axially in parallel to a secondary transfer opposing roller 13*a* and is so provided as to become separable from the bottom part of the intermediate transfer belt 10.

In the step of the primary transfer of the first- to third-color toner images from the photosensitive drum 1 to the intermediate transfer belt 10, the secondary transfer roller 13*b* and an intermediate transfer belt cleaner 9 can stand apart from the intermediate transfer belt 10.

To transfer to a recording medium P a synthesized full-color toner image transferred onto the intermediate transfer belt 10, the secondary transfer roller 13*b* is brought into contact with the intermediate transfer belt 10 and also the recording medium P is fed to the nip between the intermediate transfer belt 10 and the secondary transfer roller 13*b* at a given timing, where a secondary transfer bias is applied from a bias power source 16 to the secondary transfer roller 13*b*. By the aid of this secondary transfer bias, the synthesized full-color toner image is secondarily transferred from the intermediate transfer belt 10 to the recording medium P.

After the image transfer to the recording medium P is completed, a cleaning charging member 9 is brought into contact with the intermediate transfer belt 10, and a bias having a polarity opposite to that of the photosensitive drum 1 is applied from a bias power source 15, so that electric charges having a polarity opposite to that of the photosensitive drum 1 are imparted to the toner (transfer residual toner) remaining on the intermediate transfer belt 10 without being transferred to the recording medium P.

The transfer residual toner is transferred electrostatically to the photosensitive drum 1 at the nip between the intermediate transfer belt 10 and the photosensitive drum 1 and in the vicinity thereof, thus the intermediate transfer belt 10 is cleaned.

The intermediate transfer belt 10 comprises a beltlike base layer and a surfacing layer provided thereon. The surfacing layer may be constituted of a plurality of layers.

In the base layer and the surfacing layer, rubber, elastomer or resin may be used. For example, as the rubber and the elastomer, usable are one or more materials selected from the group consisting of natural rubber, isoprene rubber, styrene-butadiene rubber, butadiene rubber, butyl rubber, ethylene-propylene rubber, ethylene-propylene copolymer, chloroprene rubber, chlorosulfonated polyethylene, chlorinated polyethylene, acrylonitrile butadiene rubber, urethane rubber, syndiotactic 1,2-polybutadiene, epichlorohydrin rubber, acrylic rubber, silicone rubber, fluororubber, polysulfide rubbers, polynorbornane rubber, hydrogenated rubbers, and thermoplastic elastomers (e.g., polystyrene type, polyolefin type, polyvinyl chloride type, polyurethane type, polyamide type, polyester type and fluorine resin type elastomers), but not limited to these materials. As the resin, resins such as polyolefin resins, silicone resins, fluorine resins and polycarbonate resins may be used. Copolymers or mixtures of any of these resins may also be used.

As the base layer, any of the above rubbers, elastomers and resins formed into films may be used. A core material layer having the form of woven fabric, nonwoven fabric, yarn or film on one side or both sides of which any of the above rubbers, elastomers and resins is coated, soaked or sprayed may also be used.

As materials constituting the core material layer, usable are one or more materials selected from the group consisting of, e.g., natural fibers such as cotton, silk and linen; regenerated fibers such as chitin fiber, alginic acid fiber and regenerated cellulose fiber; semisynthetic fibers such as acetate fiber; synthetic fibers such as polyester fiber, nylon fiber, acrylic fiber, polyolefin fiber, polyvinyl alcohol fiber, polyvinyl chloride fiber, polyvinylidene chloride fiber, polyurethane fiber, poly alkylparaoxybenzoate fiber, polyacetal fiber, aramid fiber, polyfluoroethylene fiber and phenol fiber; inorganic fibers such as carbon fiber, glass fiber and boron fiber; and metal fibers such as iron fiber and copper fiber; but not limited to these materials of course.

A conducting agent may further be added to the base layer and surfacing layer in order to control the resistivity of the intermediate transfer belt. There are no particular limitations on the conducting agent. For example, usable are one or more agents selected from the group consisting of carbon powder, metal powders such as aluminum or nickel powder, metal oxides such as titanium oxide, and conductive polymeric compounds such as quaternary-ammonium-salt-containing polymethyl methacrylate, polyvinyl aniline, polyvinyl pyrrole, polydiacetylene, polyethyleneimine, boron-containing polymeric compounds, and polypyrrole, but not limited to these conducting agents.

A lubricant may optionally be added in order to improve the lubricity of the intermediate transfer belt to improve its transfer performance.

There are no particular limitations on the lubricant. Preferably usable are various fluororubbers, fluoroelastomers, carbon fluorides comprising fluorine-bonded graphite, fluorine compounds such as polytetrafluoroethylene (PTFE), polyvinylidene fluoride (PVDF), ethylene-tetrafluoroethylene copolymer (ETFE) and tetrafluoroethylene-perfluoroalkyl vinyl ether copolymers (PFA), silicone compounds such as silicone resin particles, silicone rubbers and silicone elastomers, polyethylene (PE), polypropylene (PP), polystyrene (PS), acrylic resins, polyamide resins, phenol resins, and epoxy resins.

An image forming method will be described with reference to FIG. 2, in which toner images of different colors are respectively formed in a plurality of image forming sections and they are transferred to the same transfer medium while superimposing them successively.

In this method, first, second, third and fourth image forming sections 29*a*, 29*b*, 29*c* and 29*d* are arranged, and the image forming sections have latent image bearing members used exclusively therein, i.e., photosensitive drums 19*a*, 19*b*, 19*c* and 19*d*, respectively.

The photosensitive drums 19*a* to 19*d* are provided around their peripheries with latent image forming means 23*a*, 23*b*, 23*c* and 23*d*, developing means 17*a*, 17*b*, 17*c* and 17*d*, transfer discharging means 24*a*, 24*b*, 24*c* and 24*d*, and cleaning means 18*a*, 18*b*, 18*c* and 18*d*, respectively.

Under such constitution, first, on the photosensitive drum 19*a* of the first image forming section 29*a*, for example, a yellow component color latent image is formed by the latent image forming means 23*a*. This latent image is converted into a visible image (toner image) by the use of a developer having a yellow toner, of the developing means 17*a*, and the toner image is transferred to a transfer medium S, a recording medium, by means of the transfer means 24*a*.

In the course the yellow toner image is transferred to the transfer medium S as described above, in the second image forming section 29*b* a magenta component color latent image is formed on the photosensitive drum 19*b*, and is subsequently converted into a visible image (a toner image) by the use of a developer having a magenta toner, of the developing means 17*b*. This visible image (magenta toner image) is transferred superimposingly to a preset position of the transfer medium S when the transfer medium S on which the transfer in the first image forming section 29*a* has been completed is transported to the transfer means 24*d*.

Subsequently, in the same manner as described above, cyan and black color toner images are formed in the third and fourth image forming sections 29*c* and 29*d*, respectively, and the cyan and black color toner images are transferred superimposingly to the same transfer medium S. Upon completion of such an image forming process, the transfer medium S is transported to a fixing section 22, where the toner images on the transfer medium S are fixed. Thus, a multi-color image is obtained on the transfer medium S. The respective photosensitive drums 19*a*, 19*b*, 19*c* and 19*d* on which the transfer has been completed are cleaned by the cleaning means 18*a*, 18*b*, 18*c* and 18*d*, respectively, to remove the remaining toner, and are served on the next latent image formation subsequently carried out.

In the above image forming apparatus, a transport belt 25 is used to transport the recording medium, the transfer medium S. As viewed in FIG. 2, the transfer medium S is transported from the right side to the left side, and, in the course of this transport, passes through the respective transfer means 24*a*, 24*b*, 24*c* and 24*d* of the image forming sections 29*a*, 29*b*, 29*c* and 29*d*, respectively.

In this image forming method, as a transport means for transporting the transfer medium, a transport belt comprised of a mesh made of Tetoron fiber and a transport belt comprised of a thin dielectric sheet made of a polyethylene terephthalate resin, a polyimide resin or a urethane resin are used from the viewpoint of readiness in working and durability.

After the transfer medium S has passed through the fourth image forming section 29*d*, an AC voltage is applied to a charge eliminator 20, whereupon the transfer medium S is destaticized, separated from the belt 68, thereafter sent into a fixing assembly 22 where the toner images are fixed, and finally sent out through a paper outlet 26.

In this image forming method, the image forming sections are provided with respectively independent latent image bearing members, and the transfer medium may be so made as to be sent successively to the transfer zones of the respective latent image bearing members by a belt type transport means.

In this image forming method, a latent image bearing member common to the respective image forming sections may be provided, and the transfer medium may be so made as to be sent repeatedly to the transfer zone of the latent image bearing member by a drum type transport means so that the toner images of the respective colors are received there.

Since, however, the transfer belt has a high volume resistivity, the transport belt continues to increase charge quantity in the course the transfer is repeated several times, as in the case of color image forming apparatus. Hence, no uniform transfer can not be maintained unless the transfer electric currents are made greater successively at every transfer.

The toner of the present invention has so good a transfer performance that the transfer performance of the toner at every transfer can be made uniform under the like transfer electric currents even if the charging of the charging means has increased at every repetition of transfer, so that images with a good quality and a high quality level can be obtained.

Figure 3:
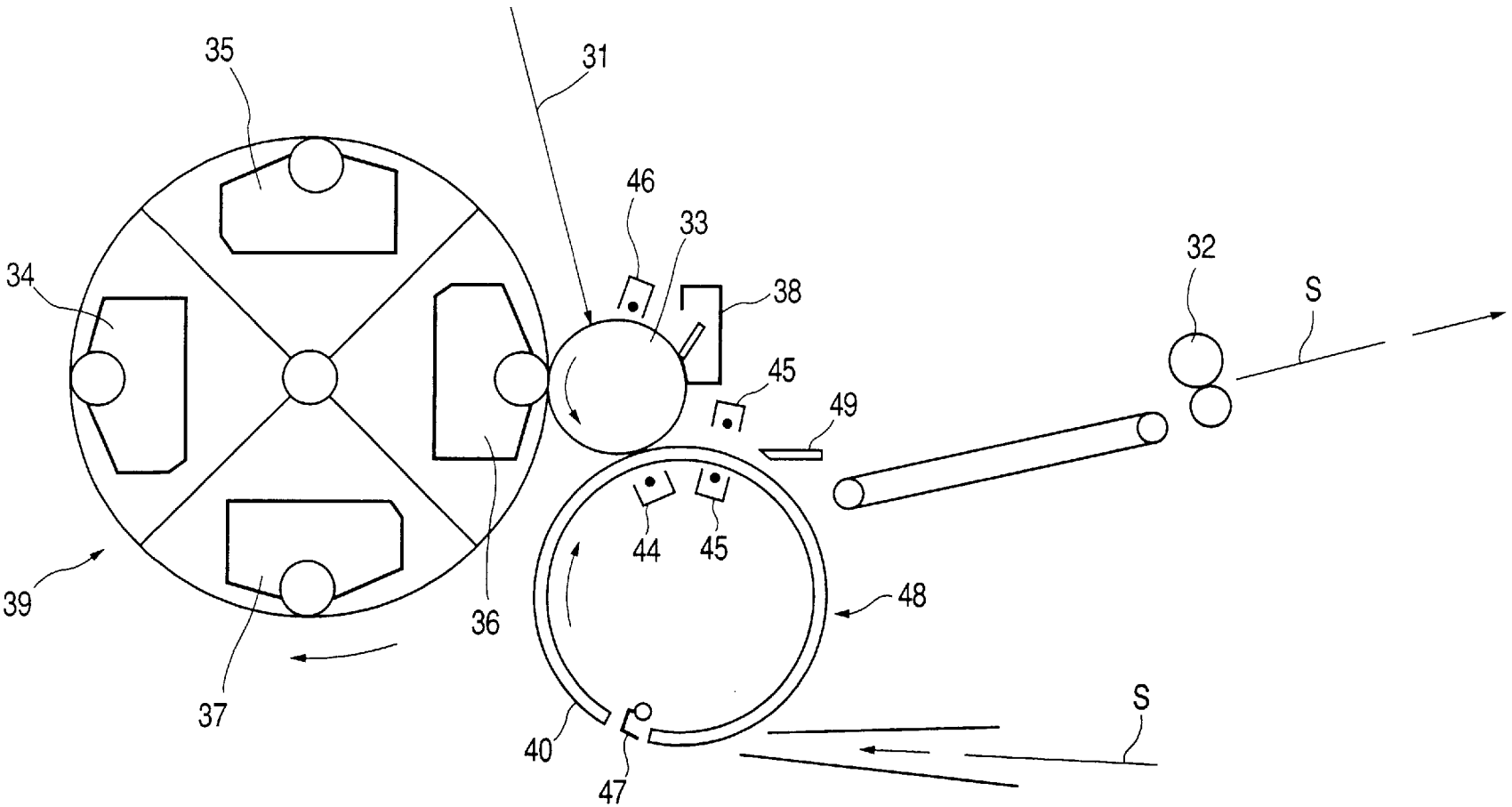
FIG. 3 illustrates still another image forming apparatus that can carry out an image forming method making use of the toner of the present invention.

An image forming method for forming full-color images according to another embodiment will further be described with reference to FIG. 3.

An electrostatic latent image formed on a photosensitive drum 33 through a suitable means is rendered visible by a first developer held in a developing assembly 36 serving as a developing means, attached to a rotary developing unit 39 which is rotated in the direction of an arrow. The color toner image (the first color) thus formed on the photosensitive drum 33 is transferred by means of a transfer charging assembly 44 to a transfer medium, a recording medium S, held on a transfer drum 48 by a gripper 47. Transfer residual toner remaining on the surface of the photosensitive drum 33 after transfer is collected by a cleaner having a cleaning blade coming in contact with the surface of the photosensitive drum 33, thus the photosensitive drum 33 is cleaned.

In the transfer charging assembly 44, a corona charging assembly or a contact transfer charging assembly is used. In the case when the corona charging assembly is used in the transfer charging assembly 44, a voltage of −10 kV to +10 kV is applied, and transfer electric currents are set at −500 μA to +500 μA. On the periphery of the transfer drum 48, a holding member is provided. This holding member is formed of a film-like dielectric sheet such as polyvinylidene fluoride resin film or polyethylene terephthalate film. For example, a sheet with a thickness of from 100 μm to 200 μm and a volume resistivity of from $10^{12}$ to $10^{14}$ Ω·cm is used.

Next, for the second color, the rotary developing unit is rotated until a developing assembly 35 faces the photosensitive drum 33. Then, a second-color latent image is developed by a second developer held in the developing assembly 35, and the color toner image thus formed is also transferred superimposingly to the same transfer medium, the recording medium S, as the above.

Similar operation is also repeated for the third and fourth colors. Thus, the transfer drum 48 is rotated given times while the transfer medium, the recording medium S, is kept being gripped thereon, so that the toner images corresponding to the number of given colors are multiple-transferred to the recording medium. Transfer electric currents for electrostatic transfer may preferably be made greater in the order of first color, second color, third color and fourth color so that the toners may less remain on the photosensitive drum after transfer.

Meanwhile, high transfer electric currents are not preferable because the images being transferred may be disordered. Since, however, the toner of the present invention has a superior transfer performance, the second, third and fourth color images to be multiple-transferred can be transferred surely. Hence, images of any turn of colors are formed neatly, and a multi-color image with sharp tones can be obtained. Also, in full-color images, beautiful images with a superior color reproduction can be obtained. Moreover, since it is no longer necessary to make the transfer electric currents great so much, the image disorder in the transfer step can be made less occur. When the recording medium S is separated from the transfer drum 48, charges are eliminated by means of a separation charging assembly 45, where the recording medium S may greatly be attracted electrostatically to the transfer drum if the transfer electric currents are great, and the transfer medium can not be separated unless the electric currents at the time of separation are made greater. If made greater, since such electric currents have a polarity reverse to that of the transfer electric currents, the toner images may be disordered, or the toners may scatter from the transfer medium to contaminate the inside of the image forming apparatus. Since the toner of the present invention can be transferred with ease, the transfer medium can be readily separated without making the separation electric currents greater, so that the image disorder and toner scatter at the time of separation can be prevented. Hence, the toner of the present invention can be used preferably especially in the image forming method that forms multi-color images or full-color images, having the step of multiple transfer.

The recording medium S on which the multiple transfer has been completed is separated from the transfer drum 48 by means of the separation charging assembly 45. Then the toner images held thereon are fixed by means of a heat-pressure roller fixing assembly 3 having a web impregnated with silicone oil, and color-additively mixed at the time of fixing, whereupon a full-color copied image is formed.

Figure 4:
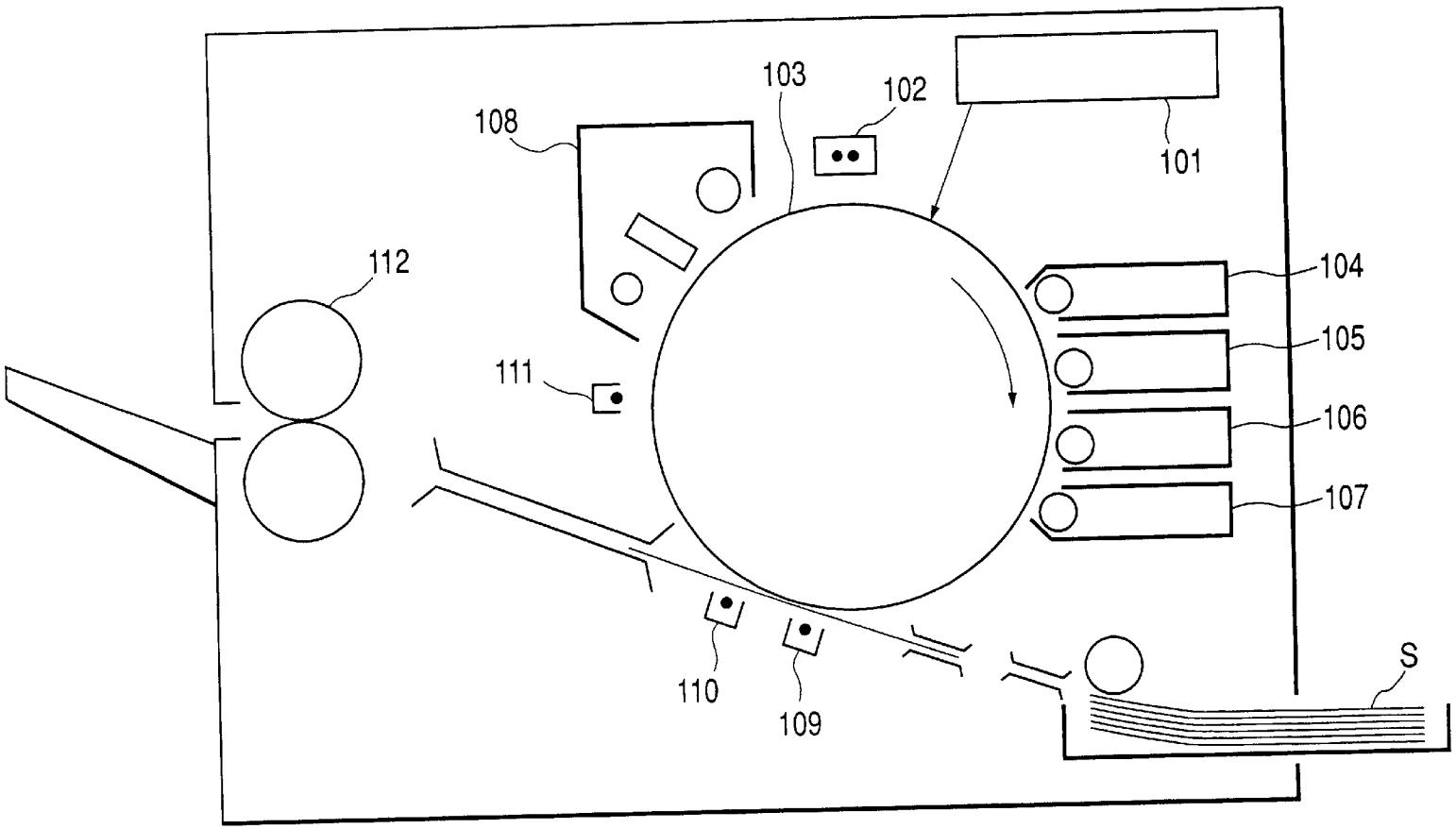
FIG. 4 illustrates a further image forming apparatus that can carry out an image forming method making use of the toner of the present invention.

A multiple development one-time transfer method will be described with reference to FIG. 4, taking an example of a full-color image forming apparatus.

Electrostatic latent images formed on a photosensitive drum 103 by a charging assembly 102 and an exposure means 101 making use of laser light is rendered visible by development successively carried out using toners by means of developing assemblies 104, 105, 106 and 107. In the developing process, non-contact development is used preferably. In the non-contact development, the developer layer formed in the developing assembly does not rub on the surface of the image forming member photosensitive drum 103, and hence the developing can be carried out without disorder of the image formed in the preceding developing step in the second and subsequent developing steps.

The toner images for a multi-color image or full-color image which have been formed superimposingly on the photosensitive drum 103 are transferred to a transfer medium, a recording medium S, by means of a transfer charging assembly 109. In the transfer step, electrostatic transfer is used preferably, where corona discharging transfer or contract transfer is utilized. The former corona discharging transfer is a method in which a transfer charging assembly 109 that generates corona discharge is provided opposingly to the toner images, interposing the transfer medium recording medium S between them, and corona discharge is acted on the back of the recording medium to transfer the toner images electrostatically. The latter contract transfer is a method in which a transfer roller or transfer belt is brought into contact with the image forming member photosensitive drum 103 and then the toner images are transferred while applying a bias to the roller, or by electrostatic charging from the back of the belt, interposing the transfer medium recording medium S between them. By such an electrostatic transfer, the multi-color toner image held on the photosensitive drum 103 is transferred at one time to the transfer medium, the recording medium S. Since in such a one-time transfer system the toners transferred are in a large quantity, the toners may remain in a large quantity after transfer to tend to cause non-uniform transfer and, in the full-color image, tend to cause color non-uniformity.

However, the toner of the present invention has so good a transfer performance that any color images of the multi-color image can be formed neatly. In full-color images, beautiful images with a superior color reproduction can be obtained. Moreover, since the toner can be transferred in a good efficiency even under a low electric current, the image disorder can be made less occur. Moreover, since the recording medium can be separated with ease, any toner scatter at the time of separation can be made less occur. Also, because of a superior releasability, a good transfer performance can be exhibited in the contact transfer means. Hence, the toner of the present invention can be used preferably also in the image forming method having the step of multiple image one-time transfer.

The recording medium S on which the multi-color toner image has been transferred at one time is separated from the photosensitive drum 103 by means of a separation charging assembly 112, and then fixed by means of a heat roller fixing assembly 112, whereupon a multi-color image is formed.

Transfer residual toner remaining on the surface of the photosensitive drum 103 after transfer is collected by a cleaner 108 having a cleaning blade so provided it can come in contact with the surface of the photosensitive drum 1, thus the photosensitive drum 103 is cleaned. The cleaning blade of the cleaner 108 stands apart from the surface of the photosensitive drum 103 during standby, and is movable so as to come in contact with the photosensitive drum 103 when the toner images are transferred to the transfer medium, recording medium S, from the photosensitive drum 103

Figure 5:
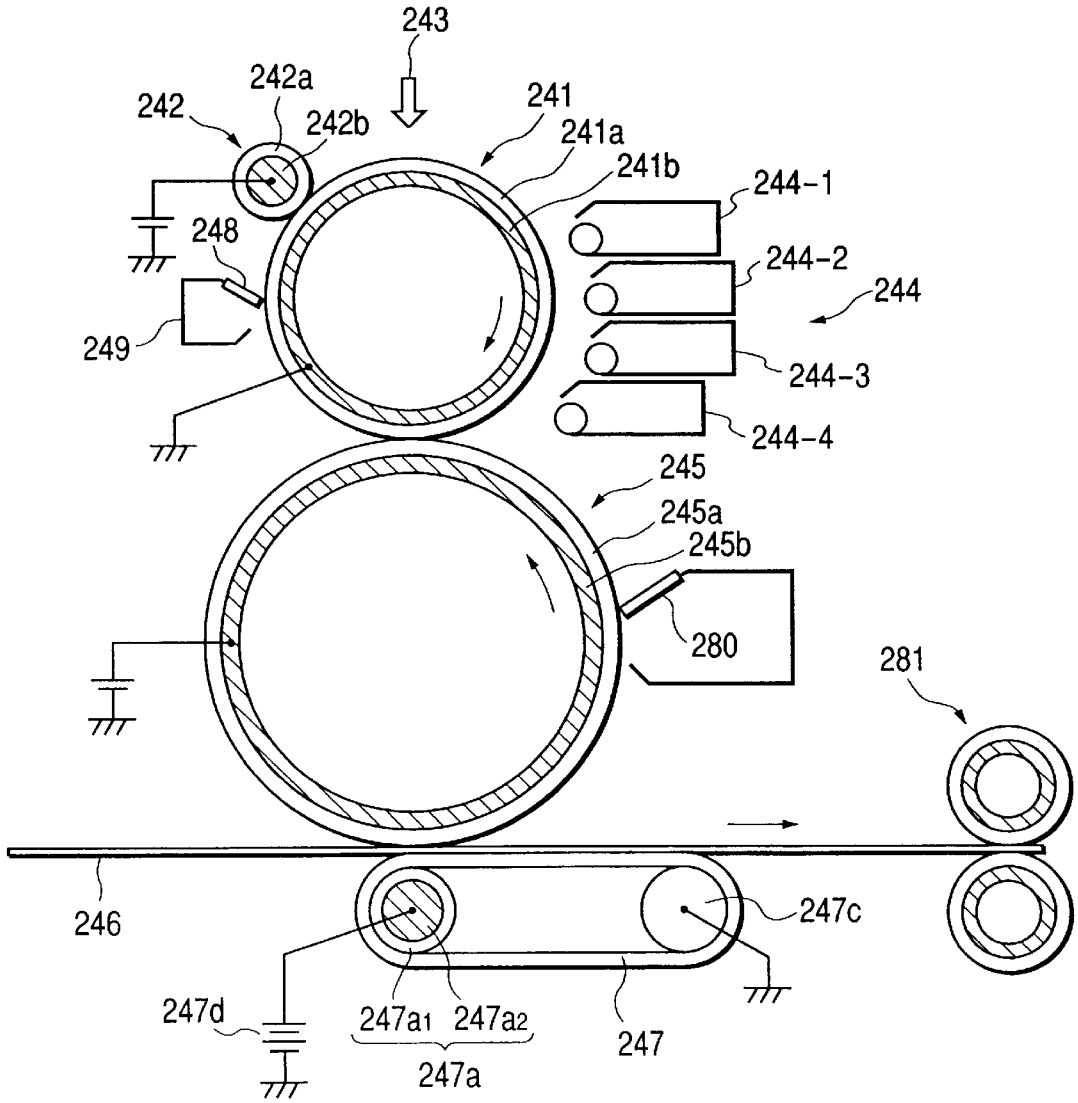
FIG. 5 illustrates a still further image forming apparatus that can carry out an image forming method making use of the toner of the present invention.

FIG. 5 illustrates an image apparatus employing a transfer belt as a secondary transfer means when four color toner images primarily transferred to an intermediate transfer drum is one-time transferred to a recording medium by the use of the intermediate transfer drum.

In the apparatus system shown in FIG. 5, a developer having a cyan toner, a developer having a magenta toner, a developer having a yellow toner and a developer having a black toner are put into developing assemblies 244-1, 244-2, 244-3 and 244-4, respectively. Electrostatic latent images formed on a photosensitive member 241 are developed to form toner images of respective colors on the photosensitive member 241. The photosensitive member 241 is a photosensitive drum or photosensitive belt having a photoconductive insulating material layer formed of a-Se, CdS, $ZnO_2$, OPC or a-Si. The photosensitive member 241 is driven rotatingly by means of a drive system (not shown).

As the photosensitive member 241, a photosensitive member having an amorphous silicon photosensitive layer or an organic photosensitive layer is used preferably.

The organic photosensitive layer may be of a single-layer type in which the photosensitive layer contains a charge generating material and a charge transporting material in the same layer, or may be a function-separated photosensitive layer comprised of a charge transport layer and a charge generation layer. A multi-layer type photosensitive layer comprising a conductive substrate and formed superposingly thereon the charge generation layer and the charge transport layer in this order is one of preferred examples.

As binder resins for the organic photosensitive layer, polycarbonate resins, polyester resins or acrylic resins have an especially good transfer performance and cleaning performance, and may hardly cause faulty cleaning, melt-adhesion of toner to the photosensitive member and filming of external additives.

The step of charging has a system making use of a corona charging assembly and being in non-contact with the photosensitive member 241, or a contact type system making use of a roller or the like. Either system may be used. The contact type system as shown in FIG. 5 is used preferably so as to enable efficient and uniform charging, simplify the system and make ozone less occur.

A charging roller 242 is constituted basically of a mandrel 242*b* and a conductive elastic layer 242*a* that forms the periphery of the former. The charging roller 242 is brought into pressure contact with the surface of the photosensitive member 241 and is rotated followingly as the photosensitive member 241 is rotated.

When the charging roller is used, the charging process may preferably be performed under conditions of a roller contact pressure of 5 to 500 g/cm, and an AC voltage of 0.5 to 5 kVpp, an AC frequency of 50 Hz to 5 kHz and a DC voltage of plus-minus 0.2 to plus-minus 1.5 kV when a voltage formed by superimposing an AC voltage on a DC voltage, and a DC voltage of from plus-minus 0.2 to plus-minus 5 kV when a DC voltage is used.

As a charging means other than the charging roller, there is a method making use of a charging blade and a method making use of a conductive brush. These contact charging means have the effect of, e.g., making high voltage unnecessary and making ozone less occur.

The charging roller and charging blade as contact charging means may preferably be made of a conductive rubber, and a release coat may be provided on its surface. The release coat may be formed of a nylon resin, PVDF (polyvinylidene fluoride) or PVDC (polyvinylidene chloride), any of which may be used.

The toner image on the photosensitive member 241 is transferred to an intermediate transfer drum 245 to which a voltage (e.g., plus-minus 0.1 to plus-minus 5 kV) is applied. The surface of the photosensitive member 241 is cleaned by a cleaning means 249 having a cleaning blade 248.

The intermediate transfer drum 245 is comprised of a pipe-like conductive mandrel 245*b* and a medium-resistance elastic material layer 245*a* formed on its periphery. The mandrel 245*b* may comprise a plastic pipe provided thereon with a conductive coating.

The medium-resistance elastic material layer 245*a* is a solid or foamed-material layer made of an elastic material such as silicone rubber, Teflon rubber, chloroprene rubber, urethane rubber or EPDM (ethylene-propylene-diene terpolymer) in which a conductivity-providing agent such as carbon black, zinc oxide, tin oxide or silicon carbide has been mixed and dispersed to adjust electrical resistance (volume resistivity) to a medium resistance of from $10^5$ to $10^{11}$ Ω·cm.

The intermediate transfer drum 245 is provided in contact with the bottom part of the photosensitive member 241, being axially supported in parallel to the photosensitive member 241, and is driven rotatingly at the same peripheral speed as the photosensitive member 241 in the anti-clockwise direction as shown by an arrow.

The first-color cyan toner image formed and held on the surface of the photosensitive member 241 is, in the course where it is passed through the transfer nip portion where the photosensitive member 241 and the intermediate transfer drum 245 come into contact, transferred intermediately sequencially to the periphery of the intermediate transfer drum 245 by the aid of the electric filed formed at the transfer nip portion by a transfer bias applied to the intermediate transfer drum 245.

If necessary, after the toner image has been transferred to the transfer medium, the surface of the intermediate transfer drum 245 may be cleaned by a cleaning means which can become contact with or separate from it. When the toner is present on the intermediate transfer drum 245, the cleaning means is separated from the surface of the intermediate transfer drum so that the toner image is not disturbed.

A transfer means 247 is provided in contact with the bottom part of the intermediate transfer drum 245, being axially supported in parallel to the intermediate transfer drum 245. The transfer means 247 is, e.g., a transfer roller or a transfer belt, and is driven rotatingly at the same peripheral speed as the intermediate transfer drum 245 in the clockwise direction as shown by an arrow. The transfer means may be so provided that it comes into direct contact with the intermediate transfer drum, or may be so disposed that a belt or the like comes into contact with, and between, the intermediate transfer drum and the transfer means.

In the case of the transfer roller, it is constituted basically of a mandrel at the center and a conductive elastic layer that forms the periphery of the former.

The intermediate transfer drum and the transfer roller may be formed of commonly available materials. The elastic layer of the transfer roller may be made to have a volume resistivity set smaller than the volume resistivity of the elastic layer of the intermediate transfer drum, whereby the voltage applied to the transfer roller can be lessened, good toner images can be formed on the transfer medium and also the transfer medium can be prevented from being wound around the intermediate transfer drum. In particular, the elastic layer of the intermediate transfer drum may preferably have a volume resistivity at least 10 times the volume resistivity of the elastic layer of the transfer roller.

The hardness of the intermediate transfer drum and transfer roller is measured according to JIS K-6301. The intermediate transfer drum used in the present invention may preferably be constituted of an elastic layer with a hardness in the range of from 10 to 40 degrees. As for the hardness of the transfer roller, the transfer roller may preferably have an elastic layer with a hardness higher than the hardness of the elastic layer of the intermediate transfer drum and has a value of from 41 to 80 degrees, in order to prevent the transfer medium from being wound around the intermediate transfer drum. If the intermediate transfer drum and the transfer roller have a reverse hardness, a concave may be formed on the transfer roller side to tend to cause the transfer medium to wind around the intermediate transfer drum.

As shown in FIG. 5, a transfer belt 247 is provided beneath the intermediate transfer drum 245. The transfer belt 247 is stretched over two rollers provided in parallel to the axis of the intermediate transfer drum 245, i.e., a bias roller 247*a* and a tension roller 247*c*, and is driven by a drive means (not shown). The transfer belt 247 is so constructed as to be movable in the directions of an arrow on the side of the bias roller 247*a* around the tension roller 247*c* so that it can become contact with or separate from the intermediate transfer drum 245 upward or downward in the direction of the arrow. To the bias roller 247*a*, a desired secondary transfer bias is applied by a secondary transfer bias source 247*d*. As for the tension roller 247*c*, it is ground.

With regard to the transfer belt 247, used in the present embodiment is a rubber belt comprising a thermosetting urethane elastomer in which carbon black has been dispersed so as to be controlled to have a thickness of about 300 $\mu$m and a volume resistivity of $10^8$ to $10^{12}$ Ω·cm (at the time of application of 1 kV) and the surface of which is further covered with a fluororubber of 20 $\mu$m thick so as to be controlled to have a volume resistivity of $10^{15}$ Ω·cm (at the time of application of 1 kV). It has the shape of a tube of 80 mm long and 300 mm wide in external size.

The transfer belt 247 described above is elongated by about 5% by tension applied by the aid of the bias roller 247*a* and tension roller 247*c*.

The transfer belt 247 is rotated at a speed equal to, or made different from, the peripheral speed of the intermediate transfer drum 245. The transfer medium 246 is transported between the intermediate transfer drum 245 and the transfer belt 247 and simultaneously a bias with a polarity reverse to that of the toner is applied to the transfer belt 247 from a transfer bias applying means, so that the toner image on the intermediate transfer drum 245 is transferred to the surface side of the transfer medium 246.

A rotating member for transfer may be made of the same material as used in the charging roller. The transfer process may preferably be performed under conditions of a roller contact pressure of 5 to 500 g/cm and a DC voltage of plus-minus 0.2 to plus-minus 10 kV.

A conductive elastic layer 247$a_1$ of the bias roller 247*a* is made of, e.g., an elastic material having a volume resistivity of $10^6$ to $10^{10}$ Ω·cm, e.g., a polyurethane, or an ethylene-propylene-diene type terpolymer (EPDM), with a conductive material such as carbon dispersed therein. A bias is applied to a mandrel 247$a_2$ by a constant voltage power source. As bias conditions, a voltage of from plus-minus 0.2 to plus-minus 10 kV is preferred.

Subsequently, the transfer medium 246 is transported to a fixing assembly 281 constituted basically of a heat roller provided internally with a heating element such as a halogen heater and an elastic material pressure roller brought into contact therewith under pressure, and is passed between the heat roller and the pressure roller, thus the toner image is heat-and-pressure fixed to the transfer medium. Another method may also be used in which the toner image is fixed by a heater through a film.

To the developing apparatus (developing assemblies) shown in FIGS. 1 to 5, it is possible to apply either method of one-component development making use of one-component developers and two-component development making use of two-component developers having toners and carriers.

Figure 6:
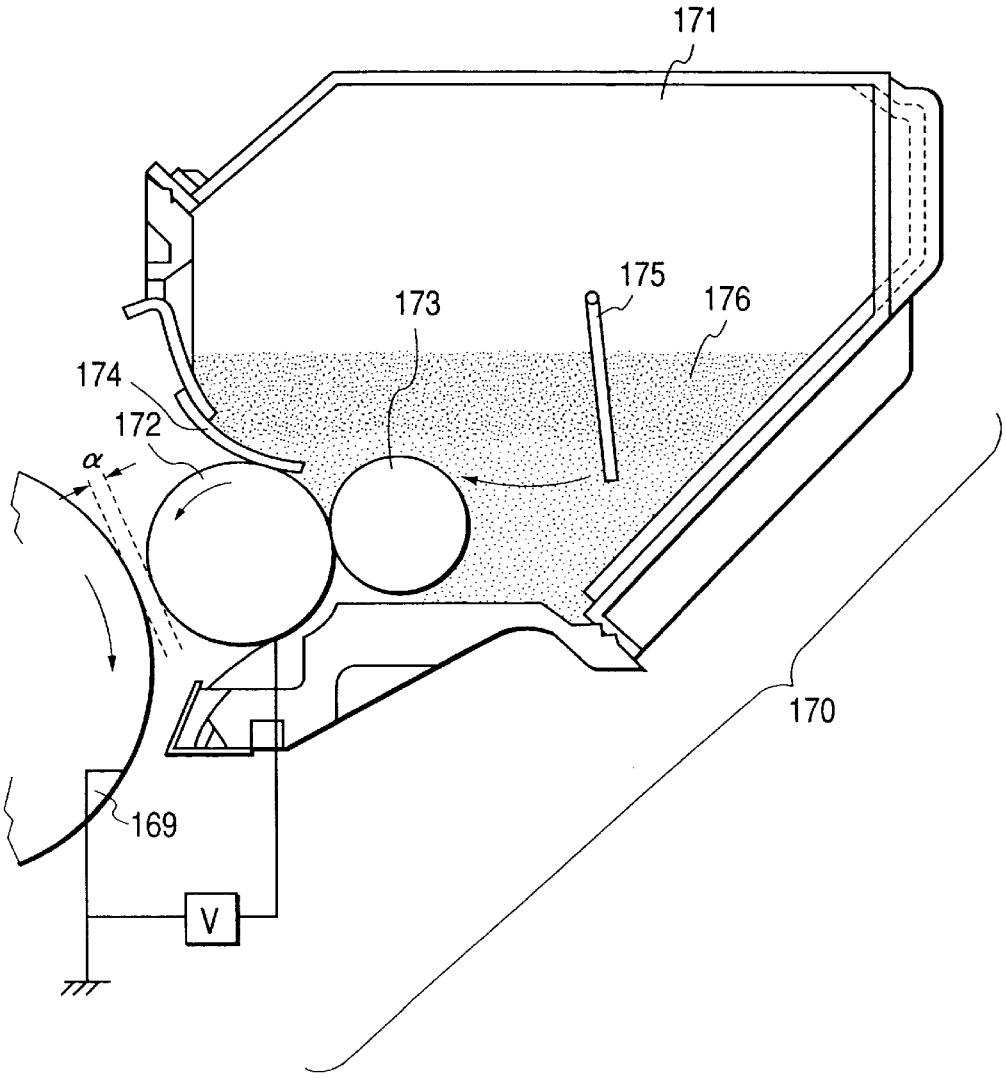
FIG. 6 illustrates a developing apparatus employing a non-magnetic one-component developing system making use of the toner of the present invention.

A developing method making use of a one-component non-magnetic developer having the toner of the present invention will be described with reference to a schematic view of its constitution as shown in FIG. 6.

A developing assembly 170 has a developing container 171 for holding the one-component non-magnetic developer 176 as a non-magnetic toner, a developer carrying member 172 for carrying thereon the one-component non-magnetic developer 176 held in the developing container 171 and for transporting it to the developing zone, a feed roller 173 for feeding the one-component non-magnetic developer onto the the developer carrying member, an elastic blade 174 as a developer layer thickness regulating member for regulating the thickness of a developer layer formed on the developer carrying member, and an agitating member 175 for agitating the one-component non-magnetic developer 176 held in the developing container 171.

Reference numeral 169 denotes a latent image bearing member for holding thereon electrostatic latent images, on which the electrostatic latent images are formed by an electrophotographic processing means or electrostatic recording means (not shown). Reference numeral 172 denotes a developing sleeve serving as the developer carrying member, and is comprised of a non-magnetic sleeve made of aluminum or stainless steel.

The developing sleeve may be prepared using a crude pipe of aluminum or stainless as it is, and may preferably be prepared by spraying glass beads on it to rough the surface uniformly, by mirror-finishing its surface or by coating its surface with a resin. In particular, the method of coating the sleeve surface with a resin may preferably be used because it enables easy adjustment of the surface roughness and conductivity of the sleeve and easy impartation of a lubricity to the sleeve surface by dispersing various particles in the resin.

There are no particular limitations on the resin used to coat the sleeve surface and the various particles added to the resin. As the resin, preferably usable are thermoplastic resins such as styrene resin, vinyl resin, polyether sulfone resin, polycarbonate resin, polyphenylene oxide resin, polyamide resin, fluorine resin, cellulose resin and acrylic resin; and thermo- or photosetting resins such as epoxy resin, polyester resin, alkyd resin, phenol resin, melamine resin, polyurethane resin, urea resin, silicone resin and polyimide resin.

As the various particles added thereto, preferably usable are particles of resins such as PMMA, acrylic resin, polybutadiene resin, polystyrene resin, polyethylene, polypropylene, polybutadiene, or a copolymer of any of these, benzoguanamine resin, phenol resin, polyamide resin, nylon, fluorine resin, silicone resin, epoxy resin and polyester resin; carbon blacks such as furnace black, lamp black, thermal black, acetylene black and channel black; metal oxides such as titanium oxide, tin oxide, zinc oxide, molybdenum oxide, potassium titanate, antimony oxide and indium oxide; metals such as aluminum, copper, silver and nickel; and inorganic fillers such as graphite, metal fiber and carbon fiber.

The one-component non-magnetic developer 176 is reserved in the developing container 171, and is fed onto the developer carrying member 173 by means of a feed roller 173. The feed roller 85 is comprised of a foamed material such as polyurethane foam, and is rotated at a relative speed that is not zero in the fair direction or adverse direction with respect to the developer carrying member so that the developer can be fed onto the developer carrying member and also the developer remaining on the developer carrying member after transfer (the developer not participated in development) can be taken off. The one-component non-magnetic developer fed onto the developer carrying member 172 is coated uniformly and in thin layer by means of the elastic blade 174 as a developer layer thickness regulating member.

It is effective for the elastic coating blade to be brought into touch with the developer carrying member at a pressure of from 0.3 to 25 kg/m, and preferably from 0.5 to 12 kg/cm, as a linear pressure in the generatrix direction of the developer carrying member. If the touch pressure is smaller than 0.3 kg/m, it is difficult to uniformly coat the one-component non-magnetic developer, resulting in a broad charge quantity distribution of the one-component non-magnetic developer to cause fog or black spots around line images. If the touch pressure is greater than 25 kg/m, a great pressure is applied to the one-component non-magnetic developer to cause deterioration of the one-component non-magnetic developer and occurrence of agglomeration of the one-component non-magnetic developer, thus such a pressure is not preferable, and also not preferable because a great torque is required in order to drive the developer carrying member. That is, the adjustment of the touch pressure to 0.3 to 25 kg/m makes it possible to effectively loosen the agglomeration of one-component non-magnetic developer and makes it possible to effect instantaneous rise of the charge quantity of one-component non-magnetic developer.

As the elastic blade, usable are rubber elastic materials such as silicone rubber, urethane rubber and NBR, elastomers such as polyethylene terephthalate and polyamide, and metal elastic members such as stainless steel, steel and phosphor bronze. A composite of some of these may also be used. It may preferably be one comprising a metal sheet of stainless steel or phosphor bronze having a springiness on which a rubber material such as urethane or silicone rubber or an elastomer of various type such as polyamide elastomer is provided by injection molding.

In this one-component non-magnetic development, in the system where the one-component non-magnetic developer is thin-layer coated on the developing sleeve by the blade, the thickness of the one-component non-magnetic developer on the developing sleeve may be made smaller than the gap a at which the developing sleeve and the latent image bearing member face and an alternating electric filed may be applied to this gap. This is preferable in order to obtain a sufficient image density. More specifically, a development bias formed of an alternating electric field or formed by superimposing a DC electric field on an alternating electric field may be applied across the developing sleeve 172 and the latent image bearing member 169. This makes it easy for the one-component non-magnetic developer to move from the surface of the developing sleeve to the surface of the latent image bearing member, thus images with better quality can be obtained.

In the present invention, the gap a between the latent image bearing member and the developer carrying member may preferably be set to be, e.g., from 50 to 500 $\mu$m, and the layer thickness of the developer layer carried on the developer carrying member, e.g., from 4 to 400 $\mu$m.

The developing sleeve is rotated at a peripheral speed of from 100 to 200% with respect to the latent image bearing member. The alternating electric field may preferably be applied at a peak-to-peak voltage of 0.1 kV or above, preferably from 0.2 to 3.0 kV, and more preferably from 0.3 to 2.0 kV. The alternating bias may be applied at a frequency of from 1.0 to 5.0 kHz, preferably from 1.0 to 3.0 kHz, and more preferably from 1.5 to 3.0 kHz. As the waveform of the alternating bias, rectangular waveform, sine waveform, sawtooth waveform and triangle waveform can be used. An asymmetrical AC bias having different time for which forward/backward voltages are applied may also be used. It is also preferable to superimpose a DC bias.

Figure 7:
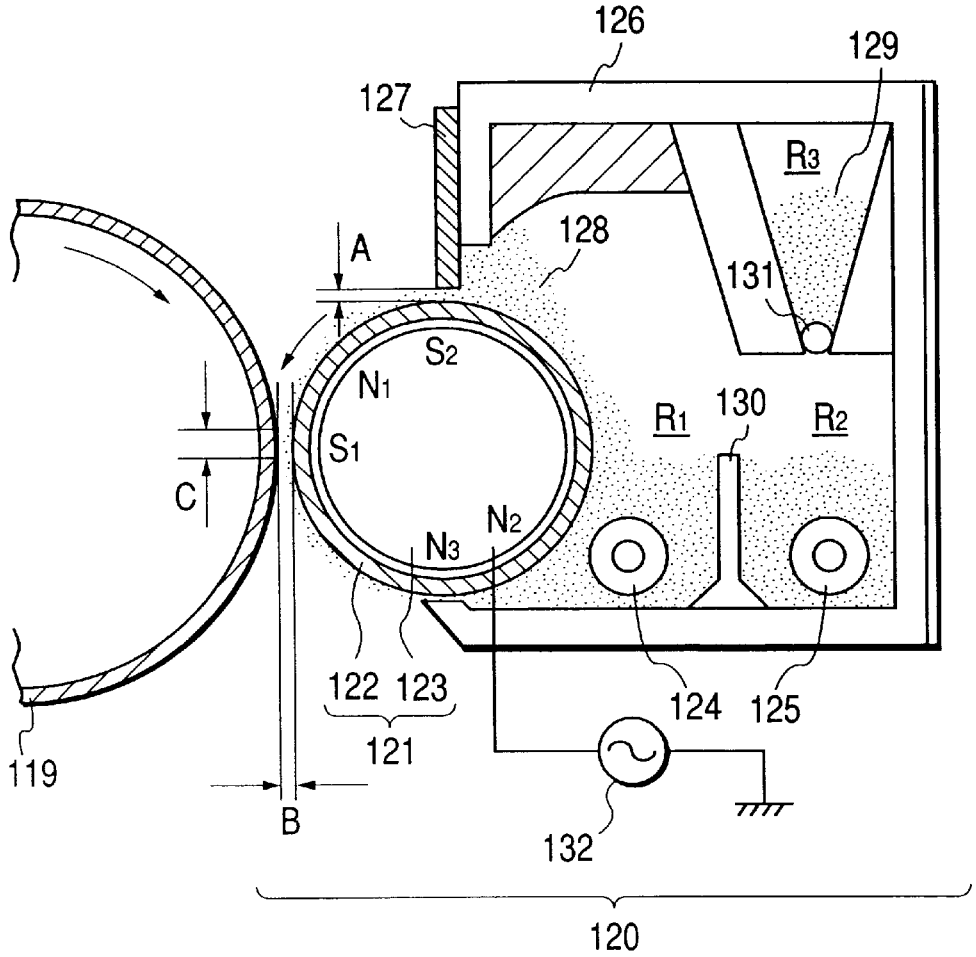
FIG. 7 illustrates a developing apparatus employing a two-component developing system making use of the toner of the present invention.

A developing method making use of a two-component developer constituted of the toner of the present invention and a carrier will be described below with reference to a schematic view of its constitution as shown in FIG. 7.

A developing assembly 120 has a developing container 126 for holding a two-component developer 128, a developing sleeve 121 as a developer carrying member for carrying thereon the two-component developer 128 held in the developing container 126 and for transporting it to the developing zone, and a developing blade 127 as a developer layer thickness regulating means for regulating the layer thickness of a toner layer formed on the developing sleeve 121.

The developing sleeve 121 is provided internally with a magnet 123 in its non-magnetic sleeve substrate 122.

The inside of the developing container 126 is partitioned into a developing chamber (first chamber) Ri and an agitator chamber (second chamber) R2 by a partition wall 130. At the upper part of the agitator chamber R2, a toner storage chamber R3 is formed on the other side of the partition wall 130. The developer 128 is held in the developing chamber R1 and agitator chamber R2, and a replenishing toner (non-magnetic toner) 129 is held in the toner storage chamber R3. The toner storage chamber R3 is provided with a supply opening 131 so that the replenishing toner 129 is supplied dropwise into the agitator chamber R2 though the supply opening 131 in the quantity corresponding to the toner consumed.

A transport screw 124 is provided in the developing chamber R1. As the transport screw 124 is driven rotatingly, the developer 128 held in the developing chamber Ri is transported in the longitudinal direction of the developing sleeve 121. Similarly, a transport screw 125 is provided in the agitator chamber R2 and, as the transport screw 125 is rotated, the toner having dropped from the supply opening 131 into the agitator chamber R2 is transported in the longitudinal direction of the developing sleeve 121.

The developer 128 is a two-component developer comprising a non-magnetic toner and a magnetic carrier.

The developing container 126 is provided with an opening at its part adjacent to a photosensitive drum 119, and the developing sleeve 121 protrudes outward from the opening, where a gap is formed between the developing sleeve 121 and the photosensitive drum 119. The developing sleeve 121, formed of a non-magnetic material, is provided with a bias applying means 132 for applying a bias voltage.

The magnet roller serving as a magnetic field generating means fixed inside the developing sleeve 121, i.e., a magnet 123, has a developing magnetic pole S1, a magnetic pole N3 positioned at its downstream, and magnetic poles N2, S2 and N1 for transporting the developer 128. The magnet 123 is provided inside the sleeve substrate 122 in such a way that the developing magnetic pole S1 faces the photosensitive drum 119. The developing magnetic pole S1 forms a magnetic field in the vicinity of the developing zone defined between the developing sleeve 121 and the photosensitive drum 119, where a magnetic brush is formed by the magnetic field.

The developer-regulating blade 127 provided above the developing sleeve 121 to control the layer thickness of the developer 128 on the developing sleeve 121 is made of a non-magnetic material such as aluminum or SUS 316 stainless steel. The distance A between an end of the non-magnetic blade 127 and the face of the developing sleeve 121 is 300 to 1,000 μm, and preferably 400 to 900 μm. If this distance is smaller than 300 μm, the magnetic carrier may be caught between them to tend to make the developing layer uneven, and also the developer necessary for carrying out good development can not be coated on the sleeve, bringing about the problem that only developed images with a low density and much unevenness can be obtained. In order to prevent uneven coating (what is called the blade clog) due to unauthorized particles included in the developer, the distance may preferably be 400 μm or larger. If it is more than 1,000 μm or larger, the quantity of the developer coated on the developing sleeve 121 increases to enable no desired regulation of the developer layer thickness, bringing about the problems that the magnetic carrier particles adhere to the photosensitive drum 119 in a large quantity and also the circulation of the developer, the formation of the non-magnetic developer layer and the control of the developer by the blade 127 may become ineffective to tend to cause fog because of a shortage of triboelectricity of the toner.

The development by this two-component developing assembly 120 may be carried out while applying an alternating electric field and in such a state that a magnetic brush formed of the toner and the magnetic carrier comes into touch with the latent image bearing member (e,g, a photosensitive drum) 119. Because of the contact of this magnetic brush with the latent image bearing member, the transfer residual toner carried on the latent image bearing member after transfer is taken into the magnetic brush and then collected in the developing chamber R1. The distance, B, between the developer carrying member (developing sleeve) 121 and the photosensitive drum 119 (distance between S-D) may preferably be from 100 to 1,000 μm. This is desirable for preventing carrier adhesion and improving dot reproducibility. If the gap is narrower than 100 μm, the developer tends to be insufficiently fed, resulting in a low image density. If it is larger than 1,000 μm, the magnetic line of force from the magnet S1 may broaden to make the magnetic brush have a low density, resulting in a poor dot reproducibility, or to weaken the force of binding the carrier, tending to cause carrier adhesion.

The alternating electric field may preferably be applied at a peak-to-peak voltage of from 500 to 5,000 V and a frequency of from 500 to 10,000 Hz, and preferably from 500 to 3,000 Hz, which may each be applied under appropriate selection. In this instance, the waveform used may be selected from triangular waveform, rectangular waveform, sinusoidal waveform, or waveform with a varied duty ratio. If the applied voltage is lower than 500 V, a sufficient image density can be attained with difficulty, and fog toner at non-image areas can not be collected well in some cases. If it is higher than 5,000 V, the latent image may be disordered through the magnetic brush to cause a lowering of image quality in some cases.

Use of a two-component developer having a toner well charged enables application of a low fog take-off voltage (Vback), and enables the photosensitive member to be low charged in its primary charging, thus the photosensitive member can be made to have a longer lifetime. The Vback, which may depend on the development system, may preferably be 150 V or below, and more preferably 100 V or below.

As contrast potential, a potential of from 200 V to 500 V may preferably be used so that a sufficient image density can be achieved.

If the frequency is lower than 500 Hz, electric charges may be injected into the carrier, in relation also to the process speed, so that carrier adhesion may occur or latent images may be disordered to cause a lowering of image quality. If it is higher than 10,000 Hz, the toner can not follow up the electric field to tend to cause a lowering of image quality.

In order to carry out development promising a sufficient image density, achieving a superior dot reproducibility and being free of carrier adhesion, the magnetic brush on the developing sleeve 121 may preferably be made to come into touch with the photosensitive drum 119 at a width (developing nip C) of from 3 to 8 mm. If the developing nip C is narrower than 3 mm, it may be difficult to well satisfy sufficient image density and dot reproducibility. If it is broader than 8 mm, the developer may pack into the nip to cause the machine to stop from operating, or it may be difficult to well prevent the carrier adhesion. As methods for adjusting the developing nip, the nip width may appropriately be adjusted by adjusting the distance A between the developer-regulating blade 127 and the developing sleeve 121, or by adjusting the distance B between the developing sleeve 121 and the photosensitive drum 119.

The above developing system making use of the two-component developer can perform cleaning-at-development, in which any cleaning member coming into contact with the surface of the photosensitive drum is not provided between a transfer zone in the transfer step and a charging zone in the charging step and between the charging zone and a developing zone in the developing step, where the transfer residual toner remaining on the photosensitive drum after transfer is collected by the developing apparatus in the developing step.

In such a cleaning-at-development system, the developing zone, transfer zone and charging zone are positioned in this order with respect to the direction of movement of the latent image bearing member, and any cleaning member coming into contact with the surface of the photosensitive drum is not provided between the transfer zone and the charging zone and between the charging zone and the developing zone to remove the transfer residual toner present on the surface of the latent image bearing member.

An image forming method employing the cleaning-at-development system will be described by taking an example of reverse development in which development is performed in the sate the charge polarity of the toner and the charge polarity of the latent image bearing member are in the same polarity in the developing step. When a negatively chargeable photosensitive member and a negatively chargeable toner are used, images rendered visible are transferred to a transfer medium by means of a transfer member with a positive polarity, where the charge polarity of the transfer residual toner varies from positive to negative depending on the relationship between the type (differences in thickness, resistance and dielectric constant) of the transfer medium and the image area. However, the charge polarities can be uniformed to the negative side even if the polarities of not only the photosensitive member surface but also the transfer residual toner have turned positive in the transfer step on account of a charging member with a negative polarity when the negatively chargeable photosensitive member is charged electrostatically. Hence, when the reverse development is employed as a developing method, the transfer residual toner standing charged negatively remains at the toner's light-portion potential areas to be developed. At the toner's dark-portion potential areas not to be developed, the transfer residual toner does not remain, and is attracted toward the developer magnetic brush or the developer carrying member because of its relation to a development electric field, so that no toner remains there.

The apparatus unit of the present invention will be described with reference to FIG. 6.

The apparatus unit of the present invention is mounted detachably to the body of the image forming apparatus (e.g., a copying machine, a laser beam printer or a facsimile machine).

In the embodiment shown in FIG. 6, the apparatus unit is the developing apparatus (assembly) 170, and the developing apparatus is mounted detachably to the body of the image forming apparatus.

Thus, the developing apparatus has the developer 176, the developing container 171, the developer carrying member 172, the feed roller 173, the developer layer thickness regulating member 174 and the agitating member 175. As the apparatus unit of the present invention, it may have at least the developer 176, the developing container 171 and the developer carrying member 172.

The apparatus unit may further have the latent image bearing member, cleaning member or charging member together as one unit.

Figure 11:
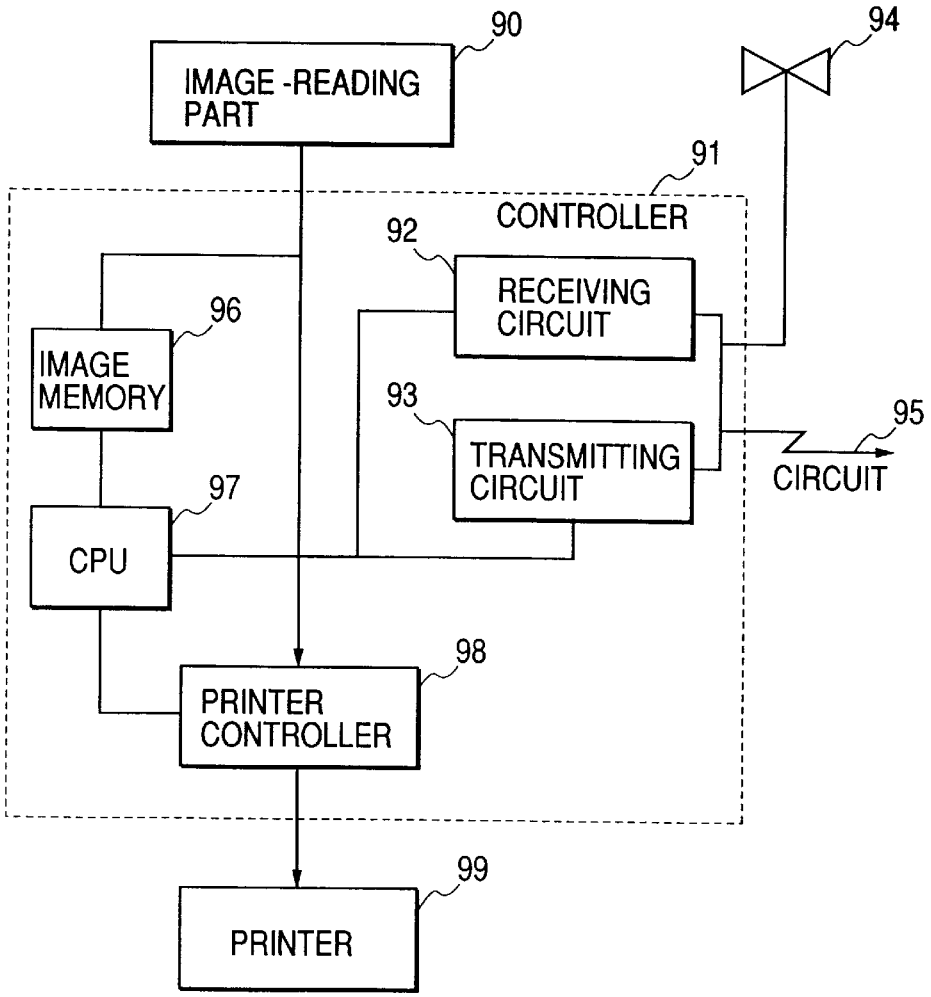
FIG. 11 is a block diagram in the case when the image forming apparatus used in the present invention is applied in a printer of a facsimile system.

When the image forming method of the present invention is applied to a printer of a facsimile machine, the photoimagewise exposing light L serves as exposing light used for the printing of received data. FIG. 11 illustrates an example thereof in the form of a block diagram.

A controller 91 controls an image reading part 90 and a printer 99. The whole of the controller 91 is controlled by CPU 97. Image data outputted from the image reading part are sent to the other facsimile station through a transmitting circuit 93. Data received from the other station is sent to a printer 99 through a receiving circuit 92. Stated image data are stored in an image memory 96. A printer controller 98 controls the printer 99. The numeral 94 denotes a telephone.

Images received from a circuit 95 (image information from a remote terminal connected through the circuit) are demodulated in the receiving circuit 92, and then stored successively in an image memory 96 after the image information is decoded by the CPU 97. Then, once images for at least one page have been stored in the memory 96, the image recording for that page is performed. The CPU 97 reads out the image information for one page from the memory 96 and sends the coded image information for one page to the printer controller 98. The printer controller 98, having received the image information for one page from the CPU 97, controls the printer 99 so that the image information for one page is recorded.

The CPU 97 receives image information for next page in the course of the recording by the printer 99.

Images are received and recorded in the manner as described above.

According to the present invention, fog-free images with superior image-density stability and minute-image reproduction can be obtained without causing deterioration of toner even in its long-term service.

EXAMPLES

The present invention will be described below in greater detail by giving Examples, which, however, by no means limit the present invention.

Example 1

In 700 parts by weight of ion-exchanged water, 450 parts by weight of an aqueous 0.1M $Na_3PO_4$ solution was introduced, followed by heating to 50° C. and then stirring at 10,000 rpm using a TK-type homomixer (manufactured by Tokushu Kika Kogyo Co., Ltd.). To the resultant mixture, 70 parts by weight of an aqueous 1.0M $CaCl_2$ solution was added little by little to obtain an aqueous medium containing a calcium phosphate compound.

| (Monomers) | (by weight) |
|---|---|
| Styrene | 170 parts |
| n-Butyl acrylate | 30 parts |
| (Colorant) | 15 parts |
| C.I. Pigment Blue 15:3 | |
| (Charge control agent) | 2 parts |
| Salicylic acid metal compound | |
| (Polar resin) | 20 parts |
| Saturated polyester resin (acid value: 10; peak molecular weight: 150,000) | |
| (Release agent) | 30 parts |
| Behenyl stearate | |
| (Cross-linking agent) | 0.5 parts |
| Divinylbenzene | |

The above materials were heated to 50° C. and dissolved or dispersed uniformly by means of a TK-type homomixer (manufactured by Tokushu Kika Kogyo Co., Ltd.) at 9,000 rpm. To the mixture obtained, 10 parts by weight of a polymerization initiator 2,2'-azobis(2,4-dimethylvaleronitrile) was dissolved to prepare a polymerizable monomer composition.

The polymerizable monomer composition was introduced in the above aqueous medium, followed by stirring at 50° C. in an atmosphere of nitrogen, using the TK-type homomixer at 8,000 rpm to granulate the polymerizable monomer composition.

Thereafter, the granulated product obtained was stirred with a paddle mixing blade during which the temperature was raised to 60° C. in 2 hours. Four hours after, the temperature was raised to 70° C. at a rate of temperature rise of 40° C./hr, where the reaction was carried out for 5 hours. After the polymerization was completed, residual monomers were evaporated off under reduced pressure, the reaction system was cooled, and thereafter hydrochloric acid was added thereto to dissolve the calcium phosphate, thus a suspension containing cyan toner particles (1-*a*) was obtained.

The average circularity and particle size distribution of the cyan toner particles (1-*a*) thus obtained were measured with a flow type particle image analyzer manufactured by Toa Iyou Denshi K.K. As a result, the particles had an average circularity of 0.970, had a maximum value X at a circle-corresponding diameter of 6.1 $\mu$m and had no maximum value Y in the region of circle-corresponding diameters of from 0.6 $\mu$m to 2.00 $\mu$m. The particles with circle-corresponding diameters of from 0.60 $\mu$m to less than 2.00 $\mu$m were in an amount of 4% by number.

Meanwhile, 7 parts by weight of styrene monomer and 3 parts by weight of potassium persulfate as a water-soluble initiator were added to 500 parts by weight of ion-exchanged water, and the mixture obtained was stirred with a paddle mixing blade during which the temperature was raised to 70° C. to carry out soap-free polymerization for 24 hours. Thus, a suspension containing fine polymer particles (1-*b*) was obtained.

The average circularity and particle size distribution of the fine polymer particles (1-*b*) thus obtained were measured with the flow type particle image analyzer manufactured by Toa Iyou Denshi K.K. As a result, the particles had an average circularity of 0.972 and had a maximum value only at a circle-corresponding diameter of 0.8 μm. The particles with circle-corresponding diameters of from 0.60 μm to less than 2.00 μm were in an amount of 72% by number.

The suspension containing fine polymer particles (1-*b*) in total amount was added to the suspension containing cyan toner particles (1-*a*), and the mixture obtained was stirred with a paddle mixing blade for 2 hours, followed by filtration, water washing and then drying to obtain cyan toner particles (1) with a weight-average particle diameter of 6.5 μm.

To 100 parts by weight of the cyan toner particles (1) thus obtained, 1.0 part of fine silica powder (A-1) having been surface-treated with silicone oil and having a BET specific surface area of 110 $m^2/g$ and 0.5 part of fine silica powder (B-1) having been surface-treated with silicone oil and a silane coupling agent and having a BET specific surface area of 50 $m^2/g$ were added, followed by uniform agitation by means of a Henschel mixer manufactured by Mitsui Mining & Smelting Co., Ltd. to obtain cyan toner (1). This toner was designated as one-component non-magnetic developer (1).

The above fine silica powder (B-1) was a product obtained by surface-treating 100 parts by weight of commercially available fine silica particles NAX50 (available from Nippon Aerosil Co., Ltd.) with 10 parts by weight of dimethylsilicone oil, followed by air classification to collect relatively coarse particles to control their particle size distribution. On a photograph of 100,000 magnifications taken with a transmission electron microscope (TEM) and a photograph of 30,000 magnifications taken with a scanning electron microscope (SEM), this fine silica powder (B-1) was confirmed to be particles formed by coalescence of a plurality of primary particles having an average particle diameter of 40 mμm. The particle shape of the fine silica powder (B-1), confirmed on this magnified photograph, is shown in FIG. 10.

On magnified photographs of the cyan toner (1), the primary particles of the fine silica powder (A-1) present on the toner particles had a shape factor SF-1 (a photograph of 100,000 magnifications) of 117, and the fine silica powder (B-1) also present on the toner particles had a shape factor SF-1 (a photograph of 50,000 magnifications) of 290.

On a photograph of 500,000 magnifications of the cyan toner (1), taken with a scanning electron microscope, the fine silica powder (A-1) was confirmed to have a number-average particle length of 7.35 mμm, a length/breadth ratio of 1.1 and, on a photograph of 100,000 magnifications, to be present in the number of 122 particles per unit area of 0.5 μm×0.5 μm. On a photograph of 50,000 magnifications of the cyan toner (1), taken with a scanning electron microscope, the fine silica powder (B-1) was confirmed to have an average particle particle length of 152 mμm, a length/breadth ratio of 3.2 and to be present in the number of 6 particles per unit area of 1.0 μm×1.0 μm.

On a photograph of 100,000 magnifications of the cyan toner (1), taken with a scanning electron microscope, the primary particles constituting the fine silica powder (B-1) were found to have an average value of Feret's diameter minimum width (average Feret's diameter minimum width) of 42 mμm.

The average circularity and particle size distribution of the cyan toner (1) were measured with the flow type particle image analyzer manufactured by Toa Iyou Denshi K.K. As a result, the toner had an average circularity of 0.970, had a maximum value X at a circle-corresponding diameter of 6.1 μm, had a maximum value Y at a circle-corresponding diameter of 0.8 μm, and contained the particles with circle-corresponding diameters of from 0.60 μm to less than 2.00 μm in an amount of 24% by number.

The developer obtained was put in a modified machine of a commercially available laser beam printer CANON LBP-2030, modified as shown in FIG. 1. Using it, 5,000-sheet running tests were made on the respective evaluation items to make evaluation.

The modified machine of LBP-2030 is constituted as shown in FIG. 1. Using as the developing apparatus the rotary unit 4 in which the black developing assembly 4Bk, the yellow developing assembly 4Y, the magenta developing assembly 4M and, as the cyan developing assembly 4C, the developing assembly 170 of the one-component non-magnetic developing system shown in FIG. 6, making use of the one-component non-magnetic developer, are provided detachably, a multiple toner image formed of the respective color toners having primarily been transferred onto the intermediate transfer drum 5 is secondarily one-time transferred to a recording medium P and thereafter heat-fixed to the recording medium P. The fixing assembly 9 is also modified so as to be constituted in the following way.

As the fixing roller 9*a* of the fixing assembly 9, a roller comprising an aluminum core shaft covered with two types of layers is used. In a lower layer thereof, high-temperature vulcanized silicone rubber (HTV silicone rubber) is used as an elastic layer. The elastic layer is 2.1 mm thick and has a rubber hardness of 3° (JIS-A). In an upper layer, a tetrafluoroethylene-perfluoroalkyl vinyl ether copolymer (PFA) formed in a thin film by spray coating is used as a release layer. The thin film is 20 μm thick.

The pressure roller 9*b* of the fixing assembly 9 has, like the fixing roller 9*a*, a structure wherein a core shaft is covered with a lower-layer silicone rubber elastic layer and an upper-layer fluorine resin release layer, formed of the like materials and having the like thickness and like values of physical properties.

The nip width at the fixing zone is set to be 9.5 mm; the fixing pressure, $2.00\times10^5$ Pa; and the fixing roller surface temperature on standby, 180° C. The fixing oil coating mechanism is detached.

As the intermediate transfer drum 5, used is a drum comprising an aluminum cylinder the surface of which is covered with an elastic layer formed of a mixture of NBR and epichlorohydrin in a thickness of 5 mm.

The cyan developing assembly 4C of the above modified machine of LBP-2030 was supplied with 160 g of the above one-component non-magnetic developer (1). As the recording medium P, commercially available copy sheets CLC Paper A4 (available from CANON SALES INC.; basis weight: 81.4 $g/m^2$) were set in the tray 7, and continuous running tests were made under conditions shown below.

Primary charging conditions:

From a power source (not shown), charging bias voltage formed by superimposing a DC voltage of −600 V and an AC voltage of 1,150 Hz sinusoidal wave in an amplitude of 2 kVpp was applied to the charging roller 2 to charge the insulating material photosensitive drum 1 uniformly while making electric charges move by discharging.

Latent image formation conditions:

The surface of the photosensitive drum 1 charged uniformly was irradiated by laser light L to make exposure to form electrostatic latent images. The intensity of laser light was so set as to provide a surface potential of −200 V at the exposed areas.

Development conditions:

To the developing sleeve of the cyan developing assembly 4C shown in FIG. 1, development bias voltage formed by superimposing a DC voltage of −350 V and an AC voltage of 2,300 Hz sinusoidal wave in an amplitude of 1.8 kVpp was applied to form an alternating electric field at the gap (distance: 300 μm) between the developing sleeve and the photosensitive drum 1, where the toner (toner layer thickness: 170 μm) on the developing sleeve was made to fly to the photosensitive drum 1 to perform development.

Primary transfer conditions:

In order to primarily transfer to the intermediate transfer drum 5 the toner image formed on the photosensitive drum 1 by the developing assembly 4C, a DC voltage of +300 V was applied to the aluminum drum 5*a* as the primary transfer bias voltage.

Secondary transfer conditions:

In order to secondarily transfer to the recording medium P the toner image primarily transferred onto the intermediate transfer drum 5, a DC voltage of +2,000 V was applied to the transfer means 8 as the secondary transfer bias voltage.

Evaluation was made on image density and image density stability of solid images at the initial stage and after running on the prescribed number of sheets, amount of fog on paper at the initial stage, and fine-line reproducibility after running on the prescribed number of sheets, which was made in the following way.

Image density:

A whole-solid image was printed on one sheet, and image densities at 10 spots selected at random from the whole-solid image formed were measured with a reflection densitometer REFLECTOMETER MODEL TC-6DS, manufactured by Tokyo Denshoku Co., Ltd.).

This measurement was made three times to measure image densities at 30 spots in total, and an arithmetic mean of the numerical values obtained was regarded as the density of initial images.

Using the evaluation method described above, the evaluation of image density was made similarly also on images after running on the prescribed number of sheets, i.e., on images obtained when printed on 1,000 sheets, 3,000 sheets and 5,000 sheets.

Image density stability of solid images:

A whole-solid image was printed on one sheet in an environment of temperature 20° C. and humidity 30%, and image densities at 10 spots selected at random from the whole-solid image formed were measured with a reflection densitometer REFLECTOMETER MODEL TC-6DS, manufactured by Tokyo Denshoku Co., Ltd.).

This measurement was made three times to measure image densities at 30 spots in total, and the difference between maximum and minimum values of the numerical values obtained was calculated. The results were ranked in the following way.

a: The difference between maximum and minimum values is not more than 0.2.

b: The difference between maximum and minimum values is more than 0.2 to not more than 0.4.

c: The difference between maximum and minimum values is more than 0.4 to not more than 0.6.

d: The difference between maximum and minimum values is more than 0.6 to not more than 0.8.

e: The difference between maximum and minimum values is more than 0.8.

In the above evaluation, the smaller the difference between maximum and minimum values is, the freer from dimmed images or uneven images in the initial images and the better the images are, having a superior image density stability.

The above evaluation of image density stability of solid images was made similarly also on images after running on the prescribed number of sheets, i.e., on images obtained when printed on 1,000 sheets, 3,000 sheets and 5,000 sheets.

Amount of fog on paper:

Using commercially available copy sheets CLC Paper A4 (available from CANON SALES INC.; basis weight: 81.4 g/m$^2$) as the recording medium, images having solid white image areas were printed thereon. Reflection density at the solid white areas and reflection density before printing were measured with a reflection densitometer REFLECTOMETER MODEL TC-6DS, manufactured by Tokyo Denshoku Co., Ltd.).

Difference between the worst white-background reflection density after print (Ds) and an average value of reflection densities of paper before printing (Dr), Ds−Dr, was regarded as the amount of fog on paper.

Images having the amount of fog on paper that is not more than 2% are good images free of fog on paper, and those of more than 5% are unsharp images having fog on paper conspicuously.

a: The amount of fog on paper is not more than 2% when 5,000-sheet printing is completed.

b: The amount of fog on paper is less than 5% when 3,000-sheet printing is completed, and the amount of fog on paper is 5% or more when 5,000-sheet printing is completed.

c: The amount of fog on paper is less than 5% when 1,000-sheet printing is completed, and the amount of fog on paper is 5% or more when 3,000-sheet printing is completed.

d: The amount of fog on paper is less than 5% when 500-sheet printing is completed, and the amount of fog on paper is 5% or more when 1,000-sheet printing is completed.

e: The amount of fog on paper is 5% or more when 500-sheet printing is completed.

Figure 9:
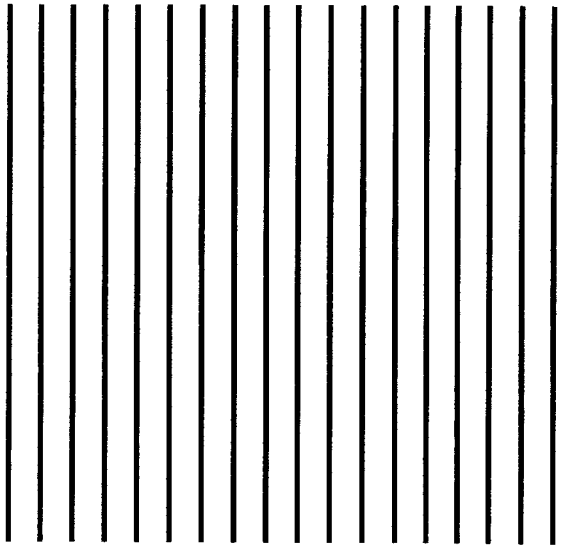
FIG. 9 shows a pattern used to evaluate the reproducibility of minute images.

Fine-line reproducibility:

To evaluate fine-line reproducibility, latent images were formed in stripes as shown in FIG. 9, and evaluation was made on images having been fixed.

Shown in FIG. 9 are latent images having a latent-image area width of 4 dot (170 μm) at a resolution of 600 dpi, and a non-latent-image area width of 10 dot (420 μm).

The latent images in stripes were formed continuously on 1,000 sheets, and fixed images on the 1,000th sheet were used. Five spots were selected from the image areas at random to evaluate the fine-line reproducibility as an absolute value of the difference between an average value of image area widths at 5 spots and the theoretical latent-image area width (170 μm).

a: 0 μm or more to not more than 30 μm.

b: More than 30 μm to not more 6 μm.

c: More than 60 μm to not more 90 μm.

d: More than 90 μm.

The above evaluation was made also on images obtained when printed on 3,000 sheets and 5,000 sheets.

Various physical properties of the toner are shown in Table 2 [2(A)–2(B)], and the results of evaluation in Table 4.

Example 2

Cyan toner (2) having various physical properties as shown in Table 2 was obtained in the same manner as in Example 1 except that 0.5 part by weight of the fine silica powder (B-1) used therein was replaced with 0.4 part by weight of fine silica powder (B-2) having not been surface-treated and having a BET specific surface area of 81 $m^2/g$. This toner was designated as one-component non-magnetic developer (2).

Using this one-component non-magnetic developer (2), evaluation was made in the same manner as in Example 1.

The results of evaluation are shown in Table 4.

Example 3

Cyan toner (3) having various physical properties as shown in Table 2 was obtained in the same manner as in Example 1 except that 1.0 part by weight of the fine silica powder (A-1) and 0.5 part by weight of the fine silica powder (B-1) which were used therein were replaced with 1.0 part by weight of fine alumina powder (A-2) having been surface-treated with silicone oil and having a BET specific surface area of 145 $m^2/g$ and 0.6 part by weight of fine silica powder (B-3) having been surface-treated with silicone oil and having a BET specific surface area of 70 $m^2/g$, respectively. This toner was designated as one-component non-magnetic developer (3).

Using this one-component non-magnetic developer (3), evaluation was made in the same manner as in Example 1.

The results of evaluation are shown in Table 4.

Example 4

Cyan toner (4) having various physical properties as shown in Table 2 was obtained in the same manner as in Example 1 except that 0.5 part by weight of the fine silica powder (B-1) used therein was replaced with 0.6 part by weight of fine silica powder (B-4) having been surface-treated with hexamethyldisilazane and dimethylsilicone oil in this order and having a BET specific surface area of 73 $m^2/g$. This toner was designated as one-component non-magnetic developer (4).

Using this one-component non-magnetic developer (4), evaluation was made in the same manner as in Example 1.

The results of evaluation are shown in Table 4.

Example 5

Cyan toner (5) having various physical properties as shown in Table 2 was obtained in the same manner as in Example 1 except that 1.0 part by weight of the fine silica powder (A-1) and 0.5 part by weight of the fine silica powder (B-1) which were used therein were replaced with 0.8 part by weight of fine silica powder (A-3) having not been surface-treated and having a BET specific surface area of 141 $m^2/g$ and 0.6 part by weight of fine silica powder (B-5) having been surface-treated with hexamethyldisilazane and dimethylsilicone oil in this order and having a BET specific surface area of 60 $m^2/g$, respectively. This toner was designated as one-component non-magnetic developer (5).

Using this one-component non-magnetic developer (5), evaluation was made in the same manner as in Example 1.

The results of evaluation are shown in Table 4.

Example 6

Cyan toner (6) having various physical properties as shown in Table 2 was obtained in the same manner as in Example 1 except that 0.5 part by weight of the fine silica powder (B-1) used therein was replaced with 0.6 part by weight of fine titanium oxide powder (B-6) having not been surface-treated and having a BET specific surface area of 86 $m^2/g$. This toner was designated as one-component non-magnetic developer (6).

Using this one-component non-magnetic developer (6), evaluation was made in the same manner as in Example 1.

The results of evaluation are shown in Table 4.

Example 7

Cyan toner (7) having various physical properties as shown in Table 2 was obtained in the same manner as in Example 1 except that 1.0 part by weight of the fine silica powder (A-1) and 0.5 part by weight of the fine silica powder (B-1) which were used therein were replaced with 1.3 parts by weight of the fine silica powder (A-1) and 0.6 part by weight of fine silica powder (B-7) having been surface-treated with silicone oil and having a BET specific surface area of 60 $m^2/g$, respectively. This toner was designated as one-component non-magnetic developer (7).

Using this one-component non-magnetic developer (7), evaluation was made in the same manner as in Example 1.

The results of evaluation are shown in Table 4.

Example 8

Cyan toner (8) having various physical properties as shown in Table 2 was obtained in the same manner as in Example 1 except that 1.0 part by weight of the fine silica powder (A-1) and 0.5 part by weight of the fine silica powder (B-1) which were used therein were replaced with 4.0 parts by weight of the fine silica powder (A-1) and 0.5 part by weight of the fine silica powder (B-1), respectively. This toner was designated as one-component non-magnetic developer (8).

Using this one-component non-magnetic developer (8), evaluation was made in the same manner as in Example 1.

The results of evaluation are shown in Table 4.

Example 9

Cyan toner (9) having various physical properties as shown in Table 2 was obtained in the same manner as in Example 1 except that 1.0 part by weight of the fine silica powder (A-1) and 0.5 part by weight of the fine silica powder (B-1) which were used therein were replaced with 0.7 part by weight of the fine silica powder (A-1) and 3.6 parts by weight of the fine silica powder (B-1), respectively. This toner was designated as one-component non-magnetic developer (9).

Using this one-component non-magnetic developer (9), evaluation was made in the same manner as in Example 1.

The results of evaluation are shown in Table 4.

Example 10

Cyan toner (10) having various physical properties as shown in Table 2 was obtained in the same manner as in Example 1 except that 1.0 part by weight of the fine silica powder (A-1) and 0.5 part by weight of the fine silica powder (B-1) which were used therein were replaced with 2.4 parts by weight of the fine silica powder (A-1) and 1.7 parts by weight of the fine silica powder (B-1), respectively. This toner was designated as one-component non-magnetic developer (10).

Using this one-component non-magnetic developer (10), evaluation was made in the same manner as in Example 1.

The results of evaluation are shown in Table 4.

Example 11

In 700 parts by weight of ion-exchanged water, 450 parts by weight of an aqueous 0.1M $Na_3PO_4$ solution was introduced, followed by heating to 50° C. and then stirring at 10,000 rpm using a TK-type homomixer (manufactured by Tokushu Kika Kogyo Co., Ltd.). To the resultant mixture, 70 parts by weight of an aqueous 1.0M $CaCl_2$ solution was added little by little to obtain an aqueous medium containing a calcium phosphate compound.

| (Monomers) | (by weight) |
|---|---|
| Styrene | 175 parts |
| n-Butyl acrylate | 25 parts |
| (Colorant) | 15 parts |
| C.I. Pigment Blue 15:3 | |
| (Charge control agent) | 3 parts |
| BONTORON E-84 (available from Orient Chemical Industries Ltd.) | |
| (Polar resin) | 20 parts |
| Saturated polyester resin (acid value: 10; peak molecular weight: 150,000) | |
| (Release agent) | 30 parts |
| Behenyl stearate | |
| (Cross-linking agent) | 1.5 parts |
| Divinylbenzene | |

The above materials were heated to 50° C. and dissolved or dispersed uniformly by means of a TK-type homomixer (manufactured by Tokushu Kika Kogyo Co., Ltd.) at 9,000 rpm. To the mixture obtained, 5 parts by weight of a polymerization initiator 2,2'-azobis(2,4-dimethylvaleronitrile) was dissolved to prepare a polymerizable monomer composition.

The polymerizable monomer composition was introduced in the above aqueous medium, followed by stirring at 50° C. in an atmosphere of nitrogen, using the TK-type homomixer at 8,500 rpm to granulate the polymerizable monomer composition.

Thereafter, the granulated product obtained was stirred with a paddle mixing blade during which the temperature was raised to 60° C. in 2 hours. Four hours after, the temperature was raised to 70° C. at a rate of temperature rise of 40° C./hr, where the reaction was carried out for 5 hours. After the polymerization was completed, residual monomers were evaporated off under reduced pressure, the reaction system was cooled, and thereafter hydrochloric acid was added thereto to dissolve the calcium phosphate, followed by filtration, water washing and then drying to obtain cyan toner particles (2-*a*) with a weight-average particle diameter of 6.5 μm.

The average circularity and particle size distribution of the cyan toner particles (2-*a*) thus obtained were measured with a flow type particle image analyzer manufactured by Toa Iyou Denshi K.K. As a result, the particles had an average circularity of 0.973, had a maximum value X at a circle-corresponding diameter of 1.0 μm, had a maximum value Y at a circle-corresponding diameter of 6.9 μm, and contained the particles with circle-corresponding diameters of from 0.60 μm to less than 2.00 μm in an amount of 41% by number.

The cyan toner particles (2-*a*) was air-classified to remove relatively fine particles, thus cyan toner particles (2) were obtained.

To 100 parts by weight of the cyan toner particles (2) thus obtained, 1.0 part of the fine silica powder (A-1) and 0.5 part of the fine silica powder (B-1) were added in the same manner as in Example 1, followed by uniform agitation by means of a Henschel mixer manufactured by Mitsui Mining & Smelting Co., Ltd. to obtain cyan toner (11) having various physical properties as shown in Table 2. This toner was designated as one-component non-magnetic developer (11).

The average circularity and particle size distribution of the cyan toner (11) were measured with the flow type particle image analyzer manufactured by Toa Iyou Denshi K.K. As a result, the toner had an average circularity of 0.970, had a maximum value X at a circle-corresponding diameter of 1.0 μm, had a maximum value Y at a circle-corresponding diameter of 6.5 μm, and contained the particles with circle-corresponding diameters of from 0.60 μm to less than 2.00 μm in an amount of 18% by number.

Using this one-component non-magnetic developer (11), evaluation was made in the same manner as in Example 1.

The results of evaluation are shown in Table 4.

Comparative Example 1

Into a four-necked flask, 180 parts by weight of nitrogen-displaced water and 20 parts by weight of an aqueous 0.2% by weight polyvinyl alcohol solution were introduced, and thereafter 75 parts by weight of styrene, 25 parts by weight of n-butyl acrylate, 3.0 parts by weight of benzoyl peroxide and 0.01 part by weight of divinylbenzene were added, followed by stirring to make a suspension. Then, after the inside of the flask was displaced with nitrogen, the temperature was raised to 80° C. to carry out polymerization reaction while maintaining the system at that temperature for 10 hours.

After the polymer obtained was washed with water, it was dried in an environment of reduced pressure while keeping the temperature at 65° C., thus a resin was obtained. Then, 88 parts by weight of the resin thus obtained, 4 parts by weight of a metal-containing azo dye, 12 parts by weight of C.I. Pigment Blue 15:3 and 10 parts by weight of paraffin wax were mixed by means of a fixed-tank dry-process mixing machine whose vent port was connected to a suction pump, where the mixture obtained was melt-kneaded in a twin-screw extruder while being sucked through the vent port.

The melt-kneaded product obtained was crushed by means of a hammer mill to obtain a 1 mm mesh-pass crushed product of a toner composition. This crushed product was further pulverized by means of a mechanical pulverizer into a product with volume-average particle diameter of 20 to 30 μm, and thereafter pulverized by means of a jet mill which utilized interparticle collision in a cyclonic stream, followed by modification of the toner composition in a surface-modifying machine by the action of thermal and mechanical shear force, and then classification by means of a multi-division classifier to obtain cyan toner particles (3) with a weight-average particle diameter of 7.0 μm.

To 100 parts by weight of the cyan toner particles (3) thus obtained, 1.0 part of the fine silica powder (A-1) and 0.5 part of the fine silica powder (B-1) were added in the same manner as in Example 1, followed by uniform agitation by means of a Henschel mixer manufactured by Mitsui Mining & Smelting Co., Ltd. to obtain cyan toner (12) having various physical properties as shown in Table 3 [3(A)–3(B)]. This toner was designated as one-component non-magnetic developer (12).

Using this one-component non-magnetic developer (12), evaluation was made in the same manner as in Example 1.

The results of evaluation are shown in Table 4.

Comparative Example 2

Cyan toner (13) having various physical properties as shown in Table 3 was obtained in the same manner as in Example 1 except that 1.0 part by weight of the fine silica powder (A-1) and 0.5 part by weight of the fine silica powder (B-1) which were used therein were replaced with 0.8 part by weight of the fine silica powder (B-1) only. This toner was designated as one-component non-magnetic developer (13).

Using this one-component non-magnetic developer (13), evaluation was made in the same manner as in Example 1.

The results of evaluation are shown in Table 4.

Comparative Example 3

Cyan toner (14) having various physical properties as shown in Table 3 was obtained in the same manner as in Example 1 except that 1.0 part by weight of the fine silica powder (A-1) and 0.5 part by weight of the fine silica powder (B-1) which were used therein were replaced with 1.4 part by weight of the fine silica powder (A-1) only. This toner was designated as one-component non-magnetic developer (14).

Using this one-component non-magnetic developer (14), evaluation was made in the same manner as in Example 1.

The results of evaluation are shown in Table 4.

Comparative Example 4

Cyan toner (15) having various physical properties as shown in Table 3 was obtained in the same manner as in Example 1 except that 0.5 part by weight of the fine silica powder (B-1) used therein was replaced with 0.5 part by weight of fine silica powder (B-10) having been surface-treated with hexamethyldisilazane and dimethylsilicone oil in this order and having a BET specific surface area of 38 $m^2/g$. This toner was designated as one-component non-magnetic developer (15).

Using this one-component non-magnetic developer (15), evaluation was made in the same manner as in Example 1.

The results of evaluation are shown in Table 4.

Comparative Example 5

Cyan toner (16) having various physical properties as shown in Table 3 was obtained in the same manner as in Example 1 except that neither the fine silica powder (A-1) nor the fine silica powder (B-1) which were used therein was used and the cyan toner particles (1) were used as they were. This toner was designated as one-component non-magnetic developer (16).

Using this one-component non-magnetic developer (16), evaluation was made in the same manner as in Example 1. As a result, the in-machine scatter of the toner occurred conspicuously, and also very poor results were obtained in all the evaluation items of image density, image density stability of solid images, amount of fog on paper and fine-line reproducibility at the initial stage and after running on 1,000 sheets. Accordingly, the evaluation was stopped when printed on 1,000 sheets.

The results of evaluation are shown in Table 4.

Comparative Example 6

Cyan toner particles (4) were obtained in the same manner as in Example 1 except that, in the conditions for producing therein the cyan toner particles (1), only the suspension containing the cyan toner particles (1-*a*) was processed by filtration, water washing and drying, without use of the suspension containing the cyan toner particles (1-*b*).

To 100 parts by weight of the cyan toner particles (4) thus obtained, 1.0 part of the fine silica powder (A-1) and 0.5 part of the fine silica powder (B-1) were added in the same manner as in Example 1, followed by uniform agitation by means of a Henschel mixer manufactured by Mitsui Mining & Smelting Co., Ltd. to obtain cyan toner (17) having various physical properties as shown in Table 3. This toner was designated. as one-component non-magnetic developer (17).

Using this one-component non-magnetic developer (17), evaluation was made in the same manner as in Example 1.

The results of evaluation are shown in Table 4.

Comparative Example 7

| (Monomers) | (by weight) |
|---|---|
| Styrene monomer | 7 parts |
| Divinylbenzene | 0.2 part |
| (Initiator) | 4 parts |
| Potassium persulfate | |

The above materials were added in 500 parts by weight of ion-exchanged water, and the mixture obtained was stirred with a paddle mixing blade during which the temperature was raised to 72° C. to carry out soap-free polymerization for 72 hours. Thus, a suspension containing fine polymer particles (5-*b*) was obtained.

The average circularity and particle size distribution of the fine polymer particles (5-*b*) were measured with a flow type particle image analyzer manufactured by Toa Iyou Denshi K.K. As a result, the particles had an average circularity of 0.972, had a maximum value only at a circle-corresponding diameter of 2.6 $\mu$m, and contained the particles with circle-corresponding diameters of from 0.60 $\mu$m to less than 2.00 $\mu$m in an amount of 37% by number.

Cyan toner particles (5) were obtained in the same manner as in Example 1 except that the fine polymer particles (1-*b*) used therein were replaced with the fine polymer particles (5-*b*), which were added in the suspension containing the cyan toner particles (1-*a*).

To 100 parts by weight of the cyan toner particles (5) thus obtained, 1.0 part of the fine silica powder (A-1) and 0.5 part of the fine silica powder (B-1) were added in the same manner as in Example 1, followed by uniform agitation by means of a Henschel mixer manufactured by Mitsui Mining & Smelting Co., Ltd. to obtain cyan toner (18) having various physical properties as shown in Table 3. This toner was designated as one-component non-magnetic developer (18).

Using this one-component non-magnetic developer (18), evaluation was made in the same manner as in Example 1.

The results of evaluation are shown in Table 4.

Comparative Example 8

Cyan toner (19) having various physical properties as shown in Table 3 was obtained in the same manner as in Example 1 except that 0.5 part by weight of the fine silica powder (B-1) used therein was replaced with 0.5 part by weight of fine silica powder (B-8) obtained under classification conditions so changed as to collect relatively fine particles to control its particle size distribution and having a BET specific surface area of 110 $m^2/g$. This toner was designated as one-component non-magnetic developer (19).

Using this one-component non-magnetic developer (19), evaluation was made in the same manner as in Example 1.

The results of evaluation are shown in Table 4.

Comparative Example 9

Cyan toner (20) having various physical properties as shown in Table 3 was obtained in the same manner as in Example 1 except that 0.5 part by weight of the fine silica powder (B-1) used therein was replaced with 0.5 part by weight of fine silica powder (B-9) obtained under classification conditions so changed that the operation of classification was repeated so as to be able to collect only coarser particles to control its particle size distribution and having a BET specific surface area of 22 $m^2/g$. This toner was designated as one-component non-magnetic developer (20).

Using this one-component non-magnetic developer (20), evaluation was made in the same manner as in Example 1.

The results of evaluation are shown in Table 4.

TABLE 2

| Toner | Toner | | | | |
|---|---|---|---|---|---|
| | | Particle size distribution | | | |
| Toner | Average circularity | Maximum value X (μm) | Maximum value Y (μm) | Content of particles with circle-corresponding diameters of 0.60 to <2.00 μm (% by number) | Toner particles Toner particles No. |
| Cyan toner: | | | | | |
| (1) | 0.970 | 6.1 | 0.8 | 24 | Cyan toner particles (1) |
| (2) | 0.970 | 6.1 | 0.9 | 23 | Cyan toner particles (1) |
| (3) | 0.969 | 6.0 | 0.8 | 28 | Cyan toner particles (1) |
| (4) | 0.970 | 6.0 | 0.9 | 18 | Cyan toner particles (1) |
| (5) | 0.967 | 6.1 | 0.9 | 25 | Cyan toner particles (1) |
| (6) | 0.975 | 6.1 | 0.9 | 29 | Cyan toner particles (1) |
| (7) | 0.977 | 6.1 | 0.9 | 38 | Cyan toner particles (l) |
| (8) | 0.975 | 6.1 | 0.8 | 22 | Cyan toner particles (1) |
| (9) | 0.978 | 6.1 | 0.8 | 26 | Cyan toner particles (1) |
| (10) | 0.971 | 6.1 | 0.9 | 26 | Cyan toner particles (1) |
| (11) | 0.970 | 6.5 | 1.0 | 18 | Cyan toner particles (2) |
| Magenta toner: | | | | | |
| (21) | 0.968 | 6.3 | 0.9 | 24 | Magenta toner particles (6) |
| Yellow toner: | | | | | |
| (22) | 0.972 | 6.2 | 0.9 | 22 | Yellow toner particles (7) |
| Black toner: | | | | | |
| (23) | 0.970 | 6.0 | 0.9 | 23 | Black toner particles (8) |

| External additives | | | | | | | | | | | | | | | |
|---|---|---|---|---|---|---|---|---|---|---|---|---|---|---|---|
| | Inorganic fine powder (A) | | | | | | | Inorganic fine powder (B) | | | | | | | |
| | | | | Physical properties of external additive*1 | | | | | | | Physical properties of external additive*1 | | | | |
| | Type | Content (pbw) | BET specific surface area ($m^2/g$) | Shape factor SF-1 | L/B | Average length (mμm) | (N) | Type | Content (pbw) | BET specific surface area ($m^2/g$) | Shape factor SF-1 | L/B | Average length (mμm) | (N') | (F) |
| Cyan toner: | | | | | | | | | | | | | | | |
| (1) | FS A-1 | 1.0 | 110 | 117 | 1.1 | 7.4 | 122 | FS B-1 | 0.5 | 50 | 290 | 3.2 | 152 | 6 | 42 |
| (2) | FS A-1 | 1.0 | 110 | 115 | 1.1 | 7.4 | 119 | FS B-2 | 0.4 | 81 | 209 | 3.8 | 412 | 7 | 38 |
| (3) | FA A-2 | 1.0 | 145 | 123 | 1.4 | 17.5 | 61 | FS B-3 | 0.6 | 70 | 281 | 3.3 | 246 | 7 | 41 |
| (4) | FS A-1 | 1.0 | 110 | 121 | 1.1 | 7.4 | 98 | FS B-4 | 0.6 | 73 | 221 | 2.3 | 70 | 12 | 27 |
| (5) | FS A-3 | 0.8 | 141 | 119 | 1.2 | 6.6 | 131 | FS B-5 | 0.6 | 60 | 250 | 3.1 | 197 | 15 | 51 |
| (6) | FS A-1 | 1.0 | 110 | 117 | 1.1 | 7.4 | 125 | FT B-6 | 0.6 | 86 | 236 | 2.9 | 46 | 4 | 28 |
| (7) | FS A-1 | 1.3 | 110 | 120 | 1.1 | 7.4 | 210 | FS B-7 | 0.6 | 38 | 202 | 2.1 | 271 | 9 | 60 |
| (8) | FS A-1 | 4.0 | 110 | 122 | 1.1 | 7.4 | 310 | FS B-1 | 0.5 | 50 | 286 | 3.2 | 152 | 7 | 40 |
| (9) | FS A-1 | 0.7 | 110 | 128 | 1.1 | 7.4 | 84 | FS B-1 | 3.6 | 50 | 278 | 3.2 | 152 | 21 | 41 |
| (10) | FS A-1 | 2.4 | 110 | 120 | 1.1 | 7.4 | 267 | FS B-1 | 1.7 | 50 | 311 | 3.2 | 152 | 19 | 44 |
| (11) | FS A-1 | 1.0 | 110 | 119 | 1.1 | 7.3 | 121 | FS B-1 | 0.5 | 50 | 292 | 3.2 | 156 | 8 | 43 |
| Magenta toner: | | | | | | | | | | | | | | | |
| (21) | FS A-1 | 1.0 | 110 | 116 | 1.1 | 7.4 | 126 | FS B-1 | 0.5 | 50 | 291 | 3.2 | 152 | 8 | 43 |
| Yellow toner: | | | | | | | | | | | | | | | |
| (22) | FS A-1 | 1.0 | 110 | 113 | 1.1 | 7.4 | 118 | FS B-1 | 0.5 | 50 | 268 | 3.2 | 154 | 11 | 39 |

TABLE 2-continued

| | | | | | | | | | | | | | | | |
|---|---|---|---|---|---|---|---|---|---|---|---|---|---|---|---|
| Black toner: | | | | | | | | | | | | | | | |
| (23) | FS A-1 | 1.0 | 110 | 116 | 1.1 | 7.4 | 121 | FS B-1 | 0.5 | 50 | 279 | 3.2 | 154 | 9 | 41 |

*1: present on toner particles in SEM magnified photograph of toner;

L/B: Length/breadth ratio;

(N): Number of particles per 0.5 × 0.5 mm unit area;

(N'): Number of particles per 1.0 × 1.0 mm unit area;

(F): Average Feret's diameter minimum value of primary particles constituting coalesced particles;

FS: Fine silica powder;

FA; Fine alumina powder;

FT: Fine titanium powder

TABLE 3

| | Toner | | | | | |
|---|---|---|---|---|---|---|
| | | Particle size distribution | | | | |
| Toner | Average circularity | Maximum value X (μm) | Maximum value Y (μm) | Content of particles with circle-corresponding diameters of 0.60 to <2.00 μm (% by number) | Toner particles Toner particles No. | |
| Cyan toner: | | | | | | |
| (12) | 0.935 | 6.0 | 1.2 | 45 | Cyan toner particles (3) | |
| (13) | 0.965 | 6.0 | 0.8 | 26 | Cyan toner particles (1) | |
| (14) | 0.968 | 6.1 | 0.8 | 20 | Cyan toner particles (1) | |
| (15) | 0.964 | 6.5 | 0.9 | 28 | Cyan toner particles (1) | |
| (16) | 0.970 | 6.0 | 0.9 | 24 | Cyan toner particles (1) | |
| (17) | 0.970 | 6.1 | — | 4 | Cyan toner particles (4) | |
| (18) | 0.968 | 6.5 | 2.6 | 11 | Cyan toner particles (5) | |
| (19) | 0.971 | 6.1 | 0.9 | 23 | Cyan toner particles (1) | |
| (20) | 0.970 | 6.1 | 0.9 | 26 | Cyan toner particles (1) | |

| | External additives | | | | | | | | | | | | | | |
|---|---|---|---|---|---|---|---|---|---|---|---|---|---|---|---|
| | Inorganic fine powder (A) | | | | | | | Inorganic fine powder (B) | | | | | | | |
| | | | | Physical properties of external additive*1 | | | | | | | Physical properties of external additive*1 | | | | |
| | Type | Content (pbw) | BET specific surface area ($m^2/g$) | Shape factor SF-1 | L/B | Average length (mμm) | (N) | Type | Content (pbw) | BET specific surface area ($m^2/g$) | Shape factor SF-1 | L/B | Average length (mμm) | (N') | (F) |
| Cyan toner: | | | | | | | | | | | | | | | |
| (12) | FS A-1 | 1.0 | 110 | 120 | 1.1 | 7.4 | 126 | FS B-1 | 0.5 | 50 | 288 | 3.2 | 152 | 9 | 41 |
| (13) | — | — | — | — | — | — | — | FS B-1 | 0.8 | 50 | 271 | 3.2 | 152 | 11 | 43 |
| (14) | FS A-1 | 1.4 | 110 | 120 | 1.1 | 7.4 | 211 | — | — | — | — | — | — | — | — |
| (15) | FS A-1 | 1.0 | 110 | 118 | 1.1 | 7.4 | 131 | FS B-10 | 0.5 | 38 | 138 | 1.3 | 200 | 9 | 41 |
| (16) | — | — | — | — | — | — | — | — | — | — | — | — | — | — | — |
| (17) | FS A-1 | 1.0 | 110 | 130 | 1.1 | 7.4 | 130 | FS B-1 | 0.5 | 50 | 273 | 3.2 | 152 | 6 | 44 |
| (18) | FS A-1 | 1.0 | 110 | 123 | 1.1 | 7.4 | 129 | FS B-1 | 0.5 | 50 | 281 | 3.2 | 152 | 12 | 45 |
| (19) | FS A-1 | 1.0 | 110 | 114 | 1.1 | 7.4 | 118 | FS B-1 | 0.5 | 110 | 261 | 3.2 | 152 | 80 | 27 |
| (20) | FS A-1 | 1.0 | 110 | 120 | 1.1 | 7.4 | 121 | FS B-1 | 0.5 | 22 | 287 | 3.2 | 152 | 2 | 266 |

*1: present on toner particles in SEM magnified photograph of toner;

L/B: Length/breadth ratio;

(N): Number of particles per 0.5 × 0.5 mm unit area;

(N'): Number of particles per 1.0 × 1.0 mm unit area;

(F): Average Feret's diameter minimum value of primary particles constituting coalesced particles;

FS: Fine silica powder

TABLE 4

| | | Image density | | | | Solid image density stability | | | | | Fine-line reproducibility | | |
|---|---|---|---|---|---|---|---|---|---|---|---|---|---|
| | Cyan toner | Initial stage | 1,000 sheets | 3,000 sheets | 5,000 sheets | Initial stage | 1,000 sheets | 3,000 sheets | 5,000 sheets | Fog on paper | 1,000 sheets | 3,000 sheets | 5,000 sheets |
| Example: | | | | | | | | | | | | | |
| 1 | (1) | 1.50 | 1.50 | 1.50 | 1.50 | a | a | a | a | a | a | a | a |
| 2 | (2) | 1.50 | 1.50 | 1.49 | 1.49 | a | a | b | b | b | a | a | b |
| 3 | (3) | 1.50 | 1.48 | 1.50 | 1.49 | a | a | a | b | a | a | a | b |
| 4 | (4) | 1.50 | 1.49 | 1.50 | 1.47 | a | a | b | b | b | a | b | b |
| 5 | (5) | 1.50 | 1.50 | 1.50 | 1.46 | a | a | a | b | b | a | a | b |
| 6 | (6) | 1.50 | 1.47 | 1.49 | 1.48 | a | a | b | b | b | a | a | b |
| 7 | (7) | 1.50 | 1.49 | 1.49 | 1.47 | a | b | b | b | b | a | b | b |
| 8 | (8) | 1.51 | 1.49 | 1.48 | 1.47 | a | b | b | b | b | a | a | b |
| 9 | (9) | 1.50 | 1.51 | 1.47 | 1.48 | a | b | b | b | b | a | b | b |
| 10 | (10) | 1.50 | 1.50 | 1.47 | 1.49 | a | a | b | b | b | b | b | b |
| 11 | (11) | 1.50 | 1.50 | 1.50 | 1.50 | a | a | a | a | a | a | a | a |
| Comparative Example: | | | | | | | | | | | | | |
| 1 | (12) | 1.50 | 1.50 | 1.48 | 1.50 | b | b | c | c | c | a | c | c |
| 2 | (13) | 1.50 | 1.45 | 1.40 | 1.40 | b | d | d | e | e | a | c | d |
| 3 | (14) | 1.51 | 1.50 | 1.45 | 1.37 | a | d | d | e | b | a | b | c |
| 4 | (15) | 1.48 | 1.46 | 1.47 | 1.39 | a | c | d | d | c | a | b | b |
| 5 | (16) | 1.38 | 1.27 | Stop | Stop | e | e | Stop | Stop | e | d | Stop | Stop |
| 6 | (17) | 1.49 | 1.50 | 1.50 | 1.49 | c | b | b | b | b | a | b | c |
| 7 | (18) | 1.50 | 1.48 | 1.46 | 1.45 | c | c | c | d | b | b | b | c |
| 8 | (19) | 1.51 | 1.48 | 1.44 | 1.36 | a | d | e | e | b | b | c | c |
| 9 | (20) | 1.47 | 1.29 | 1.35 | 1.33 | b | d | d | d | c | c | c | d |

(1): Amount of fog on paper

Example 12

Magenta toner particles (6), yellow toner particles (7) and black toner particles (8) were produced in the same manner as in Example 1 except that C.I. Pigment Blue 15:3 used therein was replaced with 11 parts by weight of C.I. Pigment Red 122, 14 parts by weight of C.I. Pigment Yellow 17 and 10 parts by weight of carbon black, respectively.

To 100 parts by weight of the magenta toner particles (6), yellow toner particles (7) and black toner particles (8) thus obtained, 1.0 part of the fine silica powder (A-1) and 0.5 part of the fine silica powder (B-1) were added respectively in the same manner as in Example 1, followed by uniform agitation by means of a Henschel mixer manufactured by Mitsui Mining & Smelting Co., Ltd. to obtain magenta toner (21), yellow toner (22) and black toner (23) having various physical properties as shown in Table 2. These toners were designated as one-component non-magnetic developers (21), (22) and (23), respectively.

Using the same modified machine of LBP-2030 as that used in Example 1, the cyan developing assembly 4C, magenta developing assembly 4M, yellow developing assembly 4Y and black developing assembly 4Bk were supplied with 160 g of the one-component non-magnetic developer (1) used in Example 1, 160 g of the one-component non-magnetic developers (21), 160 g of the one-component non-magnetic developers (22) and 160 g of the one-component non-magnetic developers (23), respectively.

Images were formed under conditions shown below.

Primary charging conditions:

From a power source (not shown in FIG. 1), charging bias voltage formed by superimposing a DC voltage of −600 V and an AC voltage of 1,150 Hz sinusoidal wave in an amplitude of 2 kVpp was applied to the charging roller 2 to charge the insulating material photosensitive drum 1 uniformly while making electric charges move by discharging.

Latent image formation conditions:

The surface of the photosensitive drum 1 charged uniformly was irradiated by laser light L to make exposure to form electrostatic latent images. The intensity of laser light was so set as to provide a surface potential of −200 V at the exposed areas.

The electrostatic latent images were developed in the color order of yellow, magenta, cyan and black, the respective color toner images were primarily transferred successively onto the intermediate transfer drum, the four-color multiple toner image primarily transferred onto the intermediate transfer drum was secondarily one-time transferred to the recording medium, and the four-color multiple toner image was heat-fixed to the recording medium to form a full-color image.

Development conditions:

To the developing sleeves of the respective cyan developing assembly 4C, magenta developing assembly 4M, yellow developing assembly 4M and black developing assembly 4Bk shown in FIG. 1, development bias formed by superimposing a DC voltage of −350 V and an AC voltage of 2,300 Hz sinusoidal wave in an amplitude of 1.8 kVpp was applied to form an alternating electric field at the gap (distance: 300 $\mu$m) between each developing sleeve and the photosensitive drum 1, where the toner (toner layer thickness: 170 $\mu$m) on each developing sleeve was made to fly to the photosensitive drum 1 to perform development.

Primary transfer conditions:

In order to primarily transfer to the intermediate transfer drum 5 the toner image formed by development with the developing assembly 4Y, a DC voltage of +100 V was applied to the aluminum drum 5*a* as the primary transfer bias voltage. In order to primarily transfer to the intermediate transfer drum 5 the toner image formed by development with the developing assembly 4M, a DC voltage of +200 V was applied to the aluminum drum 5*a* as the primary transfer bias voltage. In order to primarily transfer to the intermediate transfer drum 5 the toner image formed by development with the developing assembly 4C, a DC voltage of +300 V was applied to the aluminum drum 5*a* as the primary transfer bias voltage. In order to primarily transfer to the intermediate transfer drum 5 the toner image formed by development with the developing assembly 4Bk, a DC voltage of +400 V was applied to the aluminum drum 5*a* as the primary transfer bias voltage.

Secondary transfer conditions:

In order to secondarily transfer to the recording medium P the four-color full color toner image primarily transferred onto the intermediate transfer drum 5, a DC voltage of +2,000 V was applied to the transfer means 8 as the secondary transfer bias voltage.

As the result, even in 5,000-sheet running, good results were obtained on image density of fixed images, prevention of fog on paper and fine-line reproducibility, and full-color images with a superior color-tone reproduction were stably obtainable.

Example 13

Figure 2:
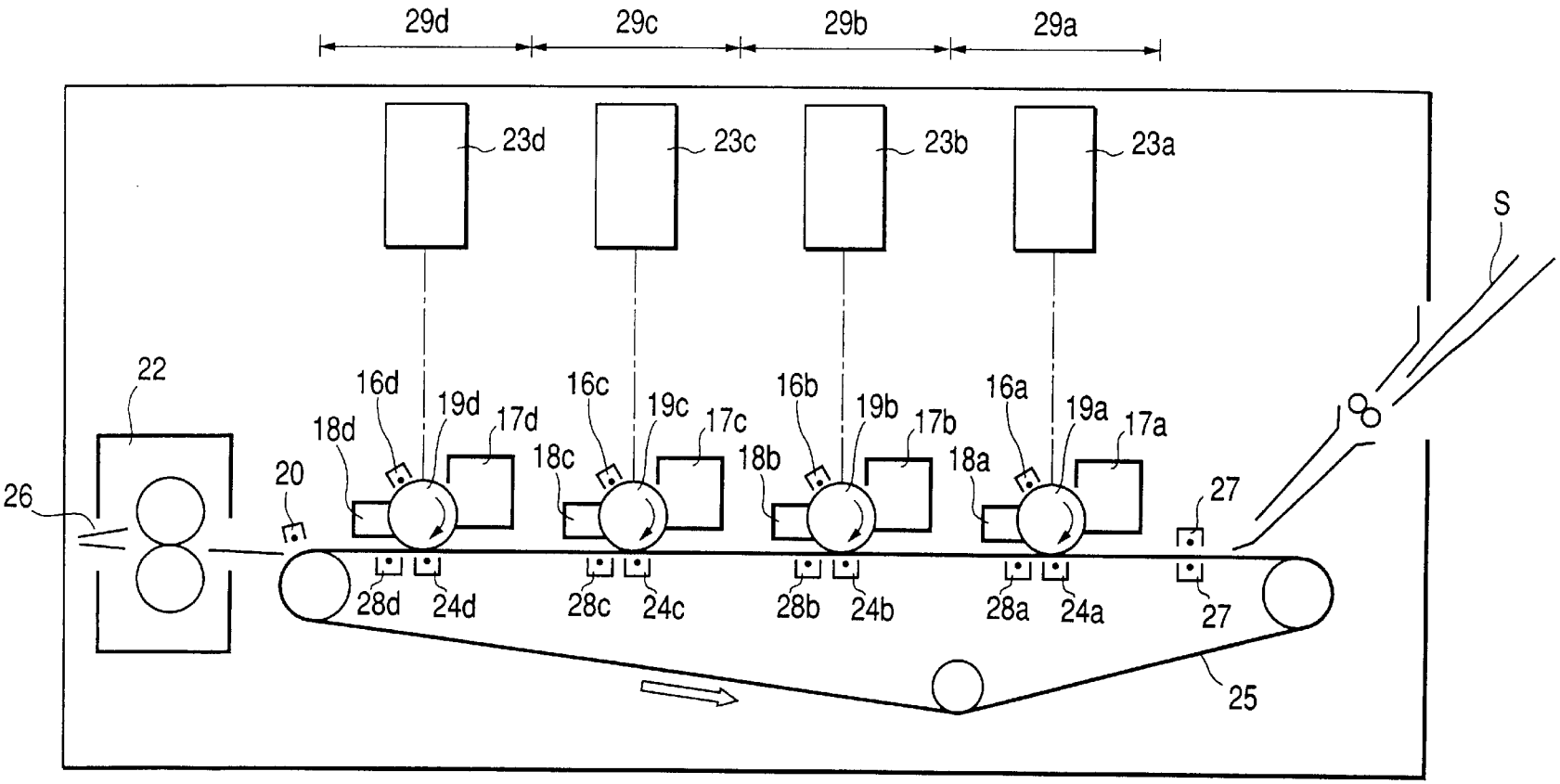
FIG. 2 illustrates another image forming apparatus that can carry out an image forming method making use of the toner of the present invention.

Full-color images were formed by means of a full-color image forming apparatus in which the developing assembly 170 of a one-component non-magnetic development system as shown in FIG. 6, making use of the one-component non-magnetic developer, was used in each of the developing sections 17*a*, 17*b*, 17*c* and 17*d* of the image forming apparatus shown in FIG. 2, and by the use of the one-component non-magnetic developer (1) produced in Example 1 and the one-component non-magnetic developers (21), (22) and (23) produced in Example 12, respectively.

The developing assembly of the developing section 17*a* was supplied with the one-component non-magnetic developer (21), the developing assembly of the developing section 17*b* with the one-component non-magnetic developer (1), the developing assembly of the developing section 17*c* with the one-component non-magnetic developer (22), and the developing assembly of the developing section 17*d* with the one-component non-magnetic developer (23). The development of electrostatic latent images and transfer to the recording medium as a transfer medium were performed in the color order of black, cyan, magenta and yellow under conditions shown below to form a four-color multiple toner image on the recording medium, followed by heat-fixing to form a full-color image on the recording medium.

Electrostatic latent images formed on photosensitive members: −150 V

Development bias voltage:

DC component: −300 V

AC component: 2,000 Hz, amplitude of 2 kVpp

Distance between photosensitive drum and developing sleeve: 300 μm

Developer layer thickness on developing sleeve: 170 μm

Transfer bias voltage:

Transfer section 24*a*: +100 V

Transfer section 24*b*: +170 V

Transfer section 24*c*: +240 V

Transfer section 24*d*: +310 V

As the result, even in 20,000-sheet running over a long term, good results were obtained on image density of fixed images, prevention of fog on paper and fine-line reproducibility, and full-color images with a superior color-tone reproduction were stably obtainable.

Example 14

Full-color images were formed by means of a full-color image forming apparatus in which the developing assembly 170 of a one-component non-magnetic development system as shown in FIG. 6, making use of the one-component non-magnetic developer, was used in each of the developing assemblies 244-1, 244-2, 244-3 and 244-4 of the image forming apparatus shown in FIG. 5, and by the use of the one-component non-magnetic developer (1) produced in Example 1 and the one-component non-magnetic developers (21), (22) and (23) produced in Example 12, respectively.

The developing assembly 244-1 was supplied with the one-component non-magnetic developer (23), the developing assembly 244-2 with the one-component non-magnetic developer (21), the developing assembly 244-3 with the one-component non-magnetic developer (1), and the developing assembly 244-4 with the one-component non-magnetic developer (22). The development was performed in the color order of black, magenta, cyan and yellow, the respective color toner images were transferred successively onto the intermediate transfer drum, and the four-color multiple toner image transferred onto the intermediate transfer drum was one-time transferred to the recording medium, followed by heat-fixing to form a full-color image on the recording medium.

Intermediate transfer drum:

Conductive material: aluminum

Elastic layer: styrene-butadiene rubber, 5 mm thick

Primary charging conditions:

DC component: −600 V

AC component: 2,000 Hz, amplitude of 1.8 kVpp

Electrostatic latent images formed on photosensitive members: −250 V

Development bias voltage:

DC component: −400 V

AC component: 2,000 Hz, amplitude of 1.8 kVpp

Distance between photosensitive drum and developing sleeve: 300 μm

Developer layer thickness on developing sleeve: 170 μm

Primary transfer conditions:

DC voltage: +100 V

DC voltage: +150 V

DC voltage: +200 V

DC voltage: +250 V

Secondary transfer conditions:

DC voltage: +2,000 V

As the result, even in 15,000-sheet running over a long term, good results were obtained on image density of fixed images, prevention of fog on paper and fine-line reproducibility, and full-color images with a superior color-tone reproduction were stably obtainable.

What is claimed is:

1. A toner comprising toner particles containing at least a binder resin and a colorant, and an external additive fine powder, wherein;

in circularity distribution of particles and in particle size distribution on the basis of circle-corresponding diameter, measured with a flow type particle image analyzer, said toner has an average circularity of from 0.950 to 0.995, and contains particles with circle-corresponding diameters of from 0.60 μm to less than 2.00 μm, having a maximum value X in the region of circle-corresponding diameters of from 3.0 μm to 9.0 μm and having a maximum value Y in the region of circle-corresponding diameters of from 0.6 μm to 2.00 μm, in an amount of from 8.0% by number to 30.0% by number; and said external additive fine powder has, on the toner particles, at least an inorganic fine powder (A) having as primary particles a number-average particle length of from 1 mμm to less than 30 mμm and a non-spherical inorganic fine powder (B) formed by coalescence of a plurality of primary particles having an average value of Feret's diameter minimum width of from 30 mμm to 200 mμm and having a shape factor SF-1 greater than 150 and a number-average particle length of from 30 mμm to 600 mμm.

2. The toner according to claim 1, wherein, in circularity distribution of particles measured with the flow type particle image analyzer, said toner has an average circularity of from 0.960 to 0.995.

3. The toner according to claim 1, wherein said inorganic fine powder (A) has, on the toner particles, a number-average particle length of from 1 mμm to 25 mμm as primary particles.

4. The toner according to claim 1, wherein said inorganic fine powder (A) has, on the toner particles, a ratio of particle length to particle breadth, length/breadth ratio, of from 1.0 to 1.5.

5. The toner according to claim 1, wherein said non-spherical inorganic fine powder (B) has, on the toner particles, a number-average particle length of from 30 mμm to 300 mμm.

6. The toner according to claim 1, wherein said inorganic fine powder (A) has a specific surface area of from 50 $m^2/g$ to 150 $m^2/g$ as measured by nitrogen adsorption according to the BET method.

7. The toner according to claim 1, wherein said non-spherical inorganic fine powder (B) has a specific surface area of from 20 $m^2/g$ to 90 $m^2/g$ as measured by nitrogen adsorption according to the BET method.

8. The toner according to claim 1, wherein said inorganic fine powder (A) has, on the toner particles, a shape factor SF-1 of from 100 to 125.

9. The toner according to claim 1, wherein said non-spherical inorganic fine powder (B) has, on the toner particles, a shape factor SF-1 greater than 190.

10. The toner according to claim 1, wherein said non-spherical inorganic fine powder (B) has, on the toner particles, a shape factor SF-1 greater than 200.

11. The toner according to claim 1, wherein, on the toner particles, said inorganic fine powder (A) comprises primary particles present individually or in an aggregated state;

the primary particles of said inorganic fine powder (A) being present on the toner particle surfaces in a number of at least 20 particles in total on the average per unit area of 0.5 μm×0.5 μm, and said non-spherical inorganic fine powder (B) being present on the toner particle surfaces in a number of from 1 to 20 particles on the average per unit area of 1.0 μm×1.0 μm, as viewed on an electron microscope magnified photograph of the toner.

12. The toner according to claim 1, wherein, on the toner particles, said inorganic fine powder (A) comprises primary particles present individually or in an aggregated state;

the primary particles of said inorganic fine powder (A) being present on the toner particle surfaces in a number of at least 25 particles in total on the average per unit area of 0.5 μm×0.5 μm, and said non-spherical inorganic fine powder (B) being present on the toner particle surfaces in a number of from 2 to 18 particles on the average per unit area of 1.0 μm×1.0 μm, as viewed on an electron microscope magnified photograph of the toner.

13. The toner according to claim 1, which contains said inorganic fine powder (A) in an amount of form 0.1 part by weight to 3.0 parts by weight based on 100 parts by weight of the toner.

14. The toner according to claim 1, which contains said non-spherical inorganic fine powder (B) in an amount of form 0.1 part by weight to 3.0 parts by weight based on 100 parts by weight of the toner.

15. The toner according to claim 1, wherein said inorganic fine powder (A) and said non-spherical inorganic fine powder (B) each have particles selected from the group consisting of silica, alumina, titania and a double oxide of any of these.

16. The toner according to claim 1, wherein said inorganic fine powder (A) and said non-spherical inorganic fine powder (B) each have fine silica powder.

17. The toner according to claim 1, wherein said inorganic fine powder (A) and said non-spherical inorganic fine powder (B) each have silicone oil.

18. The toner according to claim 1, wherein said toner particles are particles produced by polymerization in which a polymerizable monomer composition containing at least a polymerizable monomer and the colorant is polymerized in a liquid medium in the presence of a polymerization initiator.

19. The toner according to claim 1, wherein said toner particles are particles produced by suspension polymerization in which a polymerizable monomer composition containing at least a polymerizable monomer and the colorant is polymerized in an aqueous medium in the presence of a polymerization initiator.

20. The toner according to claim 1, which is a non-magnetic toner.

21. The toner according to claim 1, which is used as a one-component developer.

22. The toner according to claim 1, which is a non-magnetic toner, and the non-magnetic toner is used as a one-component developer.

23. A two-component developer comprising (I) a toner having at least toner particles containing at least a binder resin and a colorant, and an external additive fine powder, and (II) a carrier, wherein;

in circularity distribution of particles and in particle size distribution on the basis of circle-corresponding diameter, measured with a flow type particle image analyzer, said toner has an average circularity of from 0.950 to 0.995, and contains particles with circle-corresponding diameters of from 0.60 μm to less than 2.00 μm, having a maximum value X in the region of circle-corresponding diameters of from 3.0 μm to 9.0 μm and having a maximum value Y in the region of circle-corresponding diameters of from 0.6 μm to 2.00 μm , in an amount of from 8.0% by number to 30.0% by number; and said external additive fine powder has, on the toner particles, at least an inorganic fine powder (A) having as primary particles a number-average particle length of from 1 mμm to less than 30 mμm and a non-spherical inorganic fine powder (B) formed by coalescence of a plurality of primary particles having an average value of Feret'diameter minimum width of from 30 mμm to 200 mμm and having a shape factor SF-1 greater than 150 and a number-average particle length of from 30 mμm to 600 mμm.

24. The developer according to claim 23, wherein, in circularity distribution of particles measured with the flow type particle image analyzer, said toner has an average circularity of from 0.960 to 0.995.

25. The developer according to claim 23, wherein said inorganic fine powder (A) has, on the toner particles, a number-average particle length of from 1 mμm to 25 mμm as primary particles.

26. The developer according to claim 23, wherein said inorganic fine powder (A) has, on the toner particles, a ratio of particle length to particle breadth, length/breadth ratio, of from 1.0 to 1.5.

27. The developer according to claim 23, wherein said non-spherical inorganic fine powder (B) has, on the toner particles, a number-average particle length of from 30 mm to 300 mμm.

28. The developer according to claim 23, wherein said inorganic fine powder (A) has a specific surface area of from 50 $m^2/g$ to 150 $m^2/g$ as measured by nitrogen adsorption according to the BET method.

29. The developer according to claim 23, wherein said non-spherical inorganic fine powder (B) has a specific surface area of from 20 $m^2/g$ to 90 $m^2/g$ as measured by nitrogen adsorption according to the BET method.

30. The developer according to claim 23, wherein said inorganic fine powder (A) has, on the toner particles, a shape factor SF-1 of from 100 to 125.

31. The developer according to claim 23, wherein said non-spherical inorganic fine powder (B) has, on the toner particles, a shape factor SF-1 greater than 190.

32. The developer according to claim 23, wherein said non-spherical inorganic fine powder (B) has, on the toner particles, a shape factor SF-1 greater than 200.

33. The developer according to claim 23, wherein, on the toner particles, said inorganic fine powder (A) comprises primary particles present individually or in an aggregated state;

the primary particles of said inorganic fine powder (A) being present on the toner particle surfaces in a number of at least 20 particles in total on the average per unit area of 0.5 μm×0.5 μm, and said non-spherical inorganic fine powder (B) being present on the toner particle surfaces in a number of from 1 to 20 particles on the average per unit area of 1.0 μm×1.0 μm, as viewed on an electron microscope magnified photograph of the toner.

34. The developer according to claim 23, wherein, on the toner particles, said inorganic fine powder (A) comprises primary particles present individually or in an aggregated state;

the primary particles of said inorganic fine powder (A) being present on the toner particle surfaces in a number of at least 25 particles in total on the average per unit area of 0.5 μm×0.5 μm, and said non-spherical inorganic fine powder (B) being present on the toner particle surfaces in a number of from 2 to 18 particles on the average per unit area of 1.0 μm×1.0 μm, as viewed on an electron microscope magnified photograph of the toner.

35. The developer according to claim 23, wherein said toner contains said inorganic fine powder (A) in an amount of form 0.1 part by weight to 3.0 parts by weight based on 100 parts by weight of the toner.

36. The developer according to claim 23, wherein said toner contains said non-spherical inorganic fine powder (B) in an amount of form 0.1 part by weight to 3.0 parts by weight based on 100 parts by weight of the toner.

37. The developer according to claim 23, wherein said inorganic fine powder (A) and said non-spherical inorganic fine powder (B) each have particles selected from the group consisting of silica, alumina, titania and a double oxide of any of these.

38. The developer according to claim 23, wherein said inorganic fine powder (A) and said non-spherical inorganic fine powder (B) each have fine silica powder.

39. The developer according to claim 23, wherein said inorganic fine powder (A) and said non-spherical inorganic fine powder (B) each have silicone oil.

40. The developer according to claim 23, wherein said toner particles are particles produced by polymerization in which a polymerizable monomer composition containing at least a polymerizable monomer and the colorant is polymerized in a liquid medium in the presence of a polymerization initiator.

41. The developer according to claim 23, wherein said toner particles are particles produced by suspension polymerization in which a polymerizable monomer composition containing at least a polymerizable monomer and the colorant is polymerized in an aqueous medium in the presence of a polymerization initiator.

42. The developer according to claim 23, wherein said toner is a non-magnetic toner.

43. An image forming method comprising;

(I) a charging step of charging electrostatically a latent image bearing member on which an electrostatic latent image is to be held;

(II) a latent image forming step of forming the electrostatic latent image on the latent image bearing member thus charged;

(III) a developing step of developing the electrostatic latent image on the latent image bearing member by the use of a toner to form a toner image; and (IV) a transfer step of transferring to a transfer medium the toner image formed on the latent image bearing member;

wherein;

said toner has at least toner particles containing at least a binder resin and a colorant, and an external additive fine powder;

in circularity distribution of particles and in particle size distribution on the basis of circle-corresponding diameter, measured with a flow type particle image analyzer, said toner has an average circularity of from 0.950 to 0.995, and contains particles with circle-corresponding diameters of from 0.60 μm to less than 2.00 μm, having a maximum value X in the region of circle-corresponding diameters of from 3.0 μm to 9.0 μm and having a maximum value Y in the region of circle-corresponding diameters of from 0.6 μm to 2.00 μm, in an amount of from 8.0% by number to 30.0% by number; and said external additive fine powder has, on the toner particles, at least an inorganic fine powder (A) having as primary particles a number-average particle length of from 1 mμm to to less than 30 mμm and a non-spherical inorganic fine powder (B) formed by coalescence of a plurality of primary particles having an average value of Feret's diameter minimum width of from 30 mμm to 200 mμm and and having a shape factor SF-1 greater than 150 and a number-average particle length of from 30 mμm to 600 mμm.

44. The method according to claim 43, wherein, in circularity distribution of particles measured with the flow type particle image analyzer, said toner has an average circularity of from 0.960 to 0.995.

45. The method according to claim 43, wherein said inorganic fine powder (A) has, on the toner particles, a number-average particle length of from 1 mμm to 25 mμm as primary particles.

46. The method according to claim 43, wherein said inorganic fine powder (A) has, on the toner particles, a ratio of particle length to particle breadth, length/breadth ratio, of from 1.0 to 1.5.

47. The method according to claim 43, wherein said non-spherical inorganic fine powder (B) has, on the toner particles, a number-average particle length of from 30 mm to 300 mμm.

48. The method according to claim 43, wherein said inorganic fine powder (A) has a specific surface area of from 50 $m^2/g$ to 150 $m^2/g$ as measured by nitrogen adsorption according to the BET method.

49. The method according to claim 43, wherein said non-spherical inorganic fine powder (B) has a specific surface area of from 20 $m^2/g$ to 90 $m^2/g$ as measured by nitrogen adsorption according to the BET method.

50. The method according to claim 43, wherein said inorganic fine powder (A) has, on the toner particles, a shape factor SF-1 of from 100 to 125.

51. The method according to claim 43, wherein said non-spherical inorganic fine powder (B) has, on the toner particles, a shape factor SF-1 greater than 190.

52. The method according to claim 43, wherein said non-spherical inorganic fine powder (B) has, on the toner particles, a shape factor SF-1 greater than 200.

53. The method according to claim 43, wherein, on the toner particles, said inorganic fine powder (A) comprises primary particles present individually or in an aggregated state;

the primary particles of said inorganic fine powder (A) being present on the toner particle surfaces in a number of at least 20 particles in total on the average per unit area of 0.5 μm×0.5 μm, and said non-spherical inorganic fine powder (B) being present on the toner particle surfaces in a number of from 1 to 20 particles on the average per unit area of 1.0 μm×1.0 μm, as viewed on an electron microscope magnified photograph of the toner.

54. The method according to claim 43, wherein, on the toner particles, said inorganic fine powder (A) comprises primary particles present individually or in an aggregated state;

the primary particles of said inorganic fine powder (A) being present on the toner particle surfaces in a number of at least 25 particles in total on the average per unit area of 0.5 μm×0.5 μm, and said non-spherical inorganic fine powder (B) being present on the toner particle surfaces in a number of from 2 to 18 particles on the average per unit area of 1.0 μm×1.0 μm, as viewed on an electron microscope magnified photograph of the toner.

55. The method according to claim 43, wherein said toner contains said inorganic fine powder (A) in an amount of form 0.1 part by weight to 3.0 parts by weight based on 100 parts by weight of the toner.

56. The method according to claim 43, wherein said toner contains said non-spherical inorganic fine powder (B) in an amount of form 0.1 part by weight to 3.0 parts by weight based on 100 parts by weight of the toner.

57. The method according to claim 43, wherein said inorganic fine powder (A) and said non-spherical inorganic fine powder (B) each have particles selected from the group consisting of silica, alumina, titania and a double oxide of any of these.

58. The method according to claim 43, wherein said inorganic fine powder (A) and said non-spherical inorganic fine powder (B) each have fine silica powder.

59. The method according to claim 43, wherein said inorganic fine powder (A) and said non-spherical inorganic fine powder (B) each have silicone oil.

60. The method according to claim 43, wherein said toner particles are particles produced by polymerization in which a polymerizable monomer composition containing at least a polymerizable monomer and the colorant is polymerized in a liquid medium in the presence of a polymerization initiator.

61. The method according to claim 43, wherein said toner particles are particles produced by suspension polymerization in which a polymerizable monomer composition containing at least a polymerizable monomer and the colorant is polymerized in an aqueous medium in the presence of a polymerization initiator.

62. The method according to claim 43, wherein said toner is a non-magnetic toner.

63. The method according to claim 43, wherein said toner is used as a one-component developer.

64. The toner according to claim 1, wherein said toner is a non-magnetic toner, and the non-magnetic toner is used as a one-component developer.

65. The toner according to claim 1, wherein said toner is a non-magnetic toner, and the non-magnetic toner is blended with a carrier, and is used as a two-component developer.

66. The image forming method according to claim 43, wherein said transfer medium is a recording medium, where the toner image formed on the latent image bearing member is transferred directly to the recording medium, and the toner image transferred to the recording medium is fixed to the recording medium.

67. The image forming method according to claim 43, wherein said transfer medium comprises an intermediate transfer member, where the toner image formed on the latent image bearing member is primarily transferred to the intermediate transfer member, the toner image primarily transferred to the intermediate transfer member is secondarily transferred to a recording medium, and the toner image secondarily transferred to the recording medium is fixed to the recording medium.

68. The image forming method according to claim 43, which is a color image forming method comprising;

(i) a charging step of charging electrostatically a latent image bearing member on which an electrostatic latent image is to be held;

(ii) a latent image forming step of forming the electrostatic latent image on the latent image bearing member thus charged;

(iii) a developing step of developing the electrostatic latent image on the latent image bearing member by the use of a color toner to form a color toner image; said color toner being selected from the group consisting of a cyan toner, a magenta toner and a yellow toner; and (iv) a transfer step of transferring to a transfer medium the color toner image formed on the latent image bearing member;

said steps (i) to (iv) being carried out successively at least twice by the use of color toners each having a different color, to form a multiple color toner image on the transfer medium;

wherein;

the cyan toner has said toner and comprises i) cyan toner particles as said toner particles, containing at least a binder resin and a cyan colorant, and ii) said external additive fine powder;

the magenta toner has said toner and comprises i) magenta toner particles as said toner particles, containing at least a binder resin and a magenta colorant, and ii) said external additive fine powder; and the yellow toner has said toner and comprises i) yellow toner particles as said toner particles, containing at least a binder resin and a yellow colorant, and ii) said external additive fine powder.

69. The image forming method according to claim 68, which is a full-color image forming method wherein, using four color toners comprising said cyan toner, said magenta toner, said yellow toner and, in addition thereto, a black toner, said steps (i) to (iv) are carried out successively four times by the use of the color toners having the respective colors, to form a four-color color toner image on the transfer medium;

said black toner having said toner and comprising i) black toner particles as said toner particles, containing at least a binder resin and a black colorant, and ii) said external additive fine powder.

70. The image forming method according to claim 43, which further comprises a cleaning step of collecting the toner remaining of the surface of the latent image bearing member after said transfer step.

71. The image forming method according to claim 70, wherein said cleaning step employs a cleaning-before-development system in which the latent image bearing member surface is cleaned by means of a cleaning member coming into touch with the latent image bearing member.

72. The image forming method according to claim 71, wherein said cleaning step in the cleaning-before-development system is carried out after the transfer step and before the charging step.

73. The image forming method according to claim 70, wherein;

a transfer zone in said transfer step, a charging zone in said charging step and a developing zone in said developing step are positioned in the order of the transfer zone, the charging zone and the developing zone with respect to the surface movement direction of the latent image bearing member, and any cleaning member for removing the toner remaining on the surface of the latent image bearing member is not present between the transfer zone and the charging zone and between the charging zone and the developing zone in contact with the surface of the latent image bearing member; and said cleaning step employs a cleaning-at-development system in which, at the time of the developing step, a developing assembly holding said toner therein develops the electrostatic latent image held on the latent image bearing member and the developing assembly simultaneously collects the toner remaining on the surface of the latent image bearing member to clean the surface of the latent image bearing member.

74. An apparatus unit detachably mountable on a main assembly of an image forming apparatus, comprising;

a toner as a one-component developer, having at least toner particles containing at least a binder resin and a colorant, and an external additive fine powder;

a developing container for holding the one-component developer therein; and a developer carrying member for carrying the one-component developer held in the developing container and transporting the developer to the developing zone;

wherein;

in circularity distribution of particles and in particle size distribution on the basis of circle-corresponding diameter, measured with a flow type particle image analyzer, said toner has an average circularity of from 0.950 to 0.995, and contains particles with circle-corresponding diameters of from 0.60 μm to less than 2.00 μm, having a maximum value X in the region of circle-corresponding diameters of from 3.0 μm to 9.0 μm and having a maximum value Y in the region of circle-corresponding diameters of from 0.6 μm to 2.00 μm, in an amount of from 8.0% by number to 30.0% by number; and said external additive fine powder has, on the toner particles, at least an inorganic fine powder (A) having as primary particles a number-average particle length of from 1 mμm to less than 30 mμm and a non-spherical inorganic fine powder (B) formed by coalescence of a plurality of primary particles having an average value of Feret's diameter minimun width of from 30 mμm to 200 mμm and having a shape factor SF-1 greater than 150 and a number-average particle length of from 30 mμm to 600 mμm.

75. The apparatus unit according to claim 74, wherein, in circularity distribution of particles measured with the flow type particle image analyzer, said toner has an average circularity of from 0.960 to 0.995.

76. The apparatus unit according to claim 74, wherein said inorganic fine powder (A) has, on the toner particles, a number-average particle length of from 1 mμm to 25 mμm as primary particles.

77. The apparatus unit according to claim 74, wherein said inorganic fine powder (A) has, on the toner particles, a ratio of particle length to particle breadth, length/breadth ratio, of from 1.0 to 1.5.

78. The apparatus unit according to claim 74, wherein said non-spherical inorganic fine powder (B) has, on the toner particles, a number-average particle length of from 30 mm to 300 mμm.

79. The apparatus unit according to claim 74, wherein said inorganic fine powder (A) has a specific surface area of from 50 $m^2/g$ to 150 $m^2/g$ as measured by nitrogen adsorption according to the BET method.

80. The apparatus unit according to claim 74, wherein said non-spherical inorganic fine powder (B) has a specific surface area of from 20 $m^2/g$ to 90 $m^2/g$ as measured by nitrogen adsorption according to the BET method.

81. The apparatus unit according to claim 74, wherein said inorganic fine powder (A) has, on the toner particles, a shape factor SF-1 of from 100 to 125.

82. The apparatus unit according to claim 74, wherein said non-spherical inorganic fine powder (B) has, on the toner particles, a shape factor SF-1 greater than 190.

83. The apparatus unit according to claim 74, wherein said non-spherical inorganic fine powder (B) has, on the toner particles, a shape factor SF-1 greater than 200.

84. The apparatus unit according to claim 74, wherein, on the toner particles, said inorganic fine powder (A) comprises primary particles present individually or in an aggregated state;

the primary particles of said inorganic fine powder (A) being present on the toner particle surfaces in a number of at least 20 particles in total on the average per unit area of 0.5 μm×0.5 μm, and said non-spherical inorganic fine powder (B) being present on the toner particle surfaces in a number of from 1 to 20 particles on the average per unit area of 1.0 μm×1.0 μm, as viewed on an electron microscope magnified photograph of the toner.

85. The apparatus unit according to claim 74, wherein, on the toner particles, said inorganic fine powder (A) comprises primary particles present individually or in an aggregated state;

the primary particles of said inorganic fine powder (A) being present on the toner particle surfaces in a number of at least 25 particles in total on the average per unit area of 0.5 μm×0.5 μm, and said non-spherical inorganic fine powder (B) being present on the toner particle surfaces in a number of from 2 to 18 particles on the average per unit area of 1.0 μm×1.0 μm, as viewed on an electron microscope magnified photograph of the toner.

86. The apparatus unit according to claim 74, wherein said toner contains said inorganic fine powder (A) in an amount of form 0.1 part by weight to 3.0 parts by weight based on 100 parts by weight of the toner.

87. The apparatus unit according to claim 74, wherein said toner contains said non-spherical inorganic fine powder (B) in an amount of form 0.1 part by weight to 3.0 parts by weight based on 100 parts by weight of the toner.

88. The apparatus unit according to claim 74, wherein said inorganic fine powder (A) and said non-spherical inorganic fine powder (B) each have particles selected from the group consisting of silica, alumina, titania and a double oxide of any of these.

89. The apparatus unit according to claim 74, wherein said inorganic fine powder (A) and said non-spherical inorganic fine powder (B) each have fine silica powder.

90. The apparatus unit according to claim 74, wherein said inorganic fine powder (A) and said non-spherical inorganic fine powder (B) each have silicone oil.

91. The apparatus unit according to claim 74, wherein said toner particles are particles produced by polymerization in which a polymerizable monomer composition containing at least a polymerizable monomer and the colorant is polymerized in a liquid medium in the presence of a polymerization initiator.

92. The apparatus unit according to claim 74, wherein said toner particles are particles produced by suspension polymerization in which a polymerizable monomer composition containing at least a polymerizable monomer and the colorant is polymerized in an aqueous medium in the presence of a polymerization initiator.

93. The apparatus unit according to claim 74, wherein said toner is a non-magnetic toner.

94. The apparatus unit according to claim 74, which further comprises, in addition to said one-component developer, said developing container and said developer carrying member, a member selected from the group consisting of a latent image bearing member for holding thereon an electrostatic latent image, a charging member for charging the latent image bearing member electrostatically, and a cleaning member for cleaning the surface of the latent image bearing member.

95. The apparatus unit according to claim 74, which further comprises, in addition to said one-component developer, said developing container and said developer carrying member, an electrophotographic photosensitive member as a latent image bearing member for holding thereon an electrostatic latent image.

* * * * *

UNITED STATES PATENT AND TRADEMARK OFFICE

CERTIFICATE OF CORRECTION

PATENT NO. : 6,077,636
DATED : June 20, 2000
INVENTOR(S) : Yuji Moriki et al.

It is certified that error appears in the above-identified patent and that said Letters Patent is hereby corrected as shown below:

Title page,
Item [56] REFERENCES CITED:

Insert at U.S. Patent Documents

| | | |
|---|---|---|
| -- 4904558 | 2/90 | Nagatsuka et al. ....430/122 |
| 5637432 | 1/97 | Okado et al. .....430/110 |
| 5774771 | 6/98 | Kukimoto et al. ....399/223 --. |

Insert, -- FOREIGN PATENT DOCUMENTS

| | | |
|---|---|---|
| 0564002 | 10/93 | Europe |
| 0658816 | 6/95 | Europe |
| 0729075 | 8/96 | Europe |
| 032060 | 3/80 | Japan |
| 165082 | 9/84 | Japan |
| 136439 | 5/96 | Japan --. |

Insert, -- OTHER PUBLICATIONS
Lee et al., "The Glass Transition Temperatures of Polymers", Polymer Handbook, 2nd Ed., Publ. by John Wiley & Sons, pp. III-139 to III-191 (1971). --.

Column 2
Line 36, "ticles" should read -- ticles against --.

Column 7
Line 45, "acton" should read -- action --.

Column 8
Line 44, "seconds" should read -- second --.

Column 9
Line 39, "24.51-25.25" should read -- 24.54-25.25 --.

Column 10
Line 8, "as" should be deleted.

UNITED STATES PATENT AND TRADEMARK OFFICE

CERTIFICATE OF CORRECTION

PATENT NO. : 6,077,636
DATED : June 20, 2000
INVENTOR(S) : Yuji Moriki et al.

It is certified that error appears in the above-identified patent and that said Letters Patent is hereby corrected as shown below:

Column 11
Line 41, "weight out" should read -- weighed --;
Line 43, "1.0 x $10^3$ mmHg" should read -- 1.0 x $10^{-3}$ mmHg --;
Line 66, "be not" should read -- not be --.

Column 16
Line 16, "mount" should read -- amount --;
Line 20, "can not" should read -- cannot --;
Line 32, "can not" should read -- cannot --.

Column 18
Line 33, "compound, the" should read -- compounds, they --.

Column 19
Line 23, "the" (second occurrence) should be deleted --.

Column 26
Line 45, "can not" should read -- can --.

Column 27
Line 46, "can not" should read -- cannot --.

Column 28
Line 48, "made less occur." should read -- reduced --;
Line 50, "made less occur." should read -- reduced --.

Column 29
Line 45, "less occur." should read -- occur less. --;
Line 64, "less occur." should read -- occur less. --.

Column 30
Line 35, "filed" should read -- field --;
Line 41, "become contact" should read -- come in contact --.

Column 31
Line 26, "become contact" should read -- come in contact --.

Column 32
Line 40, "stainless" should read -- stainless steel --.

UNITED STATES PATENT AND TRADEMARK OFFICE

CERTIFICATE OF CORRECTION

PATENT NO. : 6,077,636
DATED : June 20, 2000
INVENTOR(S) : Yuji Moriki et al.

It is certified that error appears in the above-identified patent and that said Letters Patent is hereby corrected as shown below:

Column 33
Line 66, "gap a" should read -- gap α --.

Column 34
Line 33, "Ri" should read -- R1 --.

Column 35
Line 17, "can not" should read -- cannot --;
Line 36, "(e,g," should read -- (e.g., --;
Line 62, "can not" should read -- cannot --.

Column 36
Line 14, "can not" should read -- cannot --;
Line 55, "sate" should read -- state --.

COLUMN 42
Line 59, "6 μm." should read -- 30 μm --.

Column 45
Line 63, "was" should read -- were --.

Column 47
Line 49, "were" should read -- was --.

Column 56
Line 49, "the" should read -- a --;
Line 55, "comprising" should read -- comprising: --.

Column 58
Line 41, "comprising" should read -- comprising: --.

Column 60
Line 26, "comprising;" should read -- comprising: --;
Line Line 63, "and" (second occurrence) should be deleted --.

UNITED STATES PATENT AND TRADEMARK OFFICE

CERTIFICATE OF CORRECTION

PATENT NO. : 6,077,636
DATED : June 20, 2000
INVENTOR(S) : Yuji Moriki et al.

It is certified that error appears in the above-identified patent and that said Letters Patent is hereby corrected as shown below:

COLUMN 63
Line 32, "of" (first occurrence) should read -- on --;
Line 38, "touch" should read -- contact --.

Signed and Sealed this

Eleventh Day of September, 2001

Nicholas P. Godici

*Attest:*

*Attesting Officer*

NICHOLAS P. GODICI
*Acting Director of the United States Patent and Trademark Office*